US006553599B2

(12) United States Patent
Paterson et al.

(10) Patent No.: US 6,553,599 B2
(45) Date of Patent: Apr. 29, 2003

(54) LOW-PROFILE AND HIGHLY-MANEUVERABLE VACUUM CLEANER HAVING AT LEAST ONE ANTI-INGESTION BAR

(75) Inventors: Chris M. Paterson, Long Beach, MS (US); Javier Verdura, Milford, CT (US); Owen T. Bourgeois, Bay Saint Louis, MS (US); Jeffrey A. Millard, Long Beach, MS (US); Mel Teitzman, Boynton Beach, FL (US); Paul A. Moshenrose, Ocean Springs, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 0 days.

(21) Appl. No.: 09/991,757

(22) Filed: Nov. 21, 2001

(65) Prior Publication Data

US 2002/0038489 A1 Apr. 4, 2002

Related U.S. Application Data

(62) Division of application No. 09/678,280, filed on Sep. 29, 2000.

(51) Int. Cl.[7] ..... A47L 9/00
(52) U.S. Cl. ..... 15/37.8; 15/422
(58) Field of Search ..... 15/378, 422

(56) References Cited

U.S. PATENT DOCUMENTS

| | | | |
|---|---|---|---|
| 1,254,396 | A | 1/1918 | Dance |
| 1,903,793 | A | 4/1933 | Richardson et al. |
| 1,926,370 | A | 9/1933 | Clements |
| 2,114,630 | A | 4/1938 | Dow |
| 2,216,709 | A | 10/1940 | Langille |
| 2,239,762 | A | 4/1941 | Taylor |
| 2,668,979 | A | 2/1954 | MacFarland |
| 3,286,296 | A | 11/1966 | Waters |
| 3,733,640 | A | 5/1973 | Finberg et al. |
| 4,285,092 | A | 8/1981 | Schmitz |

*Primary Examiner*—Chris K. Moore
(74) *Attorney, Agent, or Firm*—Faegre & Benson LLP

(57) ABSTRACT

A low-profile and highly-maneuverable vacuum cleaner having improved functionality including, alone or in combination, a headlight, a sidelight, anti-ingestion bars, side brushes, a squeegee, and a scent cartridge for use in cleaning floors, floor coverings, carpets, upholstery, and other surfaces. One embodiment includes a tortuous air flow path created by baffles that divert air flow. The tortuous path creates quieter air flow through the vacuum housing. The tortuous air flow arrangement is for cooling the internal parts of a vacuum cleaner. Another embodiment includes an indicator light assembly for the vacuum cleaner visually providing the user with the vacuum's current operation status. In another embodiment, the rear wheels are recessed within the head housing and slightly offset rearwardly of the rear wall of the head housing to provide enhanced maneuverability.

38 Claims, 36 Drawing Sheets

LOW-PROFILE AND HIGHLY-MANEUVERABLE VACUUM CLEANER HAVING AT LEAST ONE ANTI-INGESTION BAR

CROSS-REFERENCE TO RELATED APPLICATION

This application is a division of U.S. utility application Ser. No. 09/678,280, filed Sep. 29, 2000, now pending (the '280 application). The '280 application is hereby incorporated by reference as though fully set forth herein.

BACKGROUND OF THE INVENTION a. Field of the Invention

The present invention relates to cleaning machines. More specifically, it relates to low-profile and highly-maneuverable vacuum cleaners having a headlight, a sidelight, anti-ingestion bars, side brushes, a squeegee, a scent cartridge, and other performance enhancing features for use in cleaning floors, floor coverings, carpets, upholstery, and other surfaces.

b. Background Art

Individuals often use cleaning machines, such as vacuum cleaners or carpet sweepers, to clean floors, floor coverings, carpets, upholstery, and other surfaces. The typical cleaning machine has a base or head, such as a power nozzle on a vacuum cleaner, that is moved over the surface to be cleaned. In some cleaning machines, suction is provided, which draws particles and debris from a section of the surface being cleaned into the cleaning machine, where the dirty air is passed through a bag in which the entrained particles are captured.

An agitator is often rotatably attached to the base or head to improve the effectiveness of the cleaning machine. The agitator typically has one or more projections that impinge on the surface being cleaned as the agitator rotates. A vacuum cleaner, for example, may have a roller brush with bristles that brush the surface as the base or head is moved across the surface to be cleaned. As the vacuum cleaner moves over the surface, the roller brush rapidly rotates and the bristles repeatedly impinge on the surface. This contact between the bristles and the surface agitates dirt and other particles from the surface and improves the effectiveness of the vacuum cleaner. A carpet sweeper has a rotating blade that similarly impinges the surface being cleaned. An example of such a device is illustrated in U.S. Pat. No. 4,646,380.

In the past there have been few attempts to control the flow of cooling air through a vacuum head. Thus, a large noise source during vacuum cleaner operation stems from the uncontrolled flow of working and cooling air through the vacuum head. Thus, there remains a need for controlled flow of both working and cooling air through the vacuum head to reduce the amount of noise generated by the vacuum during operation.

In powered vacuums, it is know to shape or contour the bottom cover to improve the efficiency of air movement from the edges of the vacuum to the intake aperture. An example of such contouring of the bottom cover is shown in U.S. Pat. No. 4,219,902. There remains a need, however, for improvement in both the design and location of these channels to further enhance the air flow from the outer edges of the vacuum head housing to the intake aperture of the vacuum.

In the art of vacuum cleaner design, it is desirable to maximize the surface area cleaned with respect to the surface area covered by the footprint of the vacuum head. One such way to maximize the surface area cleaned is to includes side brushes on the vacuum to draw in debris laterally outside the surface area covered by the footprint of the vacuum head.

Prior art side brushes generally consist of tufts of bristles designed to sweep the debris toward the vacuum's suction inlet. An example of such side brushes is disclosed in U.S. Pat. No. 4,219,902. While these prior art bristle side brushes do generally increase the surface area cleaned with respect to the surface area covered by the footprint of the vacuum head, in addition to other drawbacks they often fail to maximize the desired cleaning effect. These bristle-type side brushes are generally straight or only angled in one direction. Such a design often acts like a snow-plow, merely piling or pushing debris along the surface of the floor, or "flicking" the debris ahead of the vacuum rather than desirably directing the debris into the suction inlet. In addition, prior art side brushes are often designed to work in only one direction (i.e., they only work to sweep the debris when the vacuum is moving in a forward motion).

Other drawbacks to prior art bristle side brushes include the fact that the prior art side brushes often wear rapidly and require frequent service. Such service is often complicated by the fact that the prior art bristle side brushes are often mounted from the inside of the vacuum head and cannot be serviced from the outside of the vacuum. Additionally, prior art side brush designs are often not interchangeable from one lateral side to the other lateral side of the vacuum (i.e., the right side brush cannot be used on the left side of the vacuum and vice versa). Finally, the prior art bristle side brushes often fail to offer any protection for the wall or wall molding when the vacuum inadvertently comes in contact with the wall or wall molding.

There is a need for a vacuum side brush that more effectively directs debris toward the vacuum's suction inlet to help maximize the surface area cleaned with respect to the vacuum's footprint. There is a need for a vacuum side brush that directs debris toward the suction inlet both when the vacuum is being moved forward and backward (i.e., being pushed and pulled). There is a need for a vacuum side brush that is easily serviceable from the outside of the vacuum head. There is a need for a vacuum side brush that is interchangeable from one lateral side of the vacuum head to the other (i.e., a single side brush that can be used on either lateral side of the vacuum head). Finally, there is a need for a vacuum side brush that can serve as a de facto bumper to help protect the wall or wall molding when the vacuum inadvertently comes in contact with the wall or wall molding.

In the art of vacuum cleaners, most vacuum cleaners include some form of roller brush surrounded by a suction inlet. When vacuuming, the roller brush comes in contact with the floor surface to help guide debris into the vacuum's suction inlet. Most debris encountered by the roller brush and ultimately the suction inlet is of a particle size that is easily guided by the roller brush into the suction inlet. However, occasionally the operator of the vacuum will encounter larger sized debris, such as articles of clothing, paper items, children's toys, and the power cord of the vacuum.

The introduction of larger sized items can cause the roller brush to become entangled with the items or cause the suction inlet of the vacuum to become plugged. Entanglement of the roller brush can lead to severe damage of the vacuum motor. In addition, a vacuum will fail to operate correctly with a plugged suction inlet and can also be damaged if either the plug is not promptly removed or the vacuum power terminated.

Prior art vacuums often rely on the operator of the vacuum to prevent larger sized debris from being introduced to either the roller brush or the suction inlet. Prior art vacuums often fail to provide safeguards to prevent roller brush entanglement or clogging of the suction inlet.

There is a need for an apparatus to be included in a vacuum cleaner assembly that will prevent the introduction of larger sized debris to both the vacuum roller brush and the suction inlet.

Because in most vacuum cleaners the roller brush and suction inlet are located towards the front portion of the vacuum head housing, the front portion of most vacuum head housings is apertured. As a result, the structural integrity of the front portion of most vacuum head housings is weakened.

There is a need for an apparatus to be included in a vacuum cleaner assembly that will increase the structural integrity of the front portion of the vacuum head housing.

The squeegee structure on a vacuum serves an important role in the efficacy of the vacuum's performance. Past squeegee structures were permanently or semi-permanently attached to the bottom of the vacuum, and were not meant to be replaced or repaired. In addition, the channel that the squeegee was located within was often made of metal, which could become nicked or burred, which in turn increased the chances of scratching the floor when the vacuum was used. Further, the blade was attached to the bottom of the vacuum by a separate flexible material, such as tape, in only a few discrete locations. The discreet attachment points are prone to wear and tear, and did not provide a consistent flex across the length of the blade. There is a need in the art for a squeegee structure that is integral to the vacuum structure, and that is securely attached to the bottom of a vacuum, that does not wear to scratch the vacuumed surfaces, and that is easily replaceable.

Oftentimes vacuuming is performed in poorly lit areas such as under furniture, within closets, and the like. Lighting is necessary when vacuuming to allow the user to determine if the area being vacuumed is dirty, and if the area, after it has been vacuumed, has been cleaned successfully.

Prior art vacuum lighting systems generally include only a headlight situated near the front of the vacuum head cover. These prior art lighting systems have several drawbacks. First, prior art lighting systems generally project light well in front of the vacuum and not directly in front of the vacuum where debris is about to be vacuumed. Projecting light well in front of the vacuum detracts from the user's ability to see what is directly in the path of the vacuum.

Second, the light from prior art systems is generally cast over a wide area because the light is projected well in front of the vacuum. This diminishes the effectiveness of the lighting system. One solution to this problem is providing a vacuum with brighter lights. Brighter lights, however, require more power, which in turn requires a more powerful and generally heavier motor than vacuums with less powerful lights. Adding weight to the vacuum is undesirable because it generally reduces the mobility of the vacuum, and it generally causes the user of the vacuum to fatigue quicker than using a lighter vacuum.

A third drawback is that prior art lighting systems do not have side lighting. Oftentimes, vacuums are fitted with side brushes that clean the area directly to the sides of the vacuum. Without side lighting the debris to the sides of the vacuum in dimly lit areas is difficult to see. Hence, the user will have a difficult time determining if the area to the side of the vacuum is dirty and if vacuuming the area cleaned the area successfully. Moreover, when vacuuming in areas such as under a desk where the user may not be able to see directly in front of the vacuum, a sidelight would illuminate the area to the side of the vacuum that the user can see and hence allow the user to determine visually if the area under the desk is dirty and if the area has been cleaned successfully.

Accordingly, there is a need for a vacuum with a lighting system that lights the area directly in front of the vacuum and the area to the side of the vacuum. Moreover, there is a need for a vacuum that optimizes the brightness of the lighting system without adding weight to the vacuum.

During the operation of prior art vacuums, it is known to direct the air flow through one or more different filters as the air is drawn into, through and out from the vacuum. It remains desirable, however, to take fuller advantage of the possibilities for improving the desirability of using a vacuum by maximizing the benefit obtained from the air flow already present in the vacuum head.

Although it is well-known in the prior art to put a plurality of wheels on the underside of the vacuum head to facilitate ease of use and reduce wear to the surface being vacuumed, there remains a need for further optimization in the placement of such wheels. For example, the placement of the wheels on the underside of the head can effect the maneuverability of the vacuum and how convenient it is to use the vacuum and to move the vacuum from one working location to another.

BRIEF SUMMARY OF THE INVENTION

It is desirable to have a low-profile and highly-maneuverable vacuum cleaners having improved functionality including, alone or in combination, a headlight, a sidelight, anti-ingestion bars, side brushes, a squeegee, and a scent cartridge for use in cleaning floors, floor coverings, carpets, upholstery, and other surfaces. Accordingly, it is an object of the disclosed invention to provide such an improved vacuum cleaner.

In one embodiment of the present invention the head housing of the vacuum defines a tortuous air flow path. The path is made tortuous by placement of baffles that divert air flow. The tortuous path creates quieter air flow through the vacuum housing. The tortuous air flow arrangement is for cooling the internal parts of a vacuum cleaner. The air flow arrangement includes air intake slots on the top cover. The arrangement further includes at least one baffle attached to an interior portion of the head housing and positioned in the path of the air flow entering the intake slots. Finally, the arrangement also includes cooling vanes attached to the drive shaft and positioned in the path of the air flow in said head housing, wherein the at least one baffle and the cooling vanes slow the air flow and direct the air flow towards said internal parts thereby cooling the parts.

In yet another form, the vacuum cleaner of the present invention includes side brushes that employ spring-action blades similar to windshield wiper blades instead of tufts of bristles to overcome the drawbacks of prior art side brushes and to maximize the surface area cleaned. The combination of rubberized blade-like materials and dual-angled blades helps minimize the "snow-plowing" and "flicking" problems often encountered in prior art side brushes. The dual-angled blades serve to more effectively direct debris towards the vacuum's suction inlet. In addition, the dual-angled blades perform effectively during both pulling and pushing strokes of the vacuum. All of the above features of the present invention vacuum side brush design combine to maximize the surface area cleaned by the vacuum with respect to the surface area covered by the footprint of the vacuum.

The present invention side brushes also solve the service difficulties often found in the prior art. The present invention side brushes are easily serviced or replaced from the outside of the vacuum head housing by removing one screw. In addition, to further ease serviceability, the present invention dual-blade design is also interchangeable with respect to the vacuum head housing (i.e., a right-side blade can be used on the left side of the vacuum head housing and vice-versa) thereby reducing necessary parts inventory. Finally, the rubberized construction of the present invention side brushes effectively acts as a de facto bumper when the vacuum inadvertently comes into contact with surfaces that are lower than the height of the actual vacuum bumper.

The vacuum cleaner side brush is comprised of a substantially flat connection surface having a length, a width, a top connection surface, a bottom connection surface, and at least one blade. The blade is joined to and extends down from the bottom connection surface and includes a bottom blade surface. The side brush also includes a connection means for connecting the side brush to the head housing of the vacuum cleaner. In a preferred embodiment, the connection means is an aperture and a screw for screwing the side brush to the head housing.

In one embodiment of the present invention, an anti-ingestion bar for the vacuum includes at least two side arms including anti-ingestion portions with a front bar portion extending between the side arms. The front portion includes at least one lateral support portion.

In one embodiment of the present invention, a squeegee is attached to the bottom of a vacuum head. The squeegee includes a main body attached having a front edge, a rear edge and a middle portion. The middle portion of the squeegee defines a wiper and a flexible hinge continuously attaching the wiper to the middle portion. The squeegee is attached to the bottom of a vacuum head.

Another embodiment of the present invention includes a light assembly for a vacuum. The light assembly includes a reflector assembly having at least one light source. The light assembly further includes a headlight optically coupled with the reflector assembly wherein the at least one light source provides light for the headlight. The light assembly further includes a sidelight optically coupled with the reflector assembly wherein the at least one light source provides light for the sidelight. The light assembly generally illuminates the area to the front and the area to the side of the vacuum. The reflector assembly further includes a headlight reflector optically coupled with the light source and a headlight lens. The headlight reflector defines a generally vertical reflective surface defining at least one plane of curvature, the generally vertical reflective surface defining a focal region wherein the light source is positioned generally within the focal region. Light from the light source is reflected from the generally vertical reflective surface toward the headlight lens.

Another embodiment of the present invention includes a vacuum having a light assembly having a reflector assembly having a light source. The light assembly further includes a sidelight optically coupled to the reflector assembly, wherein the light source is adapted to provide light to the sidelight, and whereby the sidelight is adapted to illuminate the area downwardly and to the side of the vacuum. In yet another embodiment of the present invention, a lens for the light assembly includes a front face and a rear face defining a refraction contour, the refraction contour adapted to direct light incident on the refraction contour downwardly and forwardly of the vacuum.

Another embodiment of the present invention includes a vacuum having a headlight. The vacuum including a vacuum head housing defining a headlight cavity with a rear wall and a front portion. The vacuum further includes a reflector assembly attached with the vacuum head housing within the headlight cavity and a headlight lens housing releasably attached with the vacuum head housing adjacent the front portion of the vacuum head housing. The vacuum further includes a headlight lens releasably attached with the headlight lens housing.

In yet another embodiment of the present invention, a scent cartridge assembly for a vacuum cleaner includes a scent cartridge compartment disposed in the upper housing of the vacuum proximate the motor. A scent cartridge is positioned in the scent cartridge compartment. There is a scent cartridge cover removably attached to the upper housing to secure the scent cartridge housing into the scent cartridge compartment. The scent cartridge also includes a pair of exhaust vents disposed through said scent cartridge compartment.

Another embodiment of the present invention includes an indicator light assembly for the vacuum cleaner. The indicator light assembly includes a light pipe indicator unit and a circuit board. The light assembly further includes an elliptical recess in the top cover of the vacuum head for receiving the light pipe indicator unit. LEDs on the circuit board are operable to selectively illuminate upon the occurrence of a predetermined condition. The light assembly further includes at least one light pipe disposed above and slightly displaced from the LEDs, wherein upon illumination of one of the LEDs light from the LED is transmitted to the upper surface for observation by the user.

In another embodiment of the present invention the rear wheels are recessed within the head housing and slightly offset rearwardly of the rear wall of the head housing. This provides enhanced maneuverability and a generally lower overall vertical profile of the vacuum head housing. The rear wheel assembly includes at least one rear wheel positioned adjacent to the front-to-back center line of said vacuum head, with the at least one rear wheel projecting slightly from the back end.

The foregoing and other aspects, features, details, utilities, and advantages of the present invention will be apparent from reading the following description and claims, and from reviewing the accompanying drawings.

DETAILED DESCRIPTION OF THE PREFERRED EMBODIMENTS

The present invention is directed toward the features of a low-profile and highly-maneuverable vacuum cleaner 100

Figure 46:
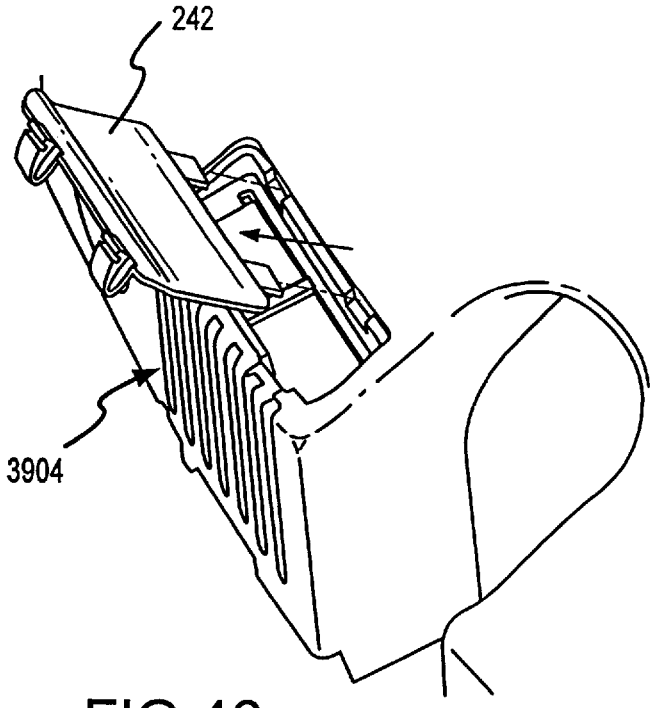
FIG. 46 is similar to FIG. 45, but depicts the scent cartridge cover being removed from the vacuum head.
Figure 47:
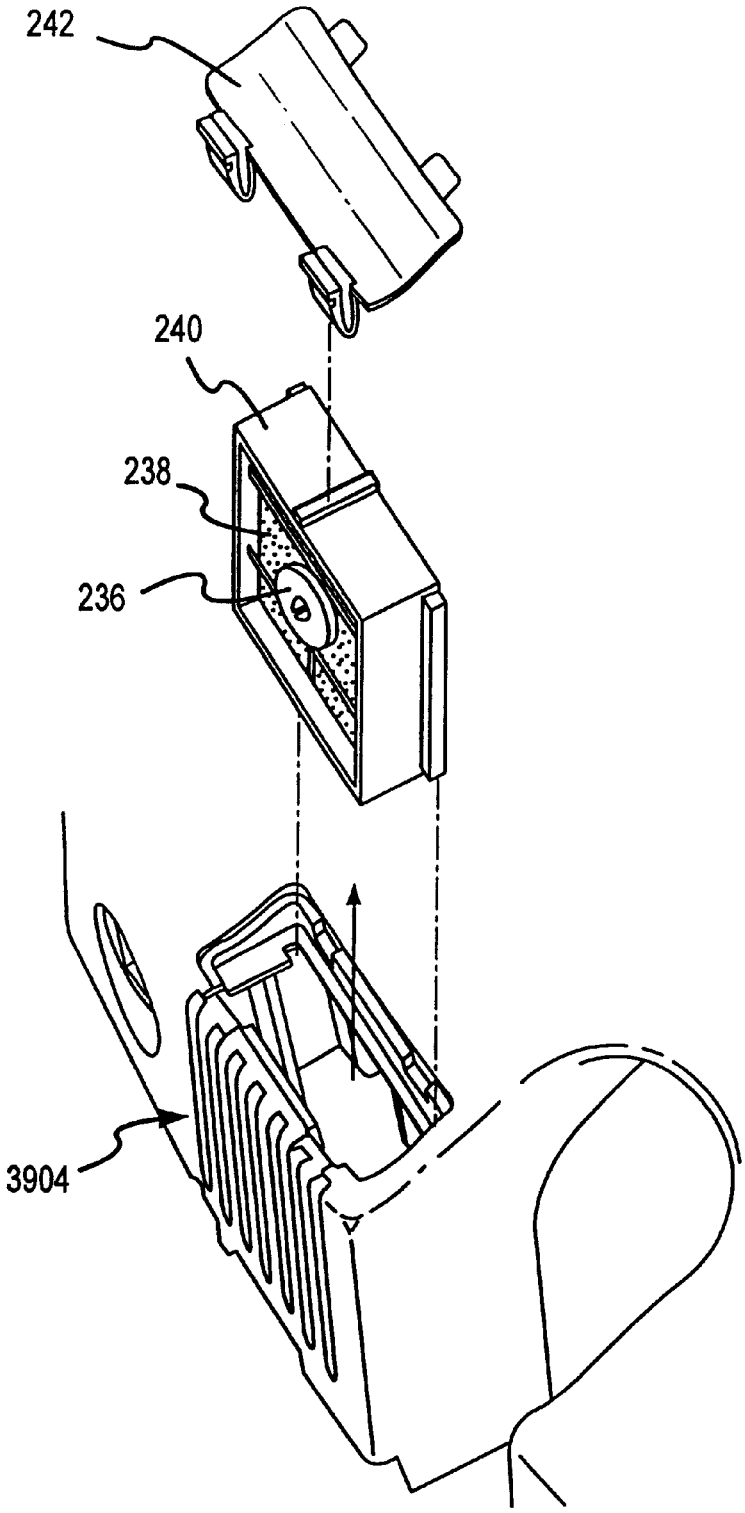
FIG. 47 is a fragmentary, exploded isometric view depicting the scent cartridge cover and scent cartridge holder removed from the vacuum head.
Figure 48:
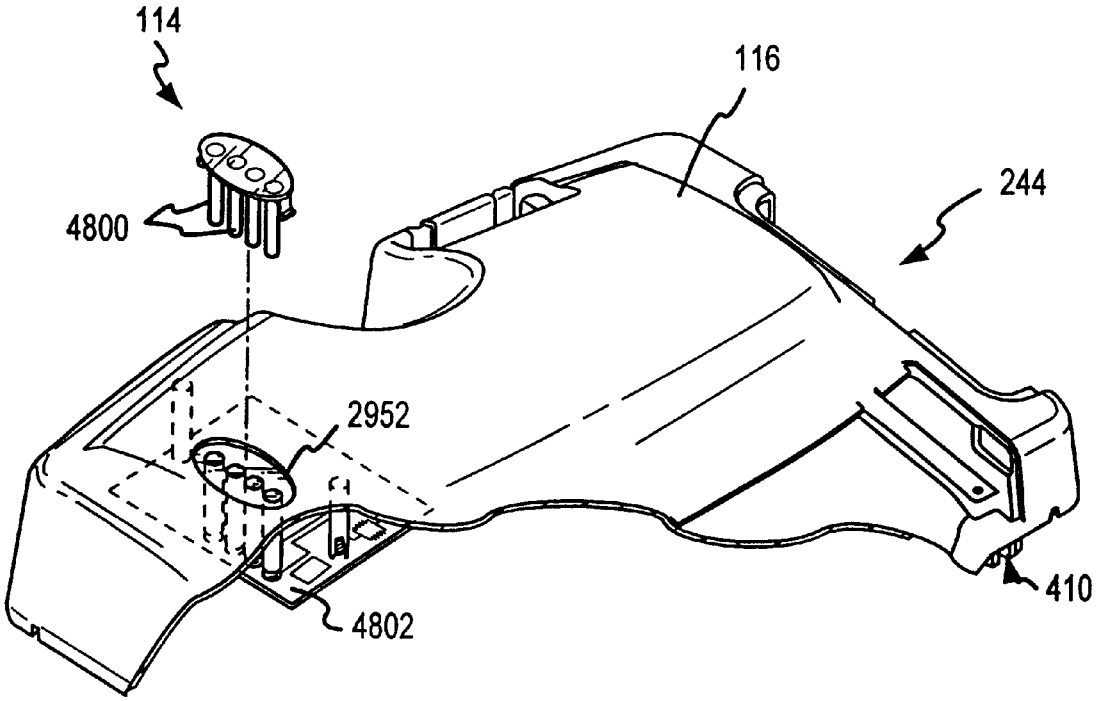
FIG. 48 is a fragmentary, partially-exploded isometric view of the top surface of the headrail housing, depicting the light pipe indicator unit and its associate circuit board.
Figure 49:
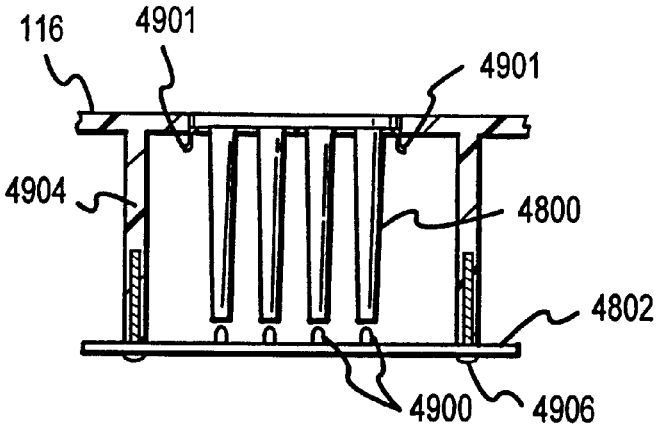
FIG. 49 is a fragmentary cross-sectional view depicting the light pipe indicator unit projecting through the top surface of the head housing and mounted to its associated circuit board.

(FIG. 1) for moving a flow of air and debris or particulate matter 500 (e.g., FIGS. 5 and 22) into the vacuum cleaner 100, where the particulate matter 500 is separated from the air. The illustrated vacuum cleaner 100 is an upright vacuum cleaner, but need not be. Several of these features, which provide improved functionality for the vacuum cleaner 100 when it is used to clean floors 404 (e.g., FIG. 40), floor coverings, carpets, upholstery, and other surfaces, are described below. Included among these features and described further below are velocity slots 412(*a*), 412(*b*), 412(*c*), and 412(*d*) (FIGS. 4–6 and 22), side brushes 410 (FIGS. 4, 5, and 9–14), anti-ingestion bars 1200 (FIGS. 12–14) or 1200' (FIGS. 18–20), a squeegee 1202 (FIGS. 12–14 and 23–28), a headlight 102 (FIG. 1), a sidelight 104 (FIG. 1), a scent cartridge 234 (FIGS. 46 and 47), and a light pipe indicator unit 4800 (FIGS. 48 and 49). These new and improved features may be used alone or in combination.

Figure 1:
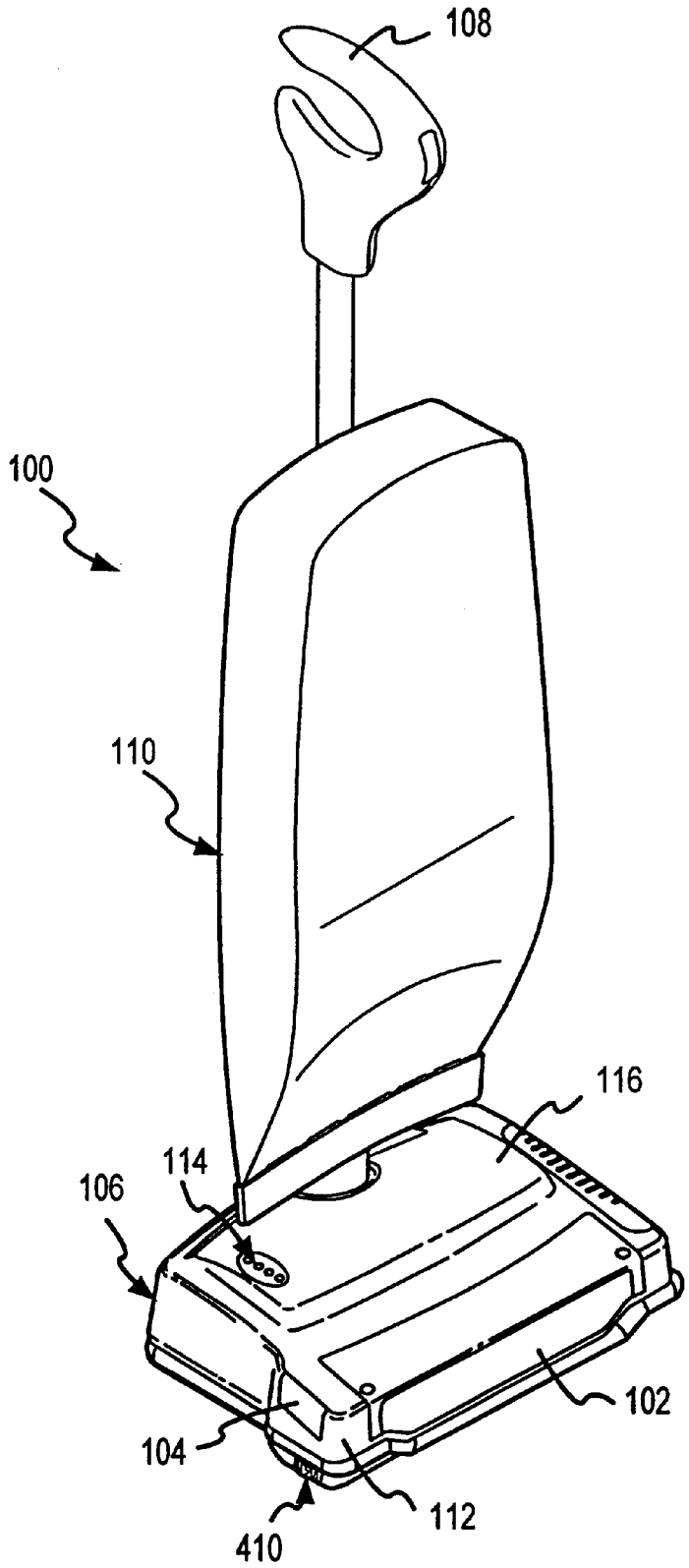
FIG. 1 is an isometric view looking downwardly at the front and top of an upright vacuum according to the present invention.
Figure 2:
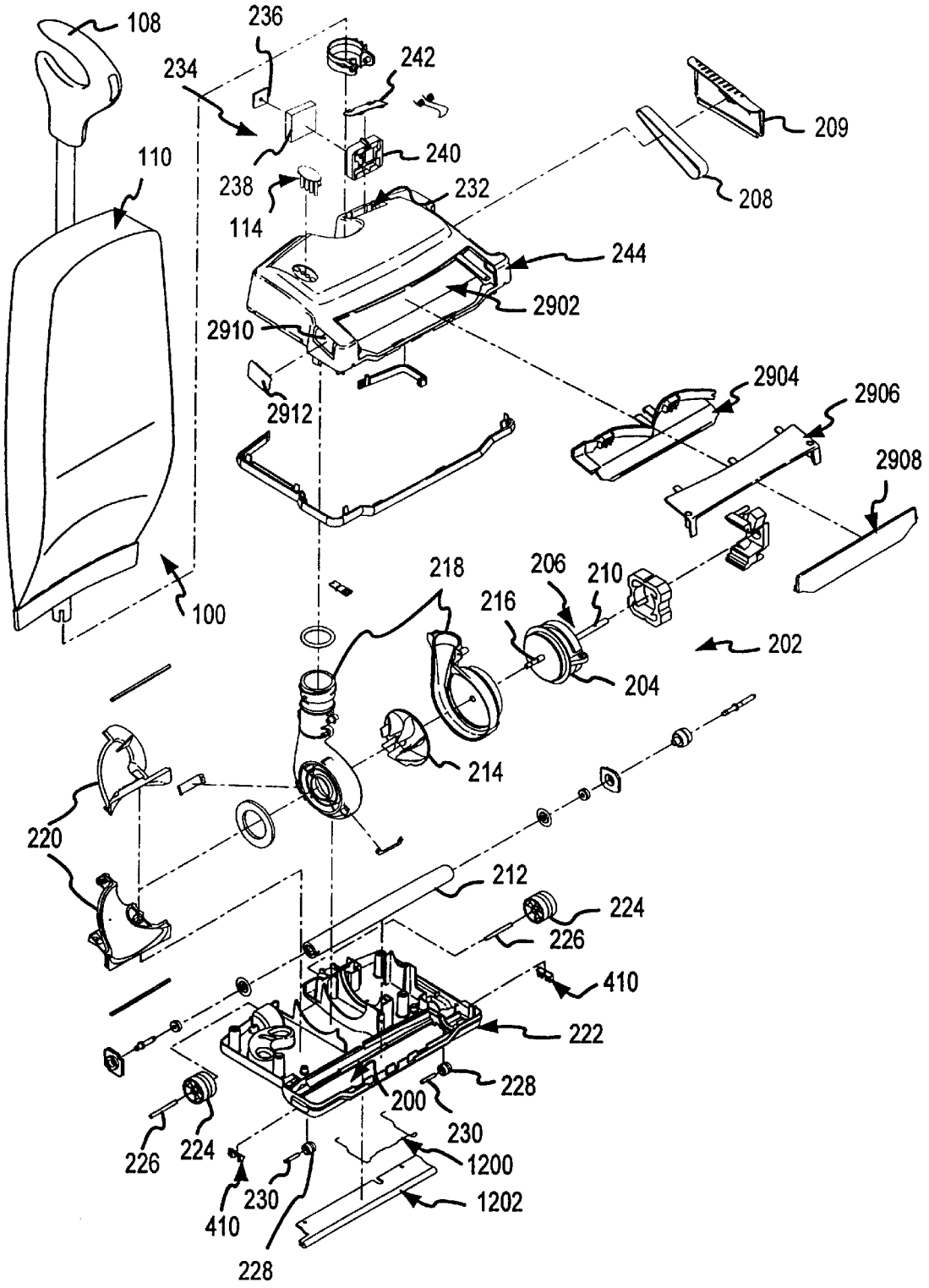
FIG. 2 is an exploded isometric view of the vacuum depicted in FIG. 1.

Referring first to FIGS. 1 and 2, the upright vacuum cleaner 100 may include a vacuum head housing 106 having an intake nozzle or aperture 200 positioned close to the floor surface 404 (e.g., FIG. 4), and a handle 108 that extends upwardly from the head housing 106 so that a user may move the head housing 106 along the floor surface 404. An airflow propulsion device 202 may be disposed within the head housing 106 to create suction at the intake nozzle 200 to draw the particulate matter 500 from the floor surface 404. The airflow propulsion device 202 may then drive or propel a particulate-laden airstream through an exhaust conduit which may, for example, be included within a portion of the handle 108. The particulate-laden airstream may exit from the exhaust conduit into a filter bag (not shown). An outer bag 110 may be disposed about the filter bag to protect the filter bag from blows or contact, which might otherwise damage the filter bag and allow the particulate matter therein to undesirably escape.

In one preferred form, the air flow propulsion device 202 includes a motor 204 having a drive shaft 206. A drive belt 208 is coupled to a first end 210 of the drive shaft 206 and to a rotatable roller brush 212 so that, as the motor 204 turns the drive shaft 206, the roller brush 212 also turns. An impeller 214 is coupled to a second end 216 of the drive shaft 206 and is disposed within a two-piece impeller housing 218. The two-piece impeller housing 218 is slippingly coupled to a suction duct 220.

As shown to good advantage in FIG. 2, and as discussed further below, there are a plurality of wheels rotatably attached to the bottom surface of the head housing bottom cover 222. In the preferred embodiment, there are two rear wheels 224, each of which is rotatably mounted to the bottom cover 222 by rear axles 226. Similarly, a pair of smaller front wheels 228 are rotatably attached to the bottom cover 222 by front axles 230.

A removable access panel 209 covers the drive belt 208 during operation, but permits ready access to the drive belt 208 when required.

As shown in FIG. 2, and as discussed further below in connection with FIGS. 29, 34 and 44–48, the vacuum head housing 106 defines a scent cartridge compartment 232, which accommodates a scent cartridge assembly 234. The scent cartridge assembly includes a scent cartridge or fragrance patch 236, an exhaust air post filter 238, a scent cartridge housing 240, and a scent cartridge compartment cover 242. The scent cartridge compartment is formed in the vacuum head housing 106 adjacent to the motor 204. The scent cartridge cover 242 is removably attached to the head housing top cover 244 to removably secure the scent cartridge housing 240 in the scent cartridge compartment 232.

As also shown in FIG. 1, the vacuum head housing 106 includes a slight projection or protuberance 112. The side light 104 is mounted on this protuberance 112. As discussed further below, the protuberance 112 in the side light 104 improve edge cleaning. For example, when running a vacuum parallel to the face of a cabinet having a toe kick, the side light 104 illuminates the toe kick area, while the protuberance 112 extends into the toe kick area.

As further described below in connection with FIGS. 48 and 49, a light pipe indicator unit 114 is present on the curved upper surface 116 of the top cover 244.

Figure 29:
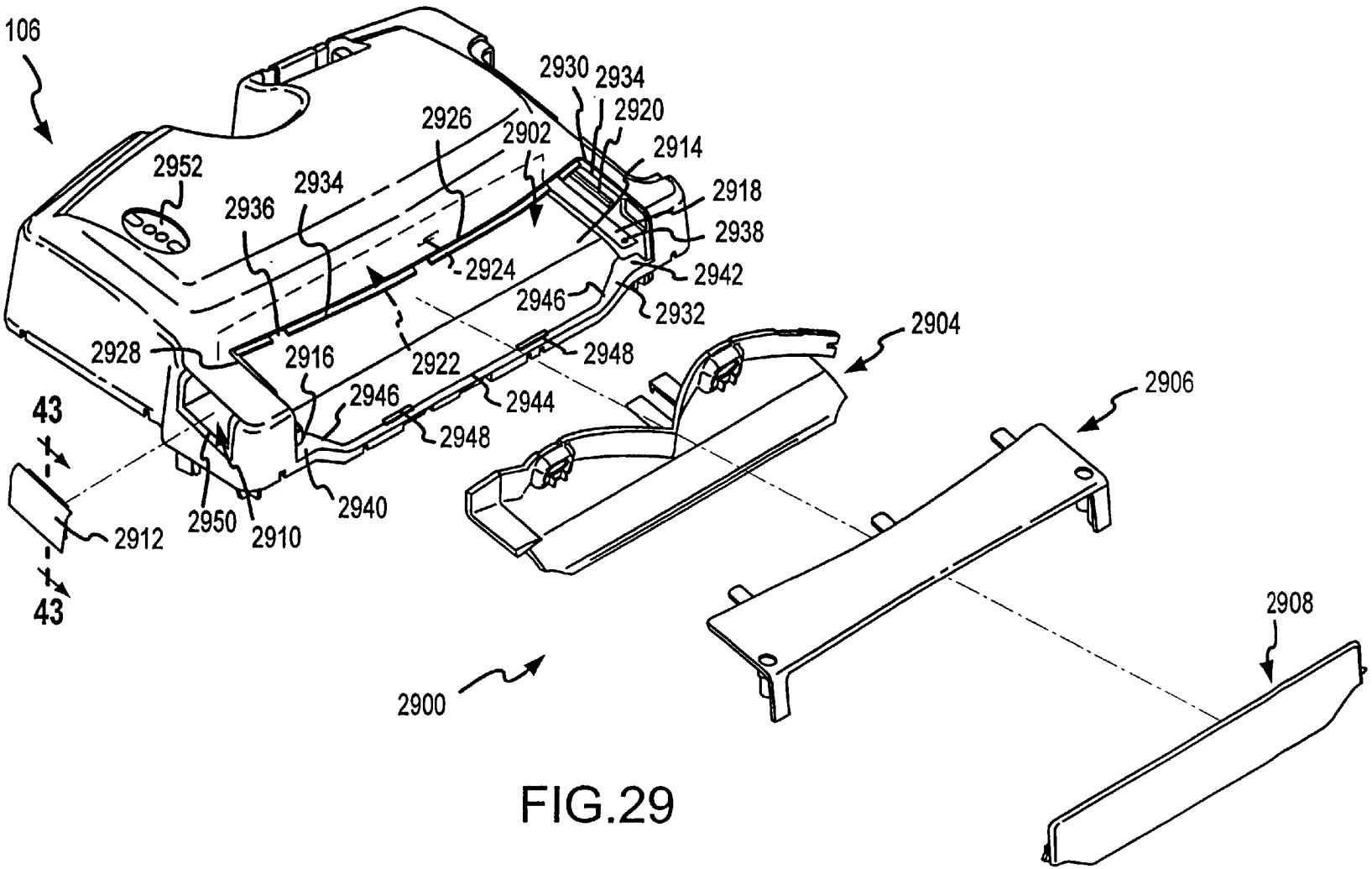
FIG. 29 is an exploded isometric view of a light assembly according to the present invention, including a headlight and a sidelight.

Also shown in FIG. 2 are the components of the headlight assembly, including a reflector assembly 2904, a headlight lens housing 2906, and a headlight lens 2908. As further described below, this headlight assembly fits in the headlight cavity 2902. A side light lens 2912, which is also discussed further below in connection with, for example, FIG. 29, is mounted in a side light cavity 2910.

In the following sections, the components and operational aspects of the improved features of the vacuum cleaner 100 mentioned above are described in greater detail.

Lower Surface of Bottom Cover

Figure 6:
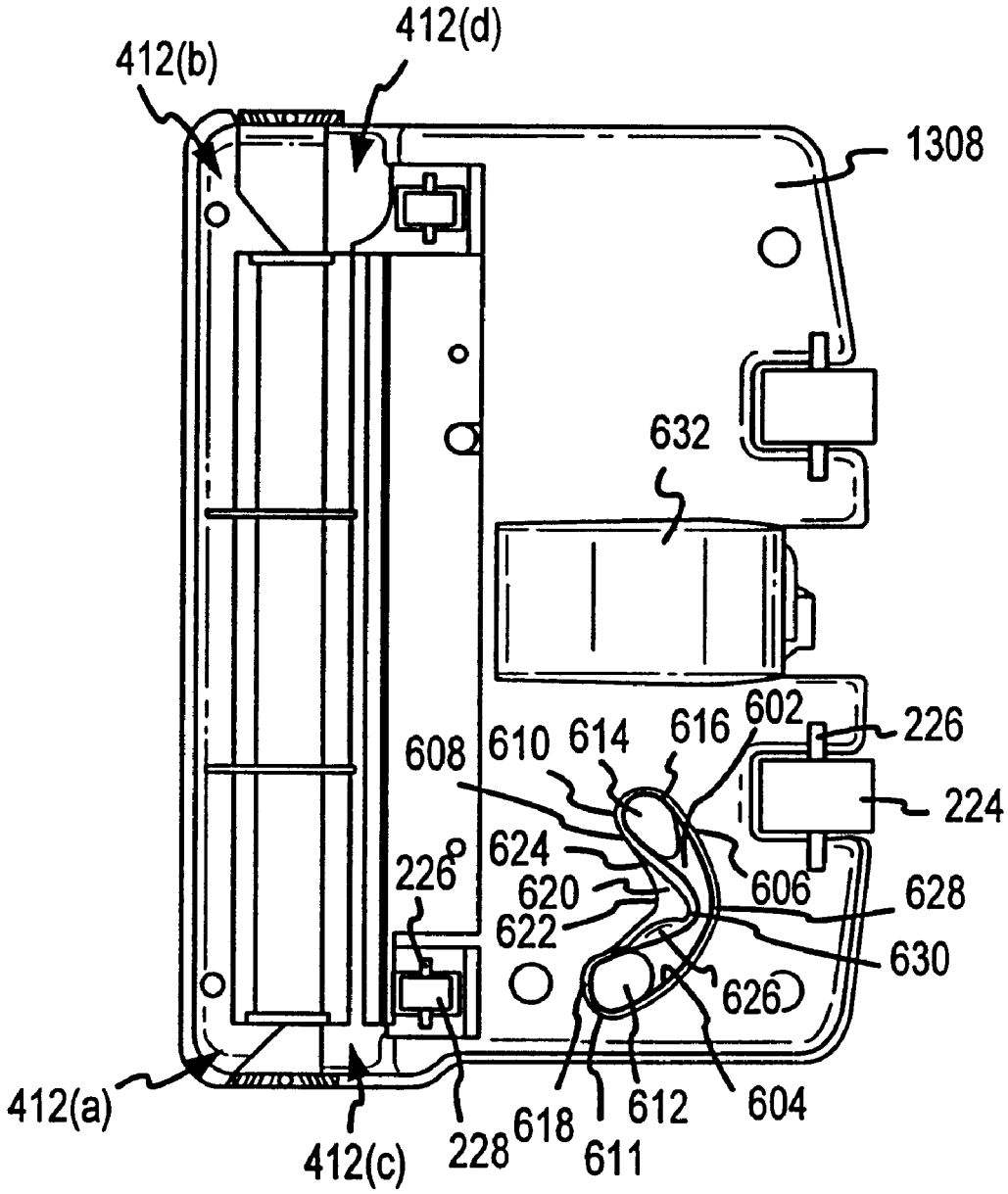
FIG. 6 is an enlarged, bottom plan view of the head and impeller housing depicted in FIGS. 4 and 5.

As shown to good advantage in FIG. 6, the lower surface 1308 of the bottom cover 222 has many features including a storage compartment 602 for a spare or back-up drive belt 604, a pair of rear wheels 224, a pair of front wheels 228, a downwardly bulbous protrusion 632, and velocity slots 412(*a*), 412(*b*), 412(*c*), and 412(*d*). Other features of the lower surface 1308 of the bottom cover 222 including the anti-ingestion bar, the squeegee, and the brush are discussed further below.

Figure 7:
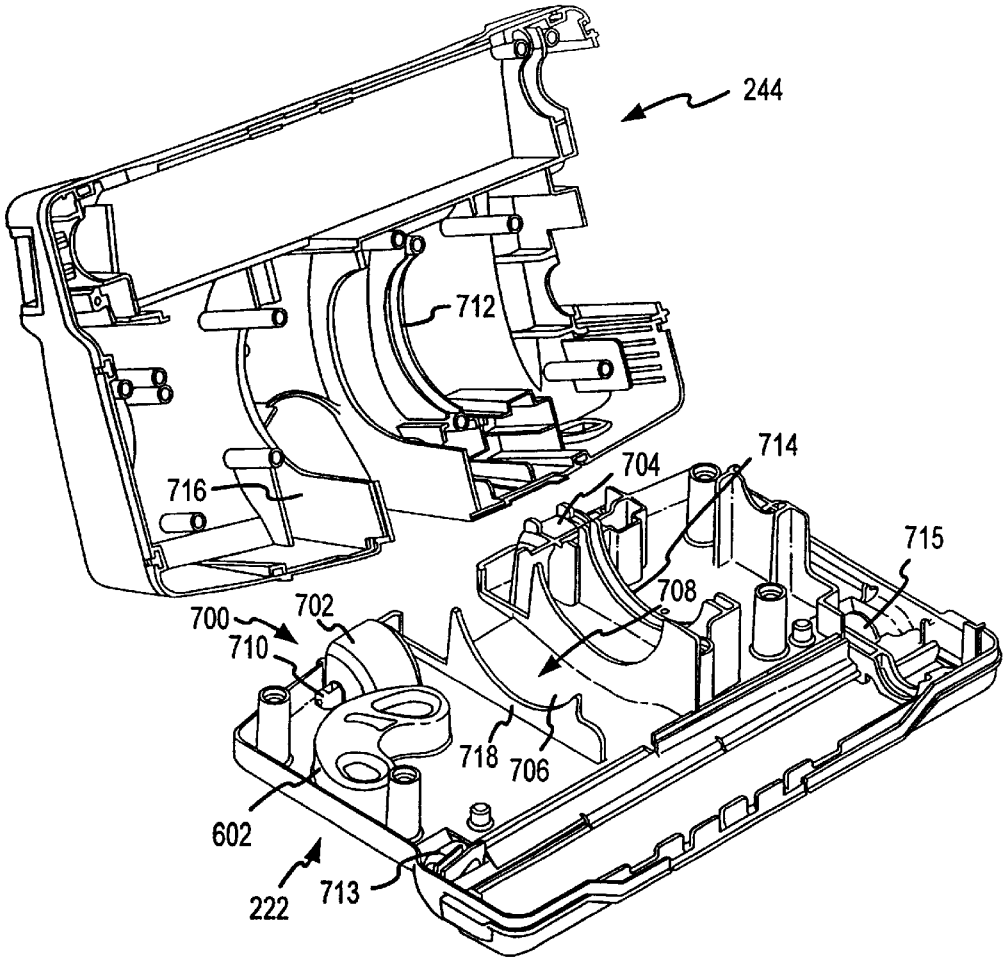
FIG. 7 is an isometric view of the head housing top cover positioned above the head housing bottom cover, exposing the interior of the vacuum head.
Figure 50:
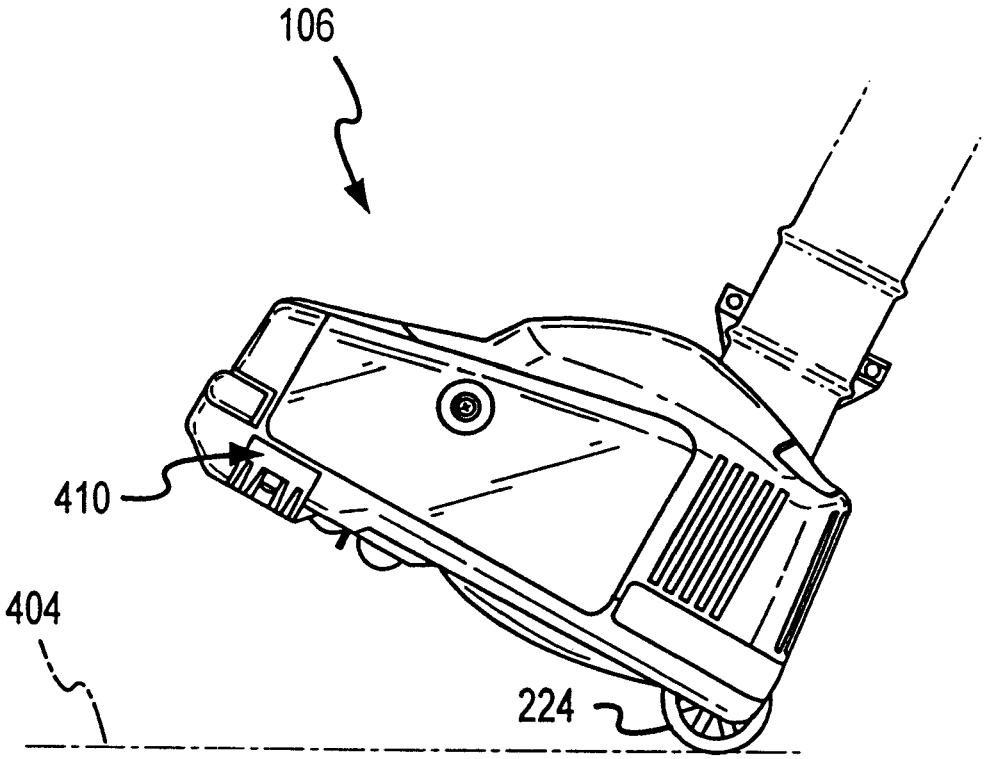
FIG. 50 is a fragmentary left-side elevation depicting the vacuum head tilted away from the working surface so that the vacuum may be transported from one working location to another.

Referring to FIG. 7, the rear portion 700 of the head housing bottom cover 222 defines a left rear wheel housing 702 and a right rear wheel housing 704. The rear wheel housings 702, 704 are recessed upwardly from the lower surface 1308 of the bottom cover 222. Each rear wheel housing defines a pair of axle apertures 710, that rotatably support the rear wheel axles 226 of the rear wheels 224. In the preferred embodiment, the rear wheels 224 are recessed within the rear wheel housings 702, 704 so that a portion of each of the rear wheels 224 extends past the rear edge of the head housing 106. This may be seen to good advantage in, for example, FIGS. 5 and 50. Also, nearly half of the front and rear wheels 228, 224, respectively, extends downwardly past the lower surface 1308 of the bottom cover 222. This configuration reduces the overall vertical profile of the vacuum head housing 106, and thus allows the vacuum 100 to be maneuvered under low surfaces such as sofas, desks, and beds. Additionally, having a portion of the rear wheels 224 extend rearwardly of the rear edge of the vacuum head housing 106 enhances the maneuverability of the vacuum, especially when the vacuum 100 is pulled rearwardly with the front end of the vacuum raised as shown in FIG. 50. For example, if the user were to tilt the vacuum rearwardly slightly (i.e., enough to take the pressure off of the front wheels), the user would experience less resistance to pivotal motion about an axis through the handle and down tube. Also, when the vacuum cleaner is tilted rearwardly as shown in, for example, FIG. 50, the vacuum may be more easily transported from a first working surface to a second working surface (e.g., from a first bedroom to a second bedroom.) Additionally, the rear wheels 224 are placed in close proximity to one another near the lateral centerline of the head housing 106 to improve the turning radius of the vacuum 100.

The front wheels 228 are rotatably mounted to the lower surface 1308 of the bottom cover 222 forwardly of the rear wheels 224 and adjacent to the outside lateral edges of the squeegee 1202. The lower surface 1308 of the bottom cover 222 defines a left front wheel housing 713 and a right front wheel housing 715 recessed upwardly from the lower surface of the bottom cover 222. The axles 230 of the front wheels 228 are rotatably supported in apertures defined within the front wheel housings 713, 714.

The belt storage compartment 602 is generally boomerang shaped and extends upwardly from the lower surface 1308 of the bottom cover 222, which is best illustrated in FIGS. 6 and 7. The back-up drive belt 604 is stored within the belt storage compartment 602 so that in case the drive belt 208 breaks during use the user will have the back-up belt 208 handy. The boomerang shaped storage compartment 602 generally defines a long radius wall 606 and a short radius wall 608 intersecting together at both of their respective ends with sweeping radius walls 610, 611. A first belt-mounting nub 612 and a second belt mounting nub 614 are positioned within the space defined by the sweeping radius walls 610, 611. The belt mounting nubs 612, 614 are generally tear drop shaped and are dimensioned so as to provide a relatively constant width channel 616, 618 between the belt mounting nubs 612, 614 and the sweeping radius walls 610, 611. The channels 616, 618 are generally only slightly wider than the thickness of the back-up drive belt 604.

A friction finger 620 extends outwardly from a midpoint 622 of the short radius wall 608. The friction finger 620 has a generally convex wall 624 and a generally concave wall 626 that intersect at a tip 630 adjacent a midpoint 628 of the long radius wall 606, and thereby form a space between the tip 630 and the long radius wall 606 slightly larger than two thicknesses of the belt 604. The concave wall 626 provides space for the finger of a user to grasp the belt 604 and remove it from the storage compartment 602.

The back-up drive belt 604 is held in place within the storage compartment 602 by placing the belt 604 around the first belt mounting nub 612 and the second belt mounting nub 614, within the channels 616, 618 and across the tip 630 of the friction finger 620. Once within the compartment, the belt 604 is held in place by frictional interaction with the walls 606, 608, the nubs 612, 614, and the friction finger 620. Accordingly, the belt 604 is in a relaxed position, i.e., without tension, when stored in the storage compartment 602. Prior art systems generally store belts in a tensioned or stretched state which causes the belts to degrade and lose their elasticity over time.

Figure 5:
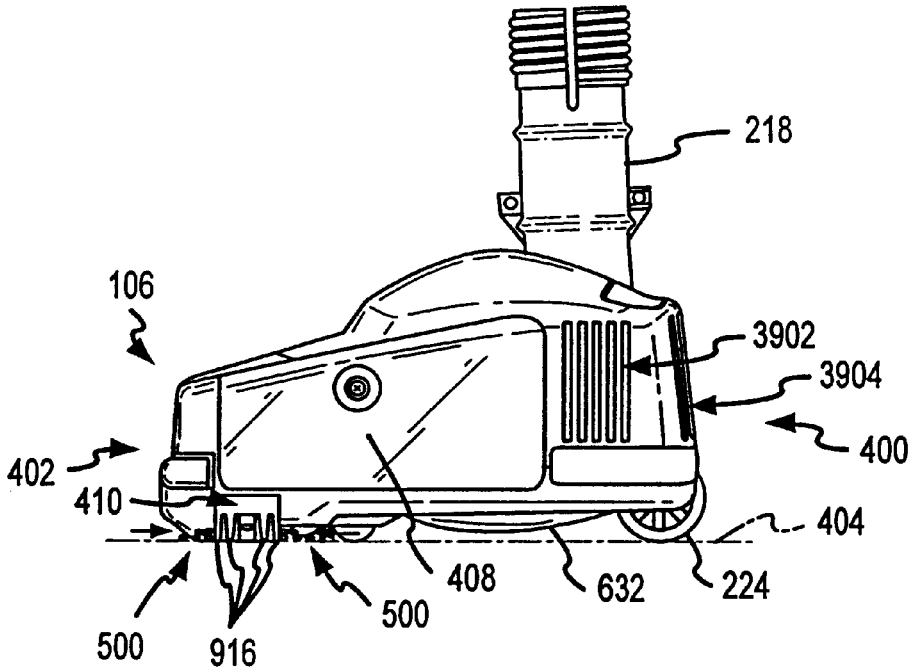
FIG. 5 is a left elevation of the head and impeller housing depicted in FIG. 4.

As shown in FIGS. 5–7, a bulbous protrusion 632 protrudes downwardly from the lower surface 1308 of the bottom cover 222. The bulbous protrusion 632 defines a bottom surface 706 of an impeller fan housing chamber 708 within the vacuum head housing 106. The impeller fan housing 218 generally occupies the impeller fan housing chamber 708. The bulbous protrusion 632 allows the impeller fan housing 218 to rest lower within the vacuum head housing 106, and thus reduces the overall vertical profile of the vacuum head housing 106. As discussed above with respect to recessing the front and rear wheels 228, 224, respectively, reducing the vertical profile allows the vacuum to be maneuvered under low lying surfaces such as sofas, desks, and beds, while minimizing contact with such low lying surfaces.

Velocity Slots

Referring most particularly to FIGS. 4–6 and 22, front velocity slots 412(*a*), 412(*b*), and rear velocity slots 412(*c*), 412(*d*) formed in the lower surface 1308 of the bottom cover 222 are described next. These front velocity slots 412(*a*), 412(*b*), and rear velocity slots 412(*c*), 412(*d*) provide suctional communication between the area adjacent to the side brushes 410 and the suction inlet 200. The side brushes 410, as described elsewhere, assist in cleaning debris 500 along the sides of the vacuum 100. In particular, the debris 500 along the sides of the head housing 106 is moved by the side brushes 410 toward the velocity slots 412(*a*), 412(*b*), 412(*c*), 412(*d*). During a forward stroke with the vacuum, the debris impacting the most forward inside and outside blades 900, 902, respectively, of each side brush 410 is pushed by these blades 900, 902 into one of the forward velocity slots 412(*a*), 412(*b*). Similarly, during a rearward stroke with the vacuum 100, the debris 500 impacting the most rearward inside and outside blades 900, 902, respectively, of each side brush is pushed by these blades 900, 902 into one of the rearward velocity slots 412(*c*), 412(*d*). Accordingly, debris 500 that is loosened by the side brushes 410 is moved from the areas adjacent the brushes and directed through one or more velocity slot 412(*a*), 412(*b*), 412(*c*), 412(*d*) into the suction inlet 200.

The forward left velocity slot 412(*a*) is defined by a recessed area 2203 bounded by a first short downwardly projecting wall 2204 oriented at an oblique angle with respect to the longitudinal axis of the roller brush 212 and a second short downwardly projecting wall 2206 orientated generally transversely to the first downwardly projecting wall 2204. The forward right velocity slot 412(*b*) is defined by a recessed area 2208 bounded by a first short downwardly projecting wall 2210 having a portion 2212 generally parallel to the longitudinal axis of the brush 212 and a portion 2214 orientated at an oblique angle with respect to the longitudinal axis of the brush 212, and by a second short downwardly projecting wall 2216 oriented generally transversely to the oblique portion 2214 of the first downwardly projecting wall 2210.

The rear left velocity slot 412(*c*) is defined by a recessed area 2218 bounded by a first downwardly projecting wall 2220 oriented generally parallel to the longitudinal axis of the brush 212 and a second downwardly projecting wall 2222 oriented generally transversely to the first wall 2220. Finally, the rear right velocity slot 412(*d*) is defined by a recessed area 2224 bounded by a first downwardly projecting wall 2226 orientated generally parallel with the longitudinal axis of the brush 212 and a second downwardly projecting wall 2228 that is curved having a portion, adjacent the side brush 410, that is generally parallel to the longitudinal axis of the brush 212 and then curving forwardly into a portion that is generally orientated at an oblique angle with respect to the longitudinal axis of the brush 212.

Generally, with respect to the velocity slots 412(*a*), 412(*b*), 412(*c*), 412(*d*), the flow of air into the suction inlet 200 along with the rotation of the brush 212 creates a flow of air from the area adjacent to the velocity slots, through the velocity slots, and into the suction inlet 200. Integrating both forward velocity slots 412(*a*), 412(*b*) and rearward velocity slots 412(*c*), 412(*d*) into the lower surface of the bottom cover 222 provides enhanced cleaning capability in both the forward and rearward direction. Accordingly, debris 500 loosened by the side brushes 410 in the forward stroke is generally routed through the forward velocity slots 412(*a*), 412(*b*) and debris that is loosened by the side brushes 410 in the rearward stroke is generally routed through the rearward velocity slots 412(*c*), 412(*d*).

The oblique angles of the sidewalls 2204, 2214 of the forward left velocity slot 412(*a*) and the forward right velocity slot 412(*b*), respectively, take advantage of the forward motion of the vacuum to guide debris 500 into the suction inlet 200. Debris that enters the forward velocity slots 412(*a*), 412(*b*) will generally contact the sidewalls 2204, 2214 and be moved rearwardly and inwardly in the forward velocity slots 412(*a*), 412(*b*). The walls 2204, 2214 by virtue of their angular orientation funnel the debris rearwardly and laterally along the walls 2204, 2214 and into the suction inlet 200.

Side Brushes

Figure 3:
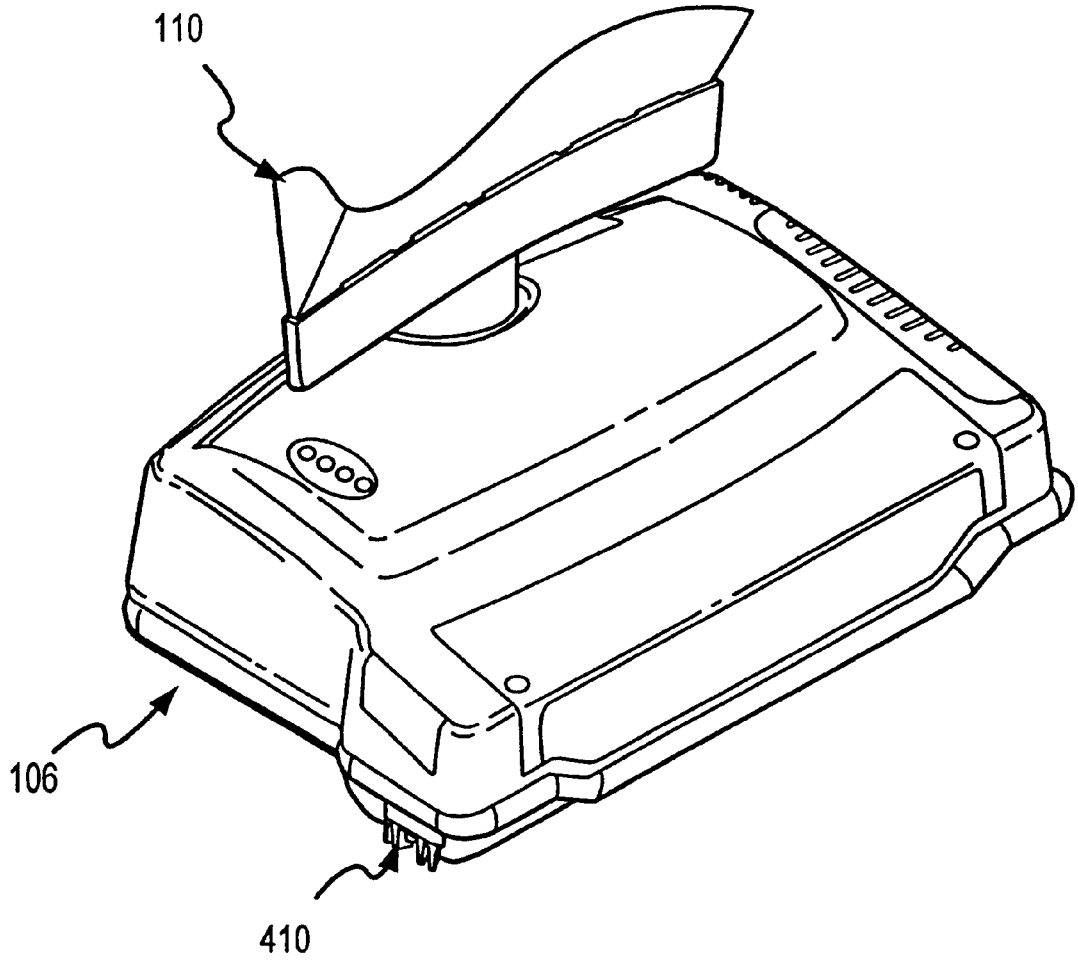
FIG. 3 is an enlarged fragmentary isometric view of the head of the vacuum depicted in FIG. 1.
Figure 4:
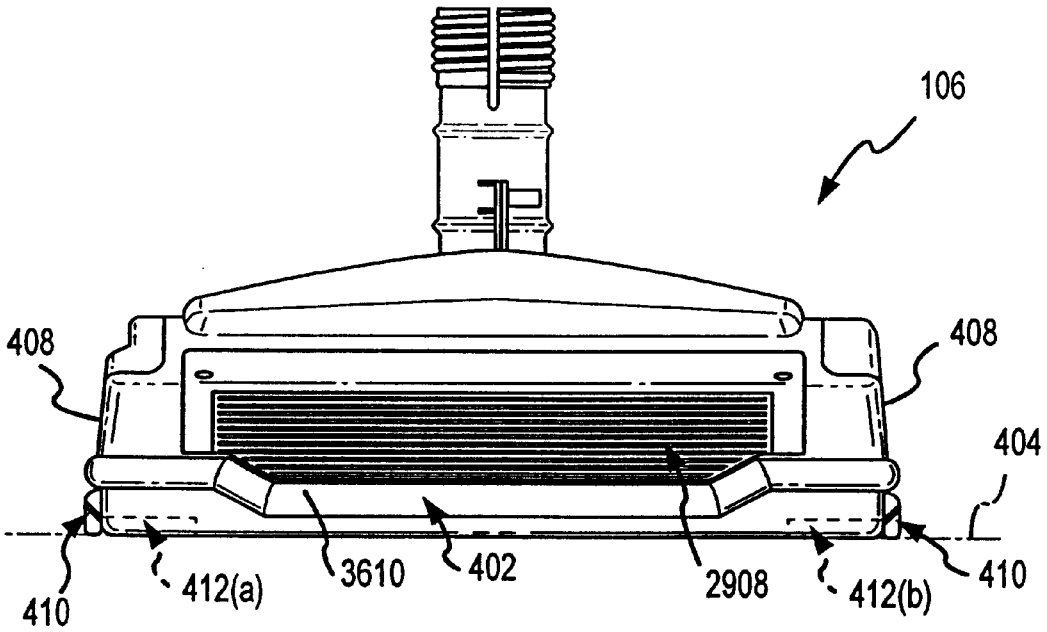
FIG. 4 is a front elevation of the head depicted in FIGS. 1 and 3, including a portion of the impeller housing.

Referring to FIGS. 3–5, side brushes 410 are attached to both sides 408 of vacuum head housing 106 adjacent velocity slots 412(*a*), 412(*b*), 412(*c*), and 412(*d*) (as described above) and proximate the front end 402 of vacuum head housing 106. The side brushes 410 serve to direct debris 500 from floor surface 404, but outside the surface area covered by the vacuum's footprint, to the velocity slots 412(*a*), 412(*b*), 412(*c*), and 412(*d*). The velocity slots 412(*a*), 412 (*b*), 412(*c*), and 412(*d*) are in communication with the suction inlet 200 (see FIGS. 2 and 22), thereby drawing in any debris 500 introduced to the velocity slots 412(*a*), 412(*b*), 412(*c*), and 412(*d*) towards the inlet 200. As shown in FIGS. 4 and 5, the side brushes 410 are in contact with the floor surface 404 to help direct debris 500 toward the vacuum's suction inlet 200.

Figure 22:
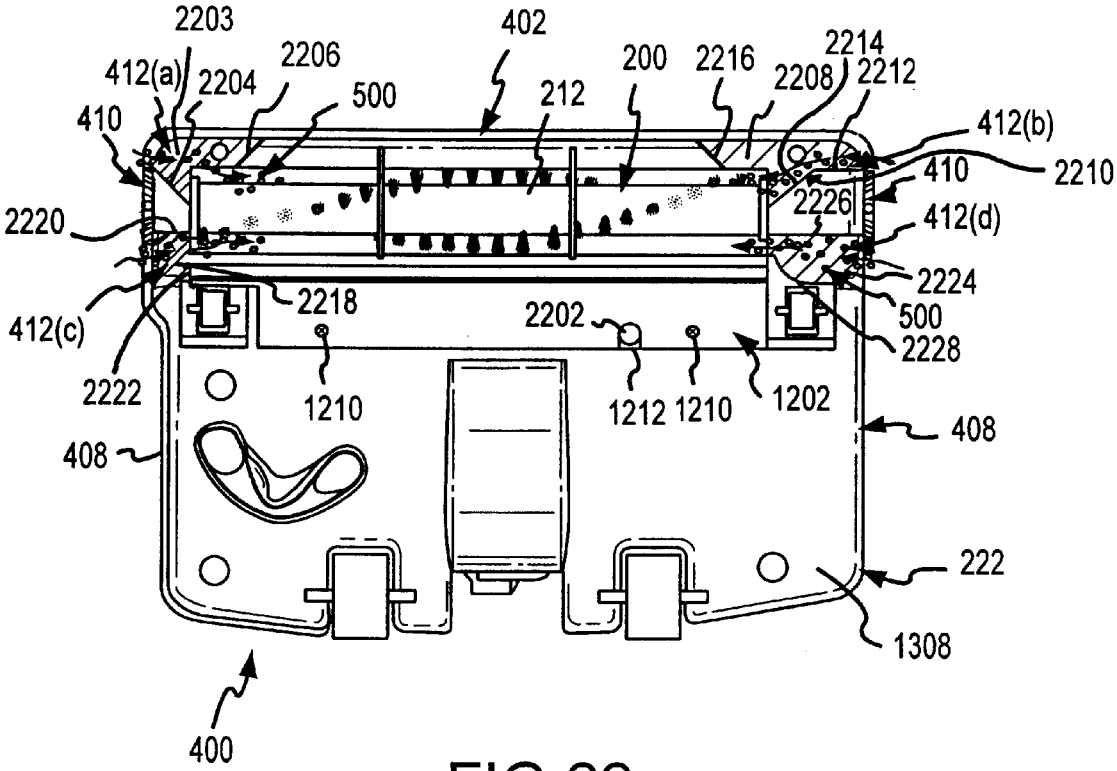
FIG. 22 is a bottom plan view of the vacuum cleaner head of the present invention showing the positioning of the integrated runner squeegee with respect to the roller brush.

FIG. 22, a bottom view of the vacuum head housing 106, provides a more detailed view of the path that the debris 500 takes en route to suction inlet 200. Side brushes 410 help direct the debris 500 into the velocity slots 412(*a*), 412(*b*), 412(*c*), and 412(*d*) and towards the powered roller brush 212. The debris 500 is ultimately directed into the suction inlet 200 by the mechanical forces of the powered roller brush 212 and the low pressure or suction forces created by the vacuum motor 274. The suction inlet 200 actually surrounds the powered roller brush 212.

Figure 9:
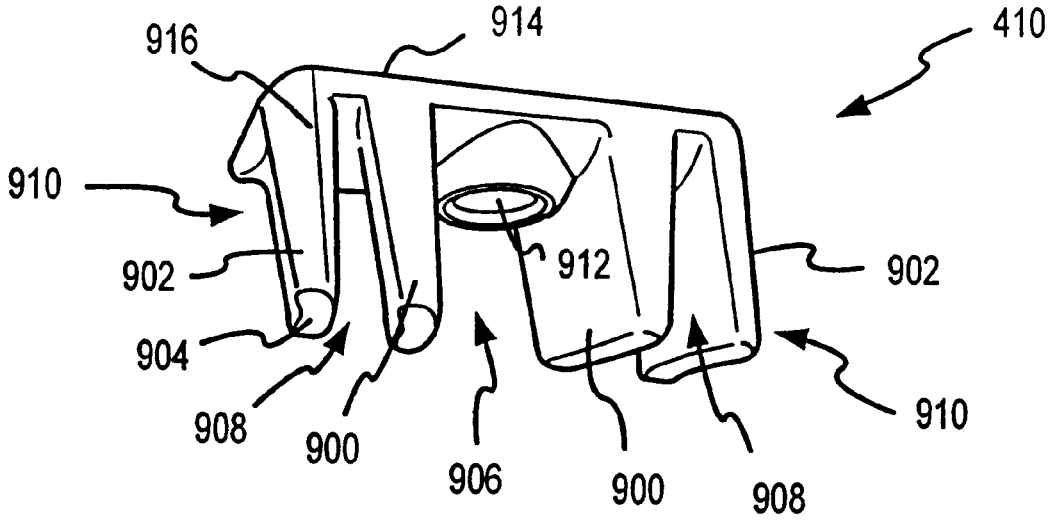
FIG. 9 is a front isometric view of a vacuum side brush in accordance with one embodiment of the present invention.
Figure 10:
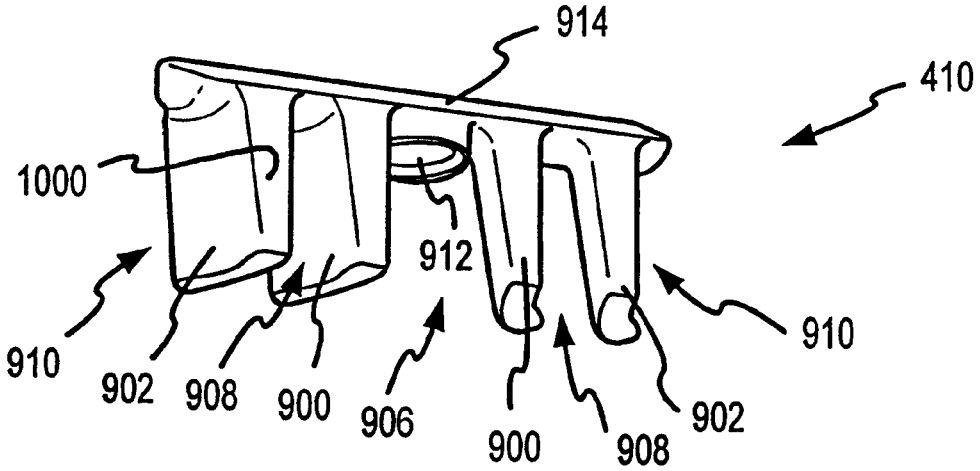
FIG. 10 is a rear isometric view of the vacuum side brush depicted in FIG. 9.

FIGS. 9 and 10 are front and rear isometric views, respectively, of a side brush 410. Generally, each side brush 410 is comprised of two dual-angled blade pairs, each blade pair including an inside blade 900 and an outside blade 902. A connection aperture 912 is present between the blade pairs and receives a connection screw 1100 (FIG. 11) to connect the side brush 410 to a mounting bracket 1102 on the bottom cover 222 of the vacuum head housing 106 (see FIG. 11). The shape and design of the blades 900 and 902 help direct debris 500 toward collection channels 906, 908, and 910 and into the suction inlet 200.

In a preferred embodiment depicted in FIGS. 9 and 10, the side brush 410 includes two slightly curved or bowed, dual-angled outside blades 902 suspended from a connection surface 914. Inward of these outside blades 902 are two slightly curved, dual-angled inside blades 900, which are also suspended from the connection surface 914. Central to the side brush 410 and between the inside blades 900 is the connection aperture 912. A more detailed description of the connection aperture 912 is provided below in connection with FIG. 11. Each blade includes a bottom surface 904, an elongated outwardly facing edge 916, and an inwardly facing edge 1000. The connection surface 914 of each blade is angled downwardly and inwardly with respect to the floor surface 404 and the head housing 106, respectively. To account for the angle of the connection surface 914 and ensure that the bottom surfaces of each respective blade is substantially parallel to the floor surface 404 when connected to the vacuum 100, the outwardly facing edge 916 of each blade is elongated in relation to the inwardly facing edge 1000 of each blade.

As mentioned previously, each side of the connection aperture 912 includes a pair of dual-angled blades, an inside blade 900 and an outside blade 902. The first angle included in the blades 900 and 902 can be described in relation to the edges 916, 1000 of each blade, the ends 400 and 402 of the vacuum 100, and the connection aperture 912 (see FIGS. 9–15). Each respective pair of blades is tilted from the portion of each blade adjacent to the connection surface 914 to the bottom surface 904 away from the connection aperture 912 toward the end 400, 402 of the head housing 106 closest to the side of the connection aperture 912 that includes the respective pair of blades.

As mentioned previously, the blades 900 and 902 are dual-angled with the first angle being the tilt angle of each blade as described above. The second angle included in the blades 900 and 902 is the angle of axial rotation and can be described in relation to the edges 916, 1000 of each blade 900, 902, and the connection aperture 912 (see FIGS. 9–15). In a preferred embodiment, the general rule is that each blade is axially rotated such that the inwardly facing edge 1000 of each respective blade is closer to the connection aperture 912 than the outwardly facing edge 916 of each respective blade.

As a result, with respect to the horizontal dimension of each blade taken along the side 408 of the head housing 106 when the side brush 410 is installed on the head housing 106, each blade's outwardly facing edge 916 extends transversely away from the connection aperture 912 while its inwardly facing edge 1000 extends transversely toward the connection aperture 912.

The blades 900 and 902 are both spaced slightly apart and are slightly curved or bowed in the direction they are angled. The effect of the spacing and the curvature is that the debris collection channels 906, 908, and 910 are formed. The debris 500 is guided along the collection channels 906, 908, and 910 into the suction inlet 200. The geometry of the blades 900 and 902 more effectively directs the debris 500 thereby helping to increase the surface area cleaned.

Figure 11:
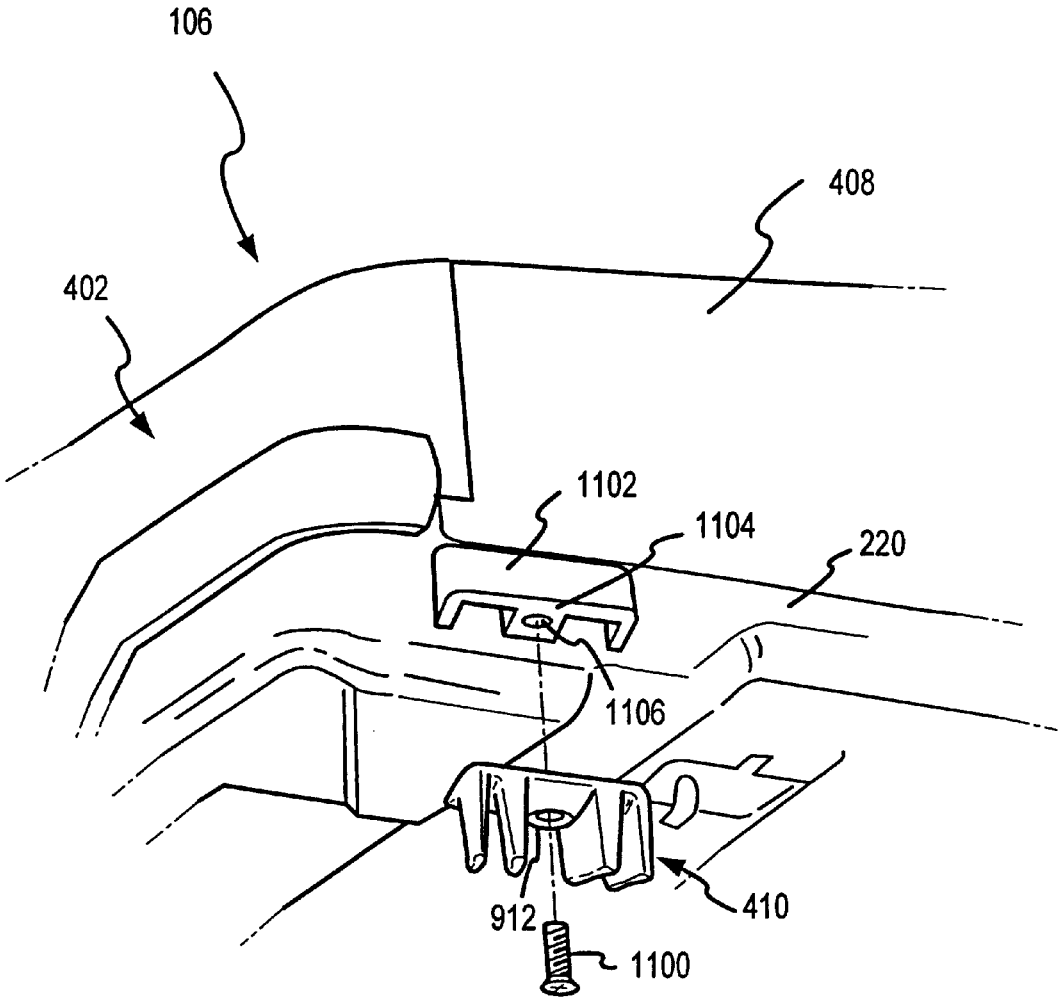
FIG. 11 is a fragmentary, partially-exploded isometric view of the vacuum side brush depicted in FIGS. 9 and 10 and a portion of the vacuum to which it attaches.

In FIG. 11, an exploded view of the side brush 410 depicting the manner of installation is provided. The mounting bracket 1102 is fixed to the side surface 408 of the head housing 106 adjacent the front end 402. The mounting bracket 1102 includes the mounting surface 1104 which lies substantially in a plane parallel to the connection surface 914 and also lies above and opposite the floor surface 404. In a preferred embodiment, the outline of the mounting surface 1104 is configured to substantially match the outline of the connection surface 914. Central to the mounting surface 1104 is the threaded aperture 1106. The threaded aperture 1106 is configured to receive the mounting screw 1100 for attaching the side brush 410 to the mounting bracket 1102. As shown in FIG. 11, the side brush 410 is attached to the mounting bracket 1102 (and head housing 106) by inserting the mounting screw 1100 up through the connection aperture 912 and into the threaded aperture 1106. By tightening the mounting screw 1100, the mounting surface 1104 and the connection surface 914 are brought in contact with each other. In other embodiments of the side brush 410, the mounting screw 1100 may be integral to the side brush 410 thereby eliminating the need for the connection aperture 912. In still further embodiments of the side brush 410, connection tabs or other known means may be used to connect the side brush 410 to the mounting bracket 1102.

While the invention has been particularly shown and described with reference to a preferred embodiment thereof, it will be understood by those skilled in the art that various other changes in the form and details may be made without departing from the spirit and scope of the invention.

Anti-Ingestion Bars

Figure 12:
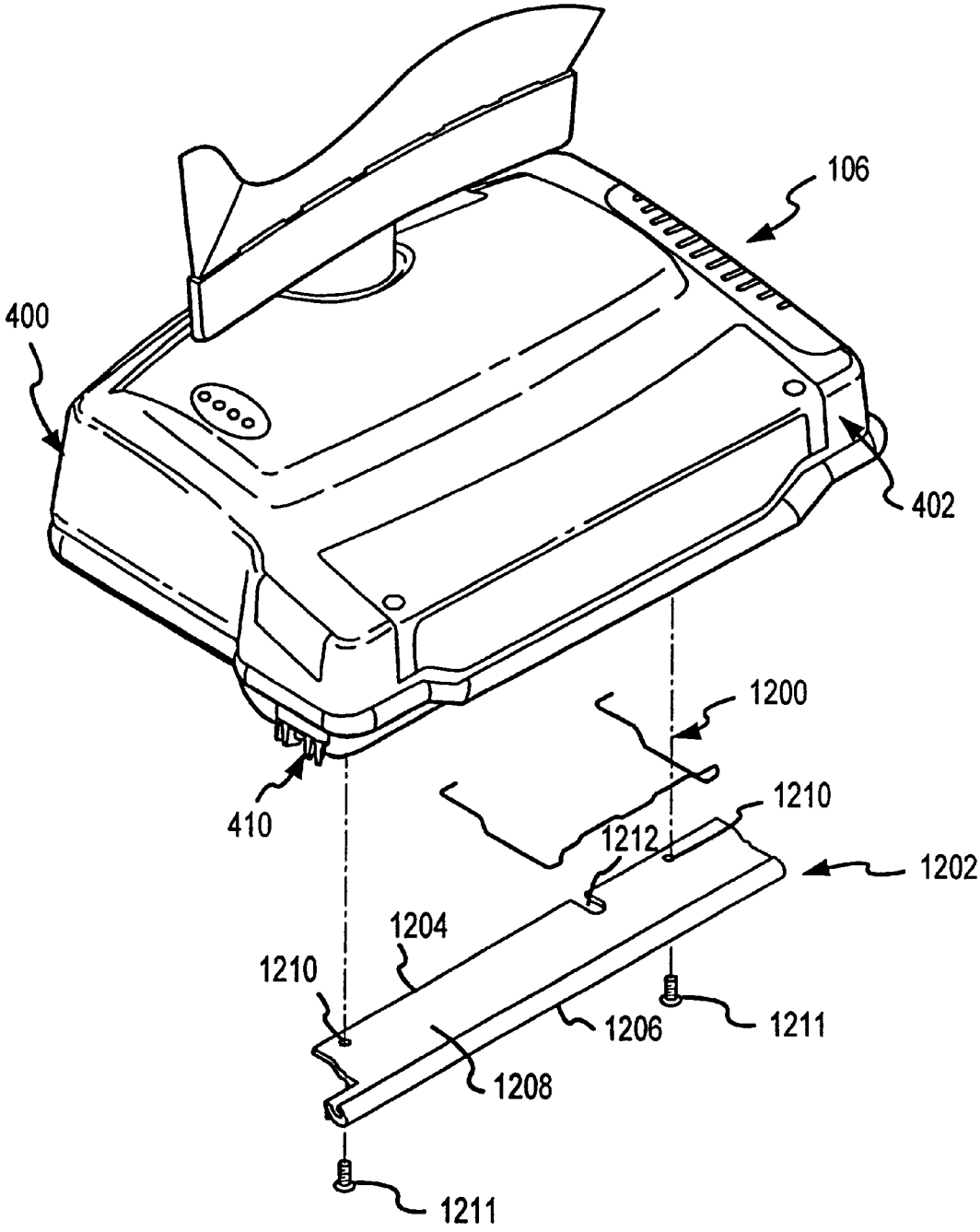
FIG. 12 is a partially-exploded top isometric view of the vacuum cleaner head with an anti-ingestion bar according to a first embodiment below its insertion point, and a squeegee positioned below the anti-ingestion bar.
Figure 13:
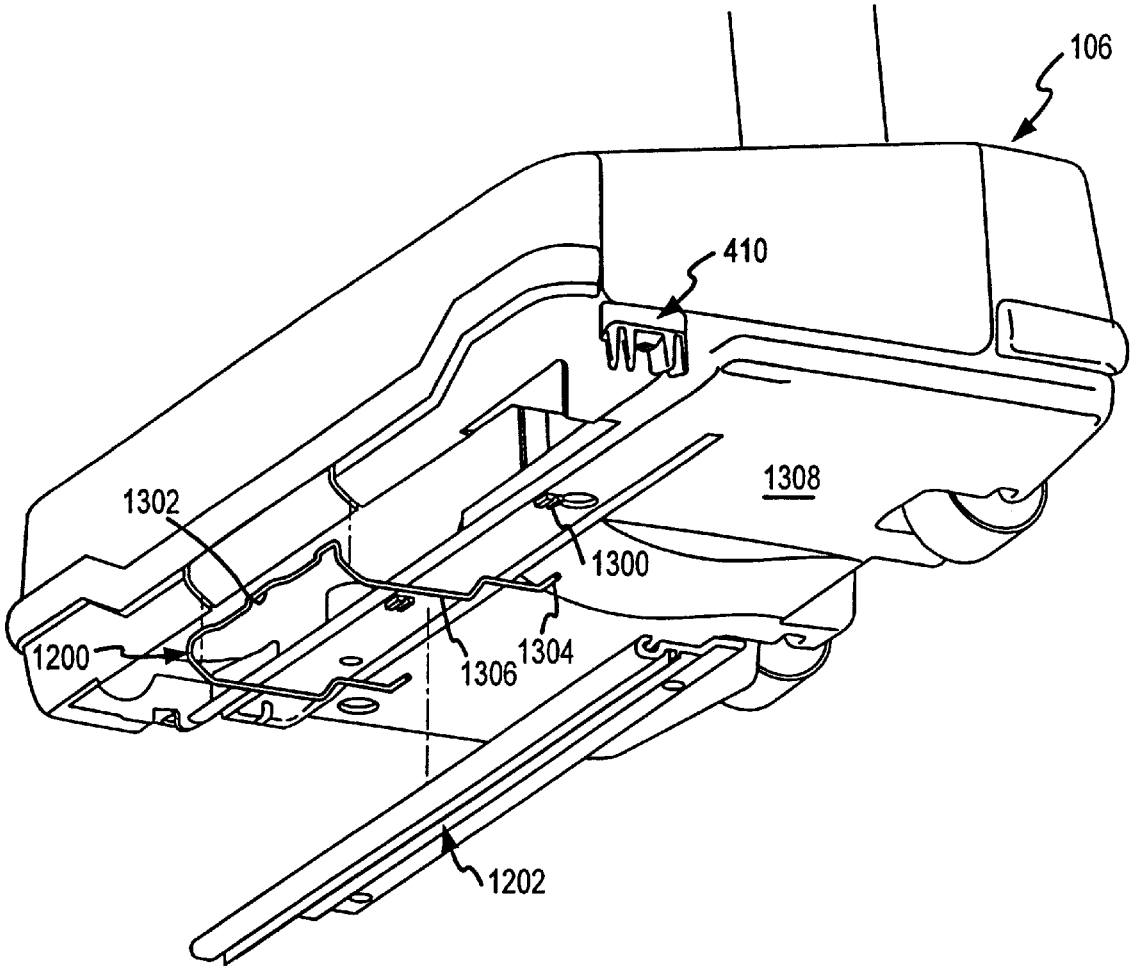
FIG. 13 is a partially-exploded bottom isometric view of the vacuum cleaner head, the anti-ingestion bar of FIG. 12 below its insertion point, and the squeegee below the anti-ingestion bar.
Figure 14:
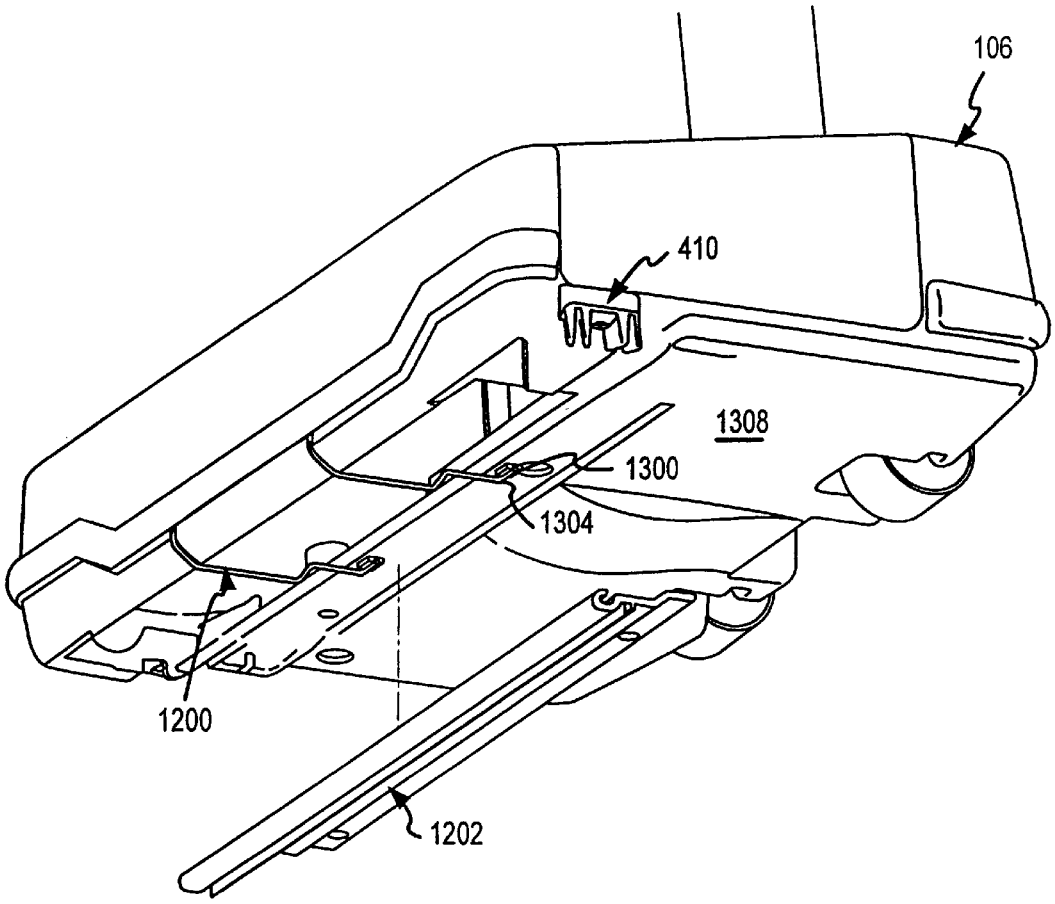
FIG. 14 is a partially-exploded bottom isometric view of the vacuum cleaner head with the anti-ingestion bar of FIG. 12 inserted in the housing, and the squeegee below the anti-ingestion bar.

FIGS. 12–17 illustrate a first preferred embodiment of anti-ingestion bar 1200 and its placement in the bottom cover 222 of the head housing 106 of the vacuum cleaner 100. When installed, the anti-ingestion bar 1200 resides on the lower surface 1308 of the bottom cover 222, as best seen in FIGS. 13 and 14.

As shown in FIGS. 13 and 14, the anti-ingestion bar 1200 includes rear anchor portions 1304 on both free ends of side arm portions 1306. The rear anchor portions 1304 are inserted into anchor slots 1300 formed on the lower surface 1308 of the bottom cover, thereby removably joining the ends of the side arm portions 1306 to the head housing 106. A front bar portion 1302 of the anti-ingestion bar 1200 engages the front of the bottom cover 222, as described below in connection with FIG. 17.

Figure 15:
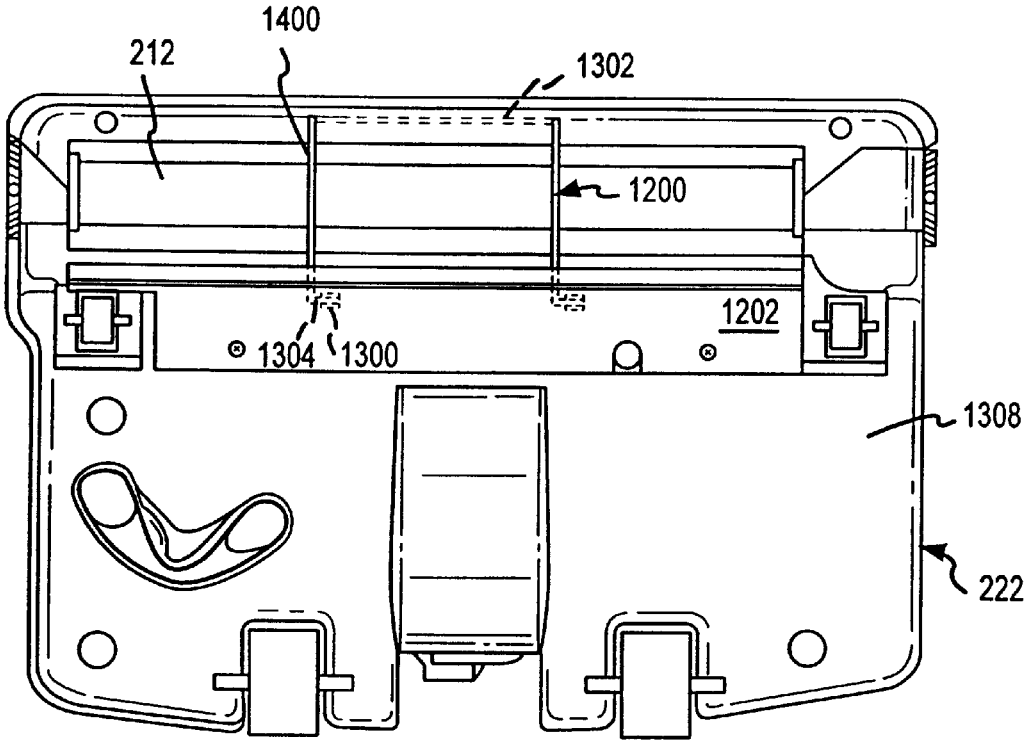
FIG. 15 is a bottom plan view of the head with the anti-ingestion bar of FIG. 12 and the squeegee installed.
Figure 16:
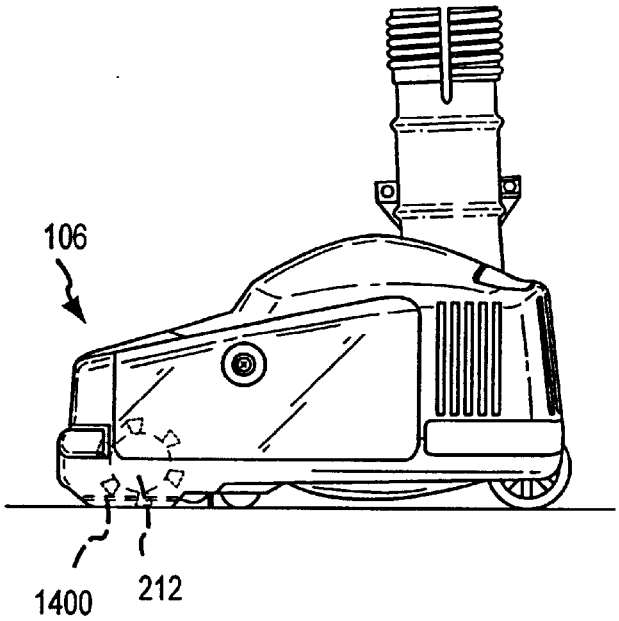
FIG. 16 is a side elevation of the head with the anti-ingestion bar installed (represented by dashed lines)

In FIGS. 15 and 16, the anti-ingestion bar 1200 is connected to the bottom cover, and a squeegee 1202 covers the rear anchor portions 1304. The squeegee is described further below. As shown in FIGS. 15 and 16, when the anti-ingestion bar 1200 is installed, anti-ingestion portions 1400 of the anti-ingestion bar 1200 reside beneath power roller brush 212, thereby acting as a guard to prevent larger-sized debris from either becoming entangled with the power roller brush 212 or entering and clogging the vacuum suction inlet (not shown). The front bar portion 1302 is not visible from the bottom of the vacuum 100 and is, therefore, shown in phantom in FIG. 15.

Figure 17:
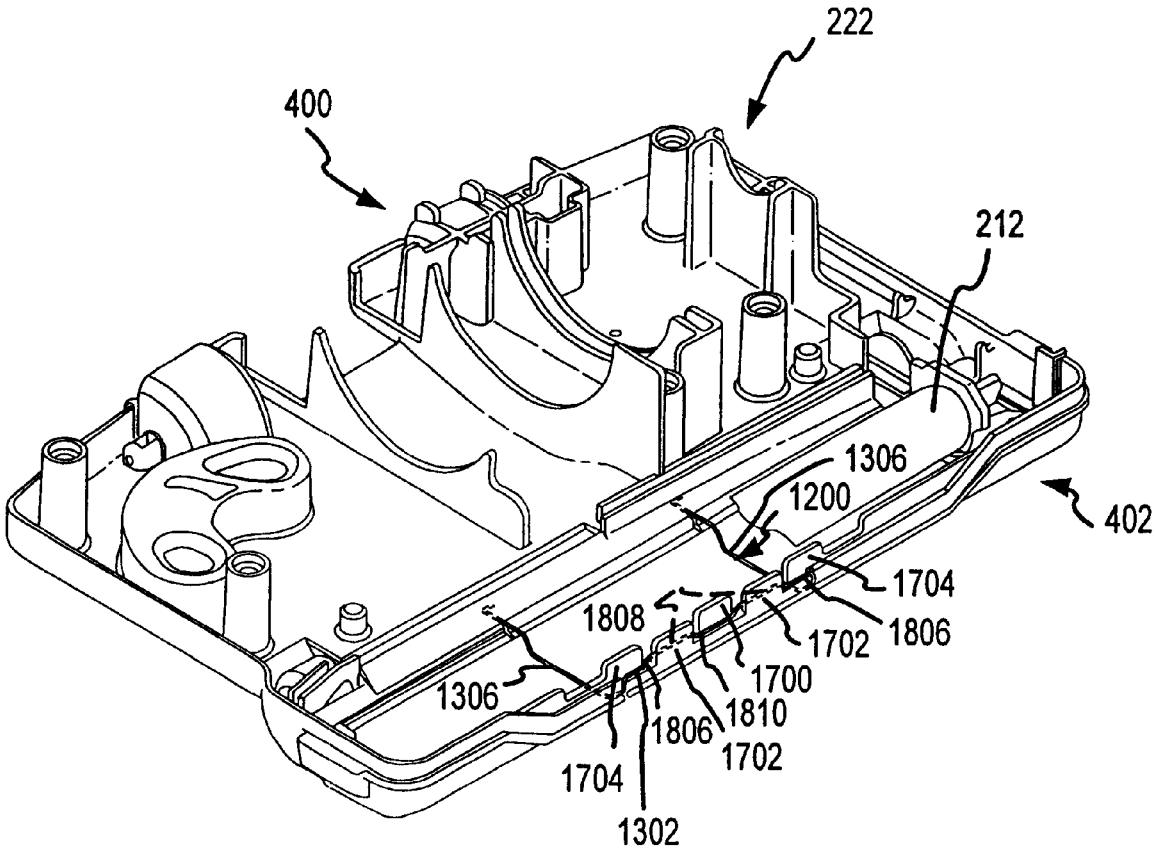
FIG. 17 is a top isometric view of the bottom cover of the head housing with the anti-ingestion bar of FIG. 12 installed therein.

FIG. 17 is an isometric view looking downwardly on the bottom cover 222 and illustrates the placement of the anti-ingestion bar 1200 within the bottom cover 222. A fragmentary portion of the agitator or roller brush 212 is shown in FIG. 17. If the front roller brush 212 were shown, its mid portion would ride above the side arm portions 1306. The front bar portion 1302 of the anti-ingestion bar 1200 is engaged with the bottom cover 222. In particular, as described in greater detail below, the front bar portion 1302 is weaved between and releasably held by holding tabs 1700, 1702, and 1704.

FIGS. 18–21 depict an alternative embodiment 1200' of the anti-ingestion bar. In this alternative embodiment 1200', only the rear anchor portions 1304' are different from those 1304 depicted in, for example, FIGS. 13 and 14. The rear anchor portions 1304' include loops that can accommodate screws or heat stakes to affix the alternative embodiment of the anti-ingestion bar 1200' to the bottom cover 222.

Figure 18:
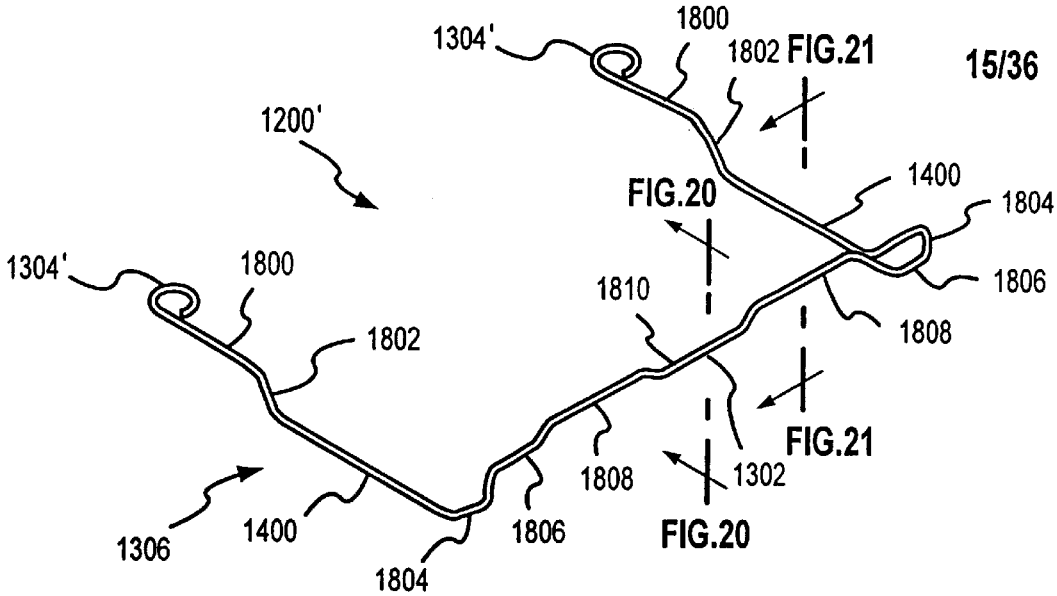
FIG. 18 is a top isometric view of an alternative embodiment of the anti-ingestion bar.

Since the remaining features of the two anti-ingestion bars 1200, 1200' are the same, additional anti-ingestion bar details will be described next with reference to FIGS. 18–21. The anti-ingestion bar 1200 or 1200' serves to add lateral support to the front wall 402 of the bottom cover 222 and prevents the introduction of larger-sized debris into the vacuum's suction inlet 200. As best seen in FIG. 18, anti-ingestion bar 1200 or 1200' is generally U-shaped and includes a front bar portion 1302 connected to at least two identical side arm ilk portions 1306. As shown in FIG. 17, front bar portion 1302 is configured to be releasably secured by the alternating holding tabs 1700, 1702, and 1704 along the front wall 402.

Each side arm portion 1306 terminates at a rear anchor portions 1304. The rear anchor portions 1304 are adapted to be releasably secured to the vacuum body. In a preferred embodiment, each rear anchor portions 1304 faces the same direction in an "L-shape" (i.e., one faces inwardly and the other faces outwardly) and is held by an anchor slot 1300. In other embodiments, the rear anchor portions 1304 could face in opposite directions. In an alternative embodiment shown in FIG. 18, the rear anchor portions 1304' define loops at each end of the anti-ingestion bar 1200'. The looped rear anchor portions 1304' are configured to fit over stubs protruding from the lower surface of the bottom cover 222.

Figure 19:
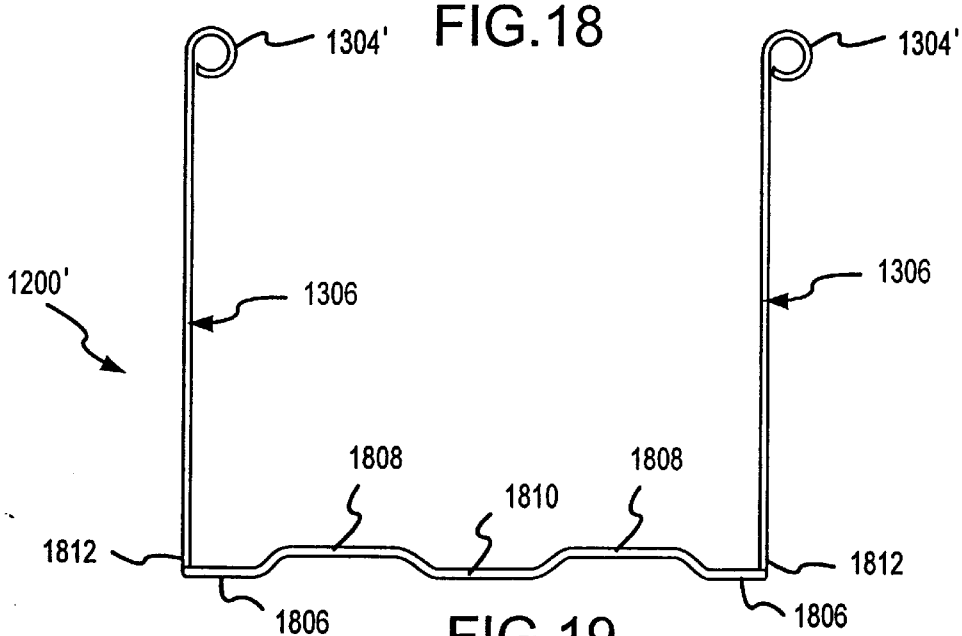
FIG. 19 is a top plan view of the alternative embodiment of the anti-ingestion bar depicted in FIG. 18.
Figure 21:
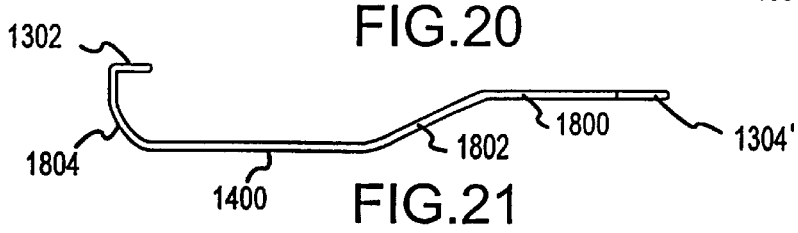
FIG. 21 is a side elevation of the alternative embodiment of the anti-ingestion bar taken along line 21—21 of FIG. 18.

In both embodiments of the rear anchor portions 1304 and 1304', each rear anchor portions is joined to a horizontally directed upper connecting portion 1800. As shown in FIG. 21, each upper connecting portion 1800 resides in the same plane as the rear anchor portions 1304 or 1304' and extends forwardly towards the front bar portion 1302. Each upper connecting portion 1800 is joined to a ramp portion 1802 that extends forwardly and downwardly from the upper connecting portion 1800 toward the front bar portion 1302. Each ramp portion 1802 is joined to a substantially horizontal anti-ingestion portion 1400 that resides in a plane lower than but parallel to the plane containing the corresponding rear anchor portion 1304 and upper connecting portion 1800. This is clearly visible in FIG. 21. As mentioned above, the anti-ingestion portions 1400 serve as a guard to prevent the introduction of larger sized debris into the vacuum's suction inlet 200. As shown in FIGS. 18 and 21, anti-ingestion portion 1400 extends forwardly and substantially horizontally from a lower end of a ramped portion and joins a forwardly extending, upwardly-curved corner portion 1804. As best seen in FIG. 19, each corner portion 1804 terminates at the forward end 1812 of its respective side arm 1306 and is joined to an inwardly and generally perpendicularly directed outside lateral support portion 1806 of the front bar portion 1302.

Figure 20:
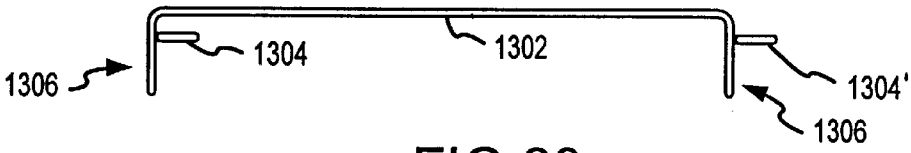
FIG. 20 is a front elevation of the alternative embodiment of the anti-ingestion bar taken along line 20—20 of FIG. 18.

The top view (FIG. 19) of the front bar portion 1302 and its side view (FIG. 21) show that the front bar portion 1302 generally comprised of a joined series of co-planar, lateral support portions 1806, 1808, and 1810 as illustrated to good advantage in FIGS. 19 and 20. As best illustrated in FIG. 17, the lateral support portions 1806, 1808, and 1810 are configured so as to weave between and be releasably secured by the offset alternating holding tabs 1700, 1702, and 1704. Holding tabs 1700, 1702, and 1704 are forwardly and rearwardly offset to allow the front bar portion 1302 to weave around holding tabs 1700, 1702, and 1704. As mentioned above, the anti-ingestion bar 1200 also serves to structurally reinforce the front wall 402 of the bottom cover 222.

In the preferred embodiment and as illustrated in FIGS. 17 and 18, each outside lateral support portion 1806 extends laterally inwardly and resides in front of an outside, rearwardly-offset holding tab 1704. Each outside lateral support portion 1806 is joined to an inside lateral support portion 1808. The inside lateral support portion 1808 extends laterally inwardly and resides behind an interior, frontwardly-offset holding tab 1702. Finally, the inward ends of the two inside lateral support portions 1808 are joined to a central lateral support portion 1810. The central lateral support portion 1810 extends laterally between the inside lateral support portions 1808 and resides in front of the central rearwardly offset holding tab 1700.

Additional embodiments of the anti-ingestion bar 1200 may include various configurations of lateral support portions along the front bar portion 1302, providing they are configured to be releasably secured by holding tabs along the front wall of the bottom cover. Additionally, the dimensions of the anti-ingestion bar 1200 may vary depending on the dimensions of the vacuum head housing 106.

Squeegee

FIGS. 12–15 and 22–28 show the integrated runner squeegee 1202 portion of the vacuum head housing 106 of the present invention. The integrated runner squeegee 1202 is attached to the lower surface 1308 of the bottom cover 222, adjacent to and behind the roller brush 212, and extends laterally substantially from edge to edge of the vacuum head housing 106. The squeegee 1202 includes a wiper blade 2402, which extends downwardly from the bottom cover 222 and contacts the surface 404 being cleaned. The wiper blade 2402 flexes rearwardly when the vacuum 100 is being pushed forwardly during use, and the wiper blade 2402 flexes forwardly when the vacuum 100 is moved rearwardly, all the while maintaining contact with the surface 404 being cleaned (see, e.g. FIG. 24). The squeegee 1202 has several functions, including enhancing the suction force of the vacuum head around the area of the roller brush 212, and helping collect debris 500 missed by the roller brush 212 in the forward pass by pushing the particles along in front of the squeegee 1202 until the vacuum is moved in a rearwardly direction. Generally, the wiper blade 2402 works on hard surfaces (hardwood, tile, etc.) to push large debris 500 forward and along behind the brush roll area so that when the vacuum head 106 is pulled rearwardly, the large debris 500 can be picked up by the roller brush 212 and suction. The wiper blade 2402 also helps keep debris 500 from being pushed out behind the vacuum by the roller brush 212. The wiper blade 2402 also works on carpeting to lay the carpet pile over so that the bristles on the roller brush can get further down into the carpet for better deep cleaning. The structure and function of the squeegee 1202 is described in more detail below.

Figure 23:
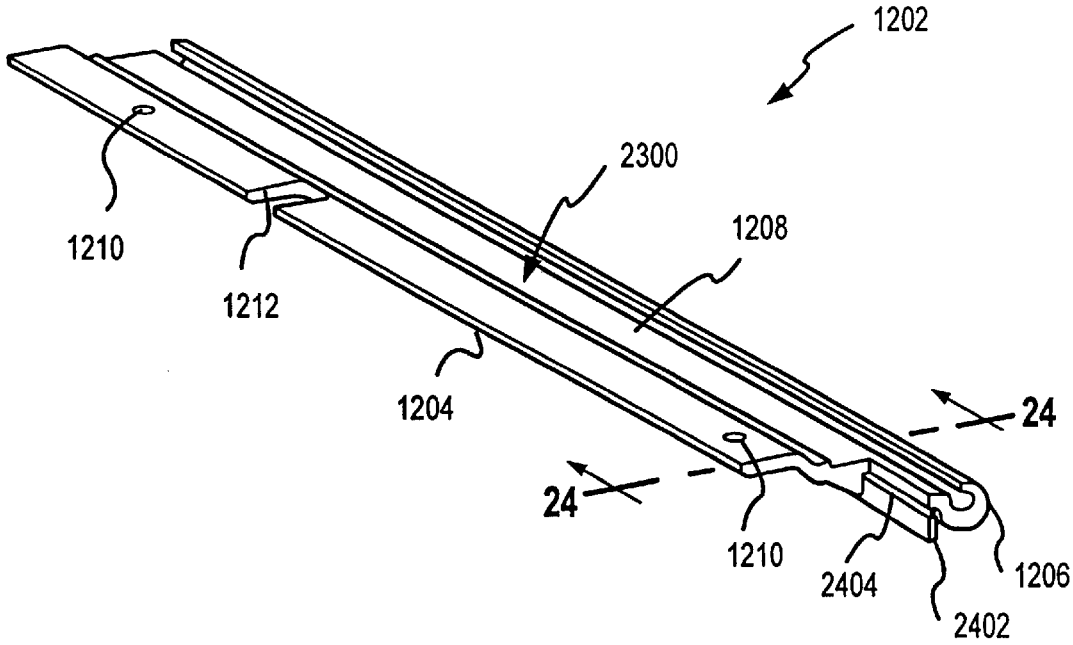
FIG. 23 is an isometric view of the integrated runner squeegee.
Figure 24:
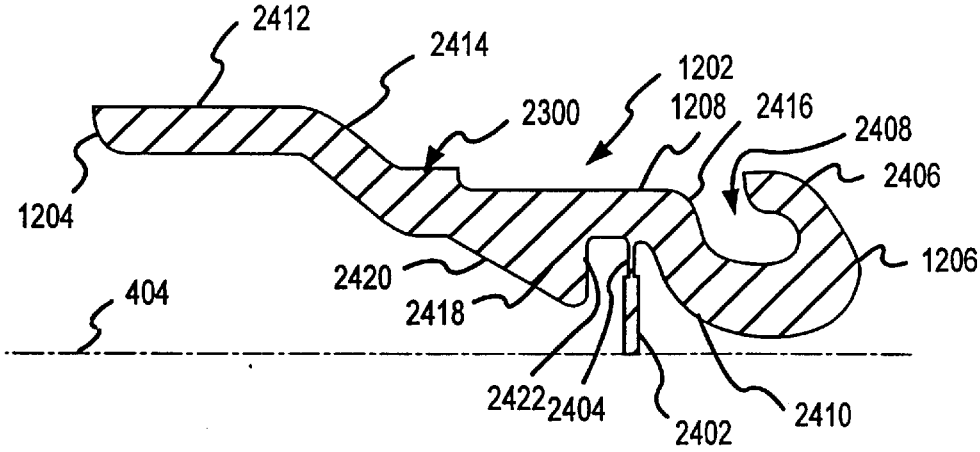
FIG. 24 is a cross-sectional view taken along lines 24—24 of FIG. 23 and showing the different portions of the runner squeegee in section.
Figure 25:
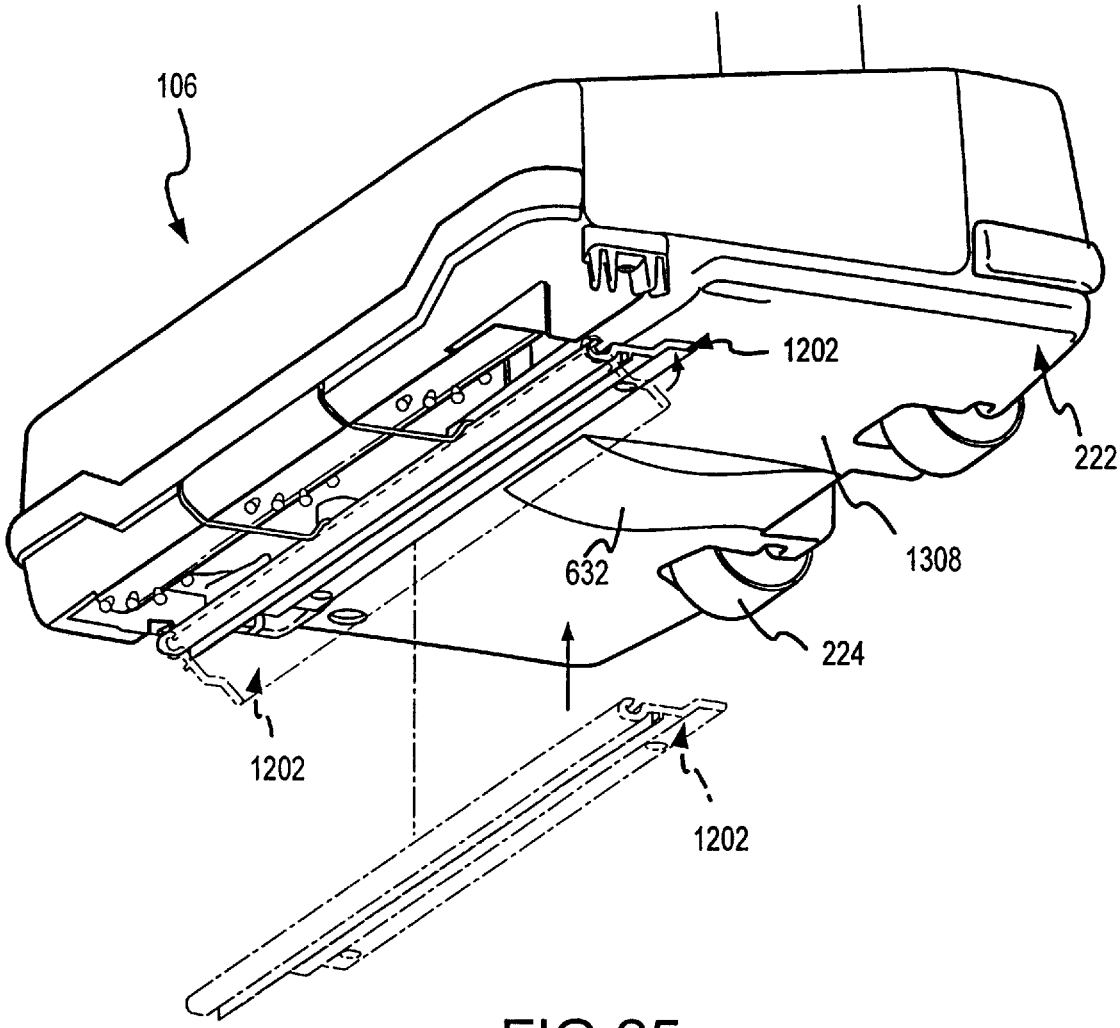
FIG. 25 is a bottom isometric view of the vacuum head, showing the squeegee both installed (solid lines) in and during mounting (dashed lines)
Figure 26:
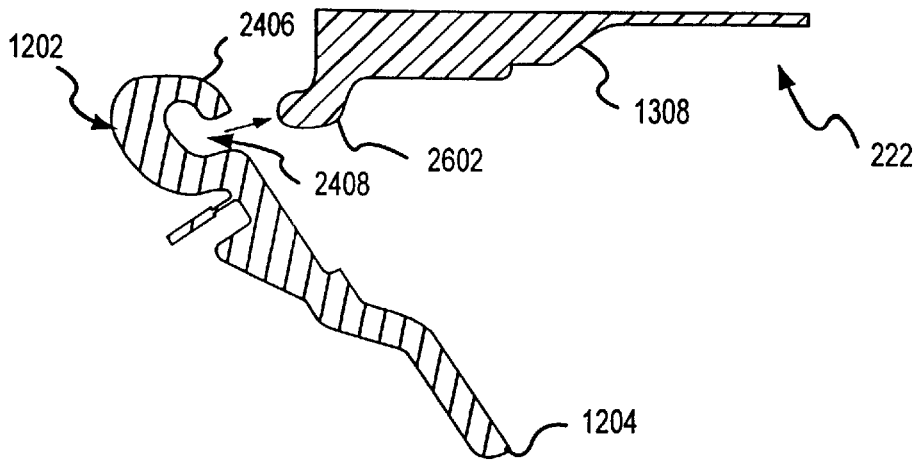
FIGS. 26–28 are representative cross-sectional views showing the squeegee prior to mounting, during mounting, and as mounted on the bottom plate.

Referring first to FIG. 12, the vacuum head 106 of the present invention incorporating the integrated runner squeegee 1202 is shown in a partially-exploded isometric view. Referring to FIGS. 12, 23, and 24, the squeegee 1202 includes a rear edge 1204, a front edge 1206, and an intermediate portion 1208. The rear edge 1204 is a flat member that defines attachment apertures 1210 and a positioning notch 1212. The attachment apertures 1210 are used with fasteners 1211 to connect the rear edge 1204 to the bottom cover 222. The positioning notch 1212 receives a positioning pin 2202 (FIG. 22) on the bottom cover 222 and ensures the proper lateral positioning of the squeegee 1202 on the lower surface 1308 of the bottom cover 222.

FIG. 22 shows the squeegee 1202 positioned on the lower surface 1308 of the bottom cover 222, adjacent to and just behind the roller brush 212. The positioning pin 2202 is shown received in the positioning notch 1212, and the two attachment apertures 1210 are shown being used to attach the squeegee 1202 to the lower surface 1308 of the bottom cover 222.

FIGS. 23 and 24 show the squeegee 1202 disconnected from the vacuum head 106. The squeegee 1202 is a generally elongated extruded part including primarily a main body 2300, a wiper blade 2402, and a flexible hinge 2404 attaching the wiper blade 2402 to the main body 2300. Preferably, the main body 2300 and the wiper blade 2402 are made of hard plastic material, and the hinge 2404 is made of relatively soft rubber material to allow the wiper blade 2402 to deflect forwardly or rearwardly depending on the motion of the vacuum head 106. It is contemplated that the wiper blade 2402 could be made of soft material, or that the main body 2300 could be made of soft material, but what is important in this instance is that the wiper blade 2402 is connected to the main body 2300 in a manner that allows the wiper blade 2402 to deflect forwardly or rearwardly as needed.

The main body 2300 includes the front edge 1206, the rear edge 1204, and the intermediate portion 1208. As best shown in FIG. 24, the front edge 1206 of the main body 2300, which is positioned adjacent to the roller brush 212 in the fully-assembled vacuum head housing 106, defines an upwardly hooked portion 2406 forming a generally L-shaped groove 2408, which opens upwardly. This L-shaped groove 2408 receives a correspondingly shaped protrusion 2602 formed on the lower surface 1308 of the bottom cover 222 of the vacuum head 106 and assists in attaching the squeegee 1202 to the lower surface 1308 of the bottom cover 222, in combination with the flat attachment flange 2412 defined in more detail below. The bottom surface of the front edge 1206, when mounted, is spaced away from the floor but is close enough to push larger objects along with the vacuum head 106 as the vacuum head 106 is moved forwardly along the surface 404 being cleaned. The front edge 1206 has an exterior generally rounded lobe shape. The rear of the lobe slopes upwardly to the bottom surface of the intermediate portion 1208, thereby forming a forward deflection stop 2410 for the wiper blade 2402.

The rear edge 1204 of the main body 2300 defines the flat attachment flange 2412. The two attachment apertures 1210 (FIG. 23) are formed therein, as well as the positioning slot 1212. The attachment flange 2412 is relatively thin and does not define any features extending from its bottom surface. The intermediate portion 1208 of the main body 2300 extends between the inner edge 2414 of the attachment flange 2412 and the inner edge 2416 of the C-shaped connector hook 2406. The top surface of the intermediate portion 1208 simply rests against the lower surface 1308 of the bottom cover 222. The bottom surface of the intermediate portion 1208 defines a rearward deflection stop 2418 and the flexible hinge 2404 for supporting the wiper blade 2402.

The flexible hinge 2404 extends along the entire bottom surface and is formed of a soft rubber material. The hinge 2404 has a relatively smaller width dimension than does the wiper blade 2402, and is relatively shorter than the wiper blade 2402 in a vertical section, as shown in FIG. 24. The wiper blade 2402 extends continuously along the bottom surface of the hinge 2404 and is preferably formed of a hard material such as hard plastic. The bottom edge of the wiper blade 2402 engages the surface 404 being cleaned when the vacuum head 106 is not being moved. The height of the wiper blade 2402, as shown in FIG. 24, is designed to allow the wiper to extend down from the main body 2300 in combination with the height of the hinge 2404 and to engage the surface 404 being cleaned. The wiper blade 2402 is shown in FIG. 24 as having a rectangular cross-section, however, the forward and rearward edges of the wiper blade 2402 adjacent the surface 404 being cleaned could be angled to facilitate an easier transition between the forward and rearward deflection of the wiper blade 2402 depending on the movement of the vacuum head 106. The bottom edge of the wiper blade 2402 could also be rounded.

The rearward deflection stop 2418 is formed between the wiper blade 2402 and the attachment flange 2412 and extends from the bottom surface of the intermediate portion 1208 of the main body 2300. The rearward deflection stop 2418 has a sloped rearward surface 2420 and a vertical forward surface 2422, which form a generally triangular cross-sectional shape. The rearward deflection stop 2418 acts to restrict the amount of deflection possible by the wiper blade 2402 when the vacuum head 106 is moved in the forward direction and the wiper blade 2402 is deflected rearwardly. Thus, the rearward deflection stop 2418 keeps the wiper blade 2402 from deflecting too far rearwardly in order to maintain the desired contact between the wiper blade 2402 and the surface 404 being cleaned. When the vacuum head 106 is moved in a rearward direction, the wiper blade 2402 deflects forwardly until it contacts the forward deflection stop 2410.

The integral co-extrusion of the main body 2300, hinge 2404, and wiper 2402 has several benefits. One of these benefits is the consistent and continuous attachment of the wiper blade 2402 to the main body 2300, which creates an evenly distributed force along the wiper blade 2402 as the wiper blade 2402 engages the floor, regardless of the direction the wiper blade 2402 is deflected. This is an advantage over the prior known attachment structures, which attach the wiper blade at discrete locations along the width of the head as opposed to the continuous attachment disclosed herein. The co-extrusion of the main body 2300, hinge 2404, and wiper blade 2402 allows for the use of polyurethane as the wiper blade material, and optionally as the main body material, while a flexible rubber can be used as the hinge material. This helps prevent scratching and marring of the surface 404 being cleaned when compared to the burrs developed on the metal wiper blades of previous designs. In addition, the wiper blade 2402 has a self-adjusting height regardless of whether the vacuum head 106 is being moved forwardly or rearwardly since the squeegee 1202 can deflect forwardly or rearwardly along its entire length, as required by the motion of the vacuum head 106. Further, the positive engagement of the wiper blade 2402 along the surface 404 being cleaned helps provide a seal against that surface, which creates a smaller suction area and accentuates the suction from the airflow propulsion device 202 along the front and side areas of the vacuum head 106 as opposed to directly behind the roller brush 212.

Figure 27:
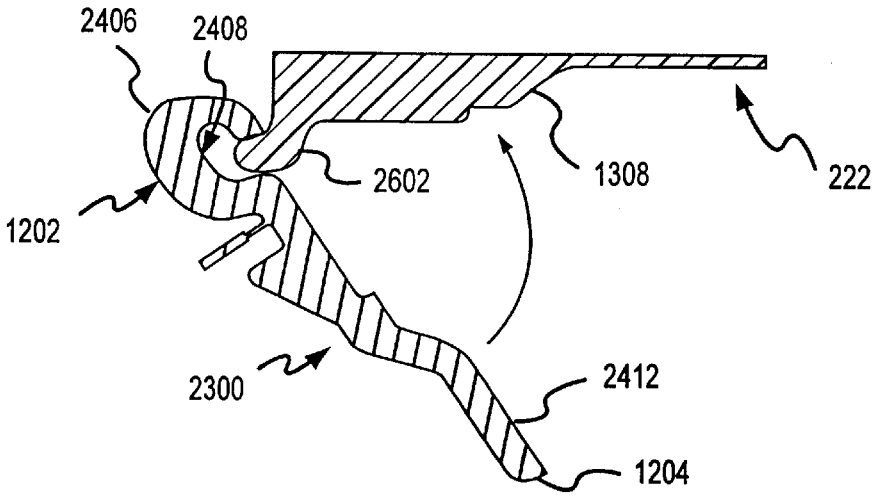
Figure 28:
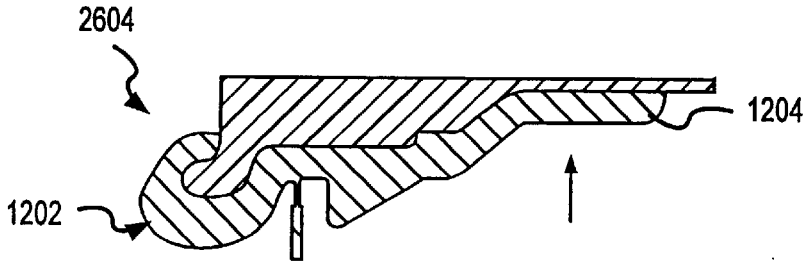

FIGS. 25–28 show the runner squeegee 1202 being attached to the bottom cover 222. The two attachment locations 1210 of the integrated runner squeegee 1202 provide secure attachment and easy replacement. The L-shaped recess 2408 is continuous along the front edge 1206 of the integrated runner squeegee 1202 and receives a similarly shaped protrusion 2602 extending from the lower surface 1308 of the bottom cover 222. The squeegee 1202 is oriented relative to the bottom cover 222 to allow the L-shaped protrusion 2602 to enter the open end of the recess 2408. The squeegee 1202 is then moved straight back to further insert the L-shaped protrusion 2602 therein. Referring to FIG. 27, the main body 2300 of the squeegee 1202 is then pivoted around the engagement of the L-shaped protrusion 2602 and the L-shaped recess 2408 so that the top surface of the main body 2300 engages the lower surface 1308 of the bottom cover 222. The L-shaped protrusion 2602 is thus seated in the L-shaped recess 2408, creating the L-shaped tongue and groove interlocking connection 2604 shown in FIG. 28. The flat attachment flange 2412 is then attached by fasteners, such as screws, to the bottom cover 222. The squeegee 1202 is held firmly in all dimensions by the L-shaped tongue and groove interlocking connection 2604 and fasteners 1211. Any lateral sliding is eliminated by the fasteners 1211, as well as the engagement of the positioning notch 1212 with the positioning pin 2202 (FIG. 22).

When attached to the vacuum head 106, the integrated squeegee 1202 also secures the rear free ends of the anti-ingestion bar 1200 or 1200'.

Headlight, Sidelight, and Refractor

The vacuum 100 of the present invention, illustrated in FIG. 1, includes a light assembly 2900 (FIG. 29) having a headlight 102 and a sidelight 104, that direct light to the front of the vacuum and to the side of the vacuum, respectively. FIG. 29 is an exploded isometric view of the light assembly including a headlight cavity 2902 in the vacuum head 106, a reflector assembly 2904, a headlight lens housing 2906, a headlight lens 2908, a sidelight cavity 2910, and a sidelight lens 2912. In the preferred embodiment, the headlight 102 and the sidelight 104 are optically connected to a common or shared light source that optimizes both the forward and side lighting without comprising weight. Additionally, the headlight 102 and the sidelight 104 of the present invention do not cast a shadow in front of vacuum 100 and to the side of the vacuum 100 respectively because of the there orientation on the head housing top cover 244 and because the light from the lights 102, 102 is projected outwardly and downwardly.

The upper front portion of the vacuum head 106 defines the headlight cavity 2902 wherein the headlight 102 is operably connected with the vacuum head 106. The headlight cavity 2902 defines structure for engaging and retaining the reflector assembly 2904, the headlight lens housing 2906, and the headlight lens 2908. The structure for engaging and retaining the reflector assembly 2904 includes a downwardly sloped reflector assembly surface 2914, a left locating wall 2916, a right locating wall 2918, a guide rail 2920, a rear wall 2922, and a snap hole 2924. Generally, the reflector assembly 2904 snaps into place and rests on the downwardly sloped reflector assembly surface 2914 between the left 2916 and right locating walls 2918. Note, "left" and "right" orientation as discussed within this section is from the perspective of facing the front of the vacuum.

The structure for engaging and retaining the headlight lens housing 2906 includes a rear edge 2926, a left side edge 2928, a right side edge 2930, and a front ledge 2932. The rear edge 2926 of the headlight cavity 2902 defines a ledge 2934 to support the headlight lens housing 2906. There are three guide slots 2936 along the rear edge 2926 of the headlight cavity 2902 that are used to guide the headlight lens housing 2906 into position during assembly. The side edges 2928, 2930 of the headlight cavity 2902 also define a ledge 2934 to support the lens housing 2906. The left and right locating walls 2916, 2918 each define a bolthole 2938 (only the right bolthole 2938 is shown) for engaging corresponding bolts or screws that secure the headlight lens housing 2906 to the vacuum head 106. Generally, the headlight lens housing 2906 is removably attached with the top cover 244 (FIG. 2) to provide easy access to the headlight lens 2908 and to the reflector assembly 2904 as discussed in more detail below.

The front ledge 2932 of the headlight cavity 2902 includes a left side portion 2940, a right side portion 2942, and a lower middle portion 2944 therebetween. The left and right side portions 2940, 2942 are generally flat areas, and the middle portion 2944 is lower than the side portions, with downwardly sloping portions 2946 between the middle and side portions. A pair of tabs 2948 project upwardly from the lower middle portion 2944 of the front ledge 2932. Generally, the headlight lens 2908 defines the same contour as the front ledge 2932 of the headlight cavity 2902 and rests atop the front ledge 2932 when assembled.

The headlight 102 includes the reflector assembly 2904, the headlight lens housing 2906, and the headlight lens 2908. In the preferred embodiment, the reflector assembly 2904, illustrated in FIG. 30, includes a first bulb 3002 and a second bulb 3004, which are the common light source for the headlight 102 and the sidelight 104. Utilizing the common light source provides for less heat build up, less energy consumption, and reduced weight as compared with a configuration that does not use a common light source. In addition, by using less energy for lighting, less energy is diverted from the vacuum motor to power the light bulbs, and hence a smaller motor may be used to achieve the desired vacuuming power.

The reflector assembly 2904 includes a headlight reflector 3006 and a sidelight reflector 3009. The sidelight reflector 3009 is discussed in more detail below. The headlight reflector 3006 defines a generally vertical reflective surface 3008 and a generally horizontal reflective surface 3010. A first reflective surface 3012 and a second reflective surface 3014 make up the vertical reflective surface 3008. Each reflective surface 3012, 3014 is curved or contoured in two directions. In other words, with respect to the coordinate axes shown in FIG. 30, each reflective surface 3012, 3014 is curved in the vertical plane about the y axis (i.e., the x-z plane) and in the horizontal plane about the z axis (i.e., the x-y plane). Accordingly, each reflective surface 3012, 3014 is generally hyperbolic. The generally hyperbolic reflective surfaces 3012, 3014 are configured to direct light from the first bulb 3002 and the second bulb 3004 toward the headlight lens 2908. As is generally known, a hyperbola defines a dish-like shape that includes a focal point. The first and second generally hyperbolic reflective surfaces were designed with the general concepts of a hyperbola in mind. However, unlike a hyperbola, the generally hyperbolic reflective surfaces 3012, 3014 do not conform to precise mathematical definition. The goal of the generally hyperbolic reflective surfaces 3012, 3014 is to reflect and concentrate light from the bulbs 3002, 3004 toward the headlight lens 2908. Accordingly, optimal use of available light from the bulbs 3002, 3004 is utilized for lighting the area directly in front of the vacuum. Note, optimal use of available light is also utilized for lighting the area to the side of the vacuum, as discussed in more detail below with reference to the sidelight 104.

Each generally hyperbolic reflective surface 3012, 3014 defines a focal region 3016, 3018. The focal regions 3016, 3018 are located forwardly of the generally reflective surfaces 3012, 3014. The first light bulb 3002 and the second light bulb 3004, plugged into a first socket assembly 3020 and a second socket assembly 3022, respectively, are located generally within the focal regions 3016, 3018 of the corresponding generally hyperbolic reflective surfaces 3012, 3014. Each generally hyperbolic reflective surface 3012, 3014 also defines apertures 3102 (FIG. 31) adjacent to the respective focal region 3016, 3018 wherein the first socket assembly 3020 and the second socket assembly 3022 and associated wiring 3402, 3404 (FIG. 34) are snapped into place. Generally, light transmitted from the focal regions 3016, 3018 toward the associated generally hyperbolic reflective surfaces 3012, 3014 is reflected so as to intersect the headlight lens generally transversely to the rear face of the headlight lens 2908 as discussed in further detail below.

Figure 32:
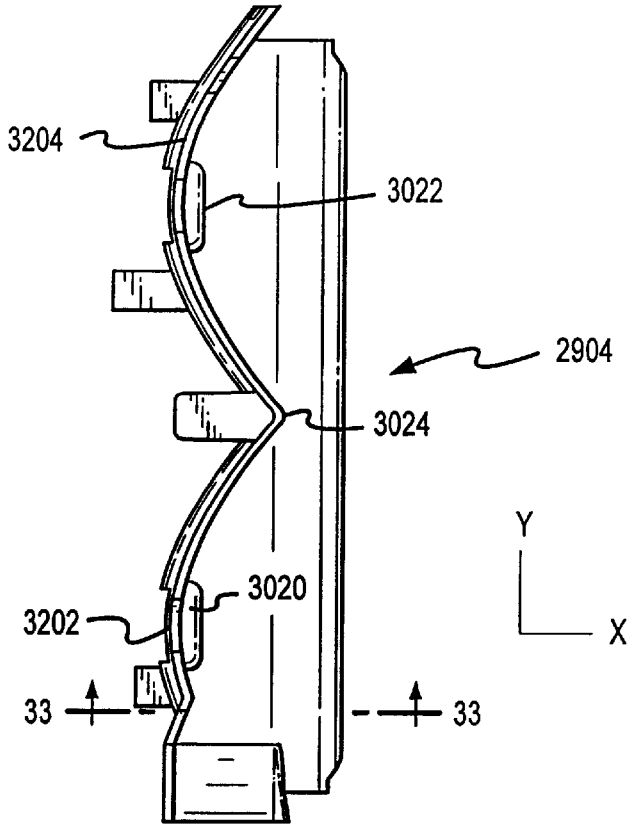
FIG. 32 is a top plan view of the reflector assembly depicted in FIG. 30.
Figure 33:
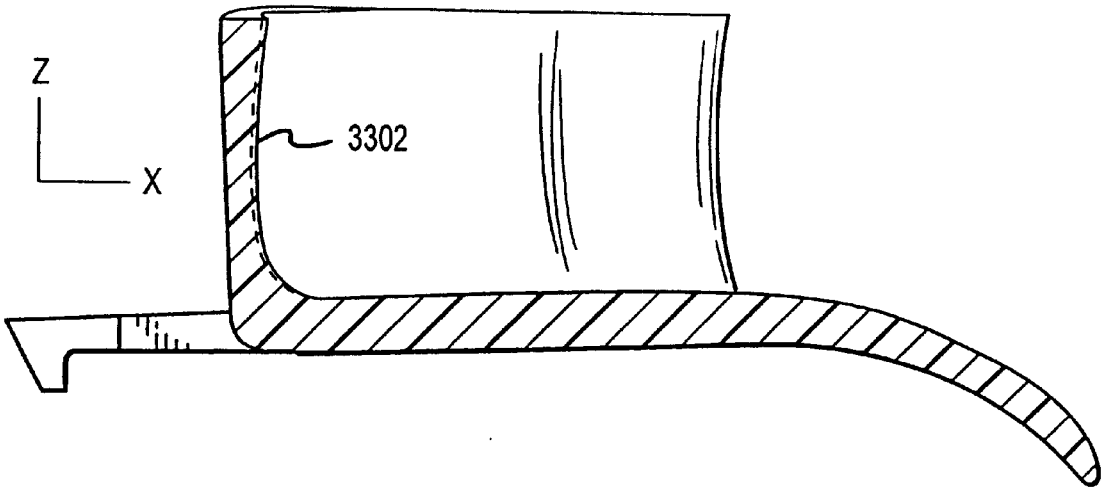
FIG. 33 is a cross-sectional view of the reflector assembly depicted in FIG. 30 taken along line 33—33 of FIG. 32.

As mentioned above, each generally hyperbolic reflective surface 3012, 3014 is curved in two directions. In FIG. 32, which is a top view of the reflector assembly 2904, the curvature of the first reflective surface 3012 in the horizontal plane is emphasized with a first dashed line 3202, and the curvature of the second reflective surface 3014 in the horizontal plane is emphasized with a second dashed line 3204. In FIG. 33, which is a cross-sectional view taken along line 33—33 of FIG. 32, the curvature of the first reflective surface 3012 in the vertical plane is emphasized with a third dashed line 3302. This section is also representative of the curvature defined in the vertical plane by the second generally hyperbolic reflective surface 3014.

Generally, in a preferred embodiment, the radii of the curvature in the horizontal plane for each generally hyperbolic reflective surface 3012, 3014 along dashed lines 3202, 3204 may vary from about 2.5 inches to about 8 inches. Generally, in a preferred embodiment, the radii of the curvature in the vertical plane for each generally hyperbolic reflective surface 3012, 3014 along dashed line 3302 may vary from about 3 inches to about 4 inches. As mentioned above, for any embodiment of the reflector assembly 2904, the curvature in the vertical plane and the curvature in the horizontal plane should be designed to reflect light transmitted from the bulbs 3002, 3004 toward the headlight lens 2908.

Figure 30:
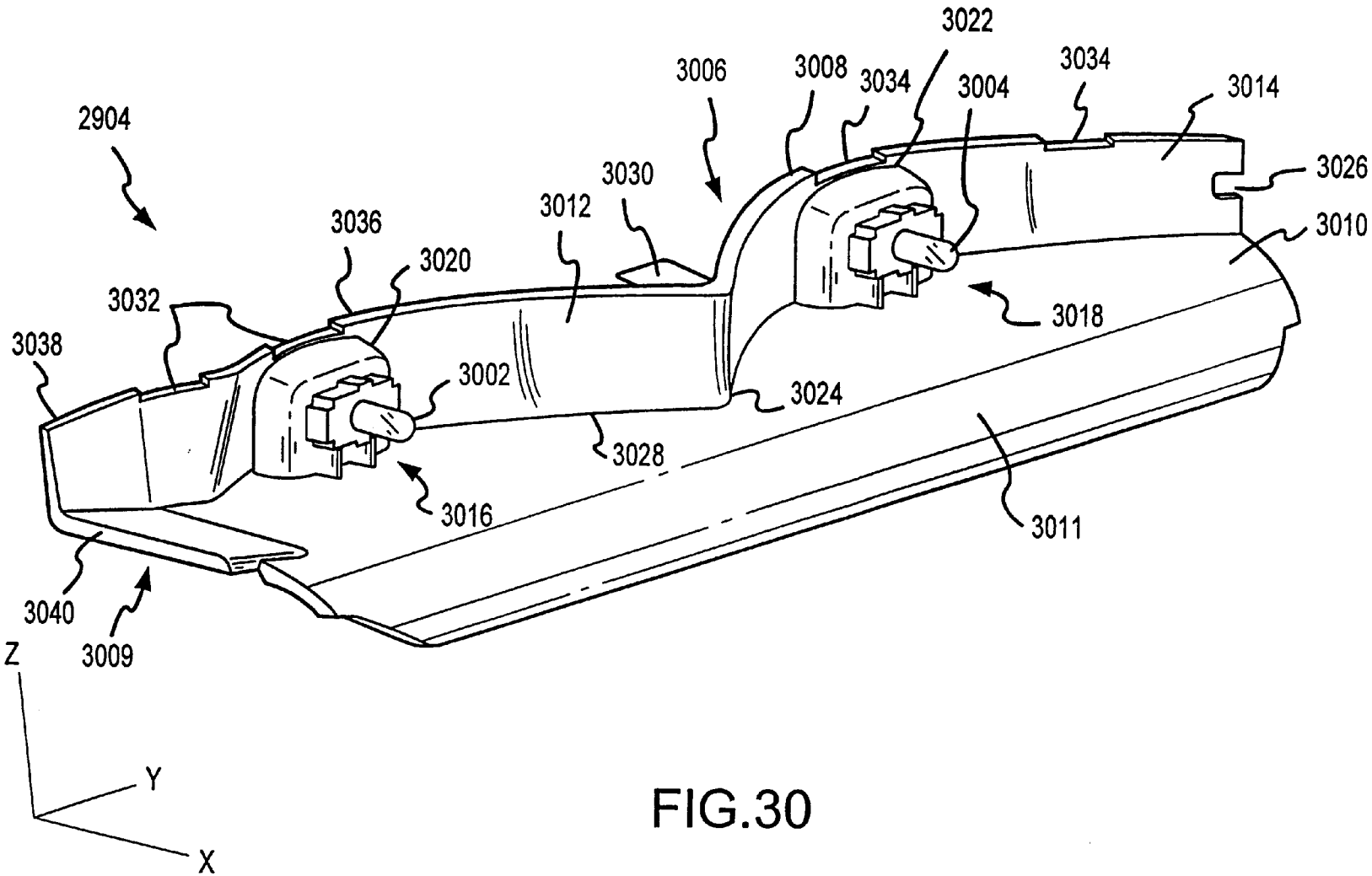
FIG. 30 is an isometric front view of a reflector assembly comprising part of the light assembly depicted in FIG. 29.

In a most preferred embodiment, the radius of the curvature of the dashed line 3202 varies from about 2.6 inches adjacent to the first socket assembly 3020 to about 7.8 inches adjacent the intersection 3024 between the first 3012 and second 3014 hyperbolic reflective surfaces. Accordingly, the curvature flattens out as one moves along the dashed line 3202 from adjacent to the first socket assembly 3020 to the intersection 3024. Referring to the second hyperbolic reflective surface 3014, in the most preferred embodiment the radius of the curvature of the dashed line 3204 in the horizontal plane varies from about 3.8 inches adjacent to the second socket assembly 3022 to nearly flat, i.e., no radius, adjacent to the intersection 3024, and to about 7.5 inches adjacent a guide slot 3026 (FIG. 30). Accordingly, the curvature flattens out from the second socket assembly 3022 to the intersection 3024, and from the second socket assembly 3022 to the guide slot 3026.

In the most preferred embodiment, if a series of vertical cross-sections were taken, each parallel to the vertical plane containing line 33—33, and if dashed lines similar to dashed line 3302 were placed in each of those cross-sections, the radius of the curvature of the dashed lines in the vertical plane would vary from about 3.2 inches adjacent to the first socket assembly 3020 to about 3.3 inches adjacent the intersection 3024. Similarly, the radius of the curvature in the vertical plane of those dashed lines would vary from about 3.8 inches adjacent the second assembly 3022 to about 3.1 inches adjacent the intersection 3024, and to about 3.2 inches adjacent to the guide slot 3026.

In addition to the generally vertical reflective surface 3008, the reflector assembly includes a generally horizontal reflective surface 3010. The generally horizontal reflective surface 3010 defines a generally flat reflective surface adjacent a bottom edge 3028 of the generally vertical reflective surface 3008. Moving forward (i.e., away from the vertical reflective surface 3008), the horizontal reflective surface 3010 defines a generally flat surface until just forward of the intersection 3024. Moving forward from the intersection 3024, the horizontal reflective surface 3010 begins to curve downwardly. As shown to good advantage in FIG. 37, the horizontal reflective surface 3010 thereby reflects both direct light and diffuse light from the bulbs 3002, 3004 toward the headlight lens 2908.

Both the generally vertical reflective surface 3008 and the generally horizontal reflective surface 3010 are reflective. Preferably, the reflector assembly 2904 is fabricated from plastic. In the preferred embodiment, the reflector assembly is coated with chrome to provide the reflective characteristic. A coating tab 3030 extends rearwardly from the reflector assembly 2904 and is used to hold the reflector assembly 2904 during the coating process.

Figure 31:
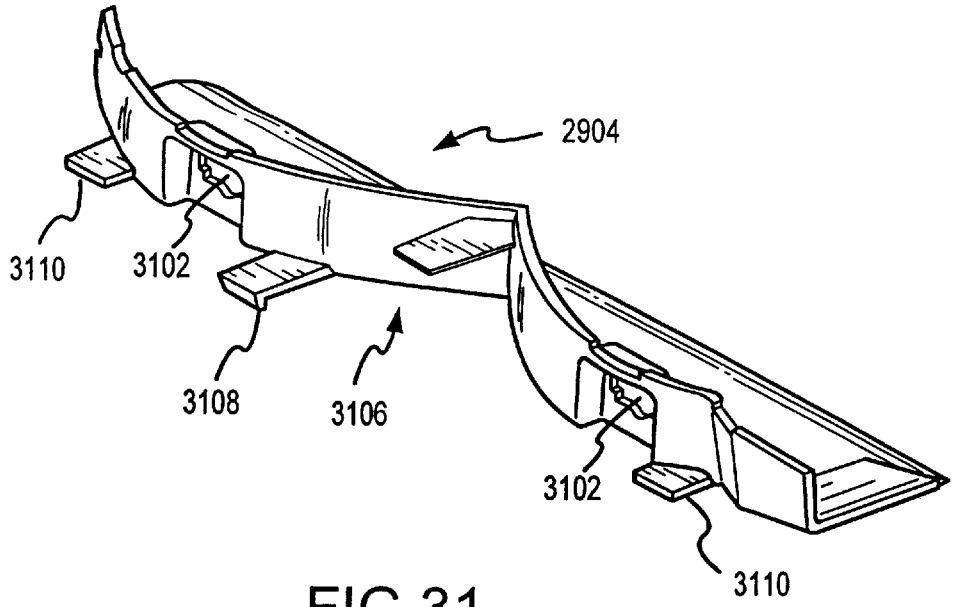
FIG. 31 is an isometric rear view of the reflector assembly depicted in FIG. 30.

Referring to FIG. 31, the rear side 3106 of the reflector assembly 2904 defines a hook 3108 and at least one pressure tab 3110. To assemble the reflector assembly 2904 with the headlight cavity 2902, the reflector assembly 2904 is placed between the locating walls 2916, 2918 with the bottom side of the horizontal reflective surface 3010 on the downwardly curved 2914 reflector assembly surface. The reflector assembly 2904 is then pushed rearward until the pressure tabs 3110 abut the rear wall 2922 of the cavity 2902, and with the guide slot 3026 (FIG. 30) engaging the guide rail 2920. When the tabs 3110 abut the rear wall 2922 of the cavity 2902, the hook 3108 will be adjacent the hook snap hole 2924. The reflector assembly 2904 is seated within the headlight cavity 2902 by pressing rearwardly on the reflector assembly 2904 until the hook 3108 engages the hook snap hole 2924 (see FIG. 34). When the reflector assembly 2904 is seated in the headlight cavity 2902, the bottom of the horizontal reflective surface 3010 will generally lie on the top of the downwardly sloped reflector assembly surface 2914 with the bottom of the downwardly curving portion of the horizontal reflective surface 3010 following the downwardly curved contour of the reflector assembly surface 2914. In the seated position, the reflector assembly 2904 is canted somewhat downwardly.

Figure 34:
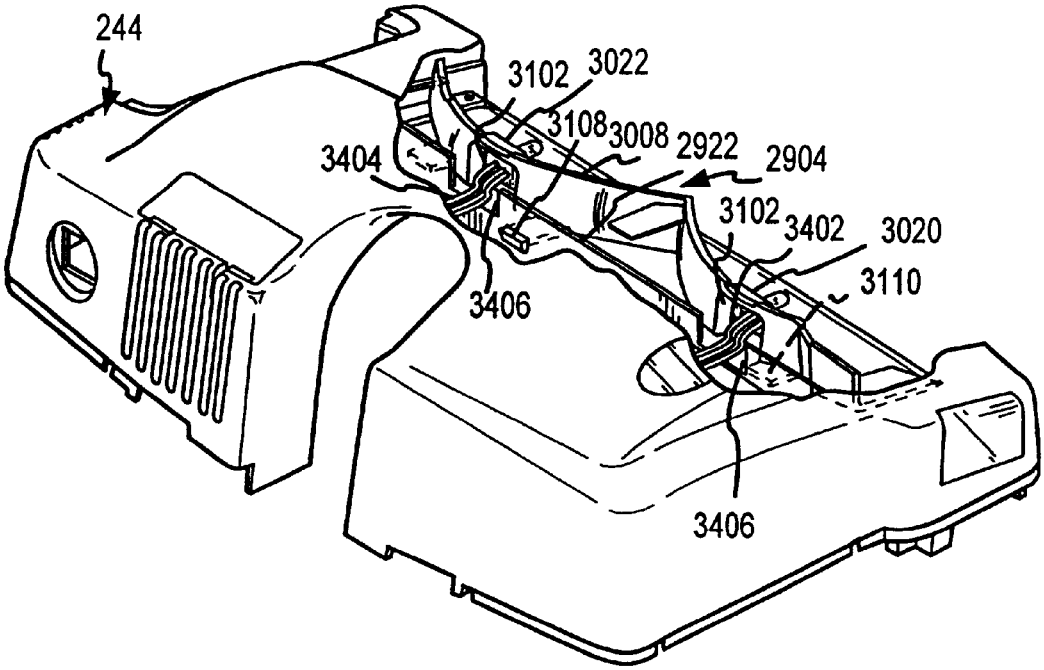
FIG. 34 is a partially cut-away, isometric view of the top side and rear side of the head, showing the rear side of the reflector assembly installed in the head.

FIG. 34 is a cut-away isometric view of the reflector assembly 2904 within the light assembly cavity 2902 of the vacuum top cover 244. As can be seen from this figure, the wiring harnesses 3404 extend through the apertures 3102 in the vertical reflective surface 3008 and through cut-outs 3406 in the rear wall 2922 of the cavity 2902, and the sockets 3020, 3022 on the forward end of the wiring harnesses 3404 are secured within the apertures 3102 in the vertical reflective surface 3008. As can be further seen, the hook 3108 engages the backside of the rear wall 2922 of the headlight cavity 2902, and the pressure tabs 3110 (shown in phantom) abut the front of the rear wall 2922 of the headlight cavity 2902.

Figure 8:
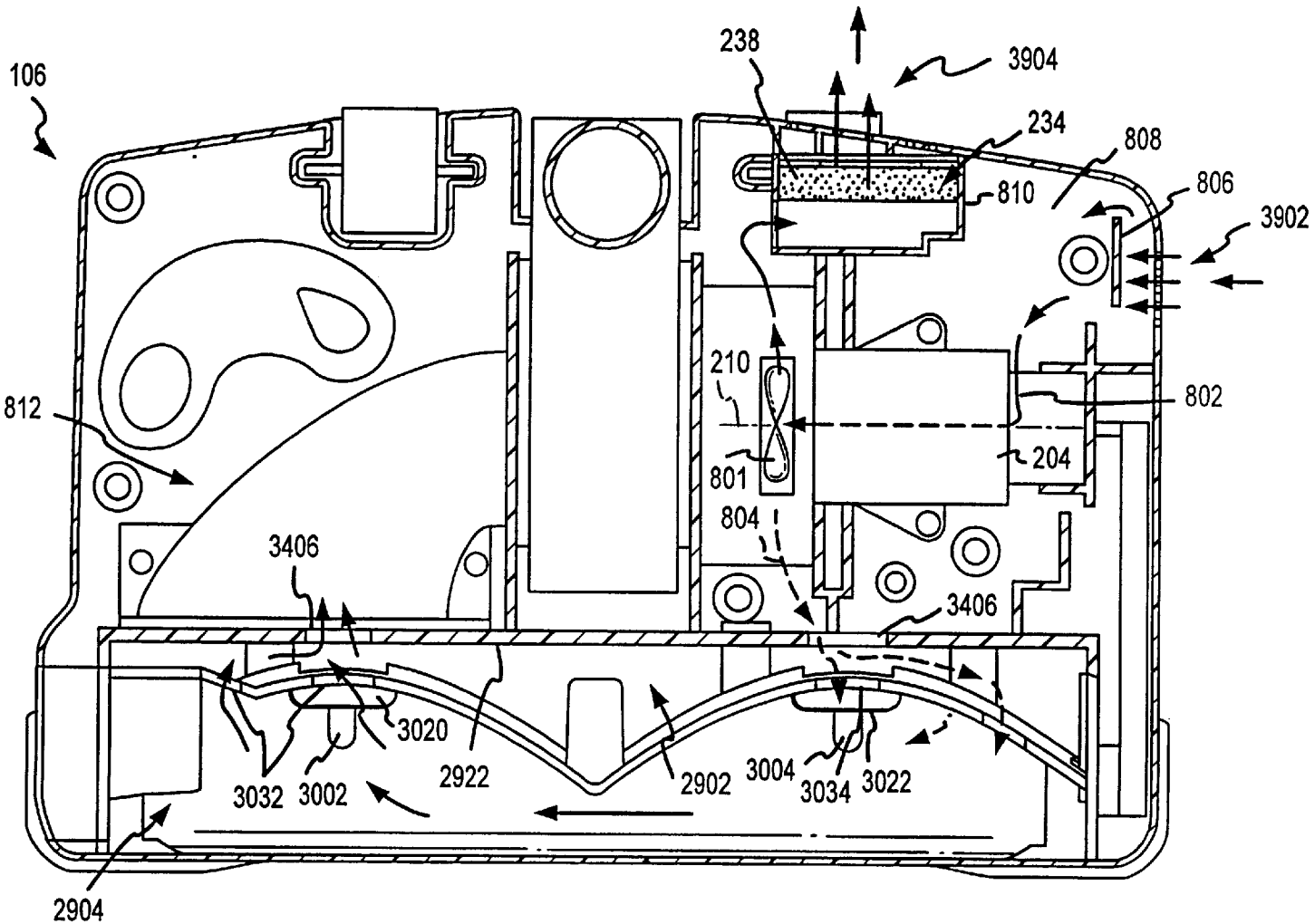
FIG. 8 is a top plan view of the head with the top cover removed and showing the air path through the head.

Referring again to FIG. 30 and to FIG. 8, the reflector assembly 2904 includes at least one left ventilation recess 3032 along the top edge of the vertical reflector, and at least one right ventilation recess 3034 along the top edge 3036 of the vertical reflector 3008. The ventilation recesses 3032, 3034 provides a pathway for air to circulate around the socket assemblies 3020, 3022 and the light bulbs 3002, 3004, and hence remove heat therefrom. The air flow within the reflector assembly 2904 and within the vacuum head is discussed in detail below. Cooling the bulbs 3002, 3004 provides for longer bulb life. In the preferred embodiment, there are two left ventilation recesses 3032 and two right ventilation recesses 3034 in the top edge 3036 of the vertical reflector 3008, wherein at least one left vent recess and at least one right vent recess are adjacent the left and right socket assemblies 3020, 3022, respectively. This provides greater cooling to the socket assemblies 3020, 3022 and the corresponding bulbs 3002, 3004.

Figure 35:
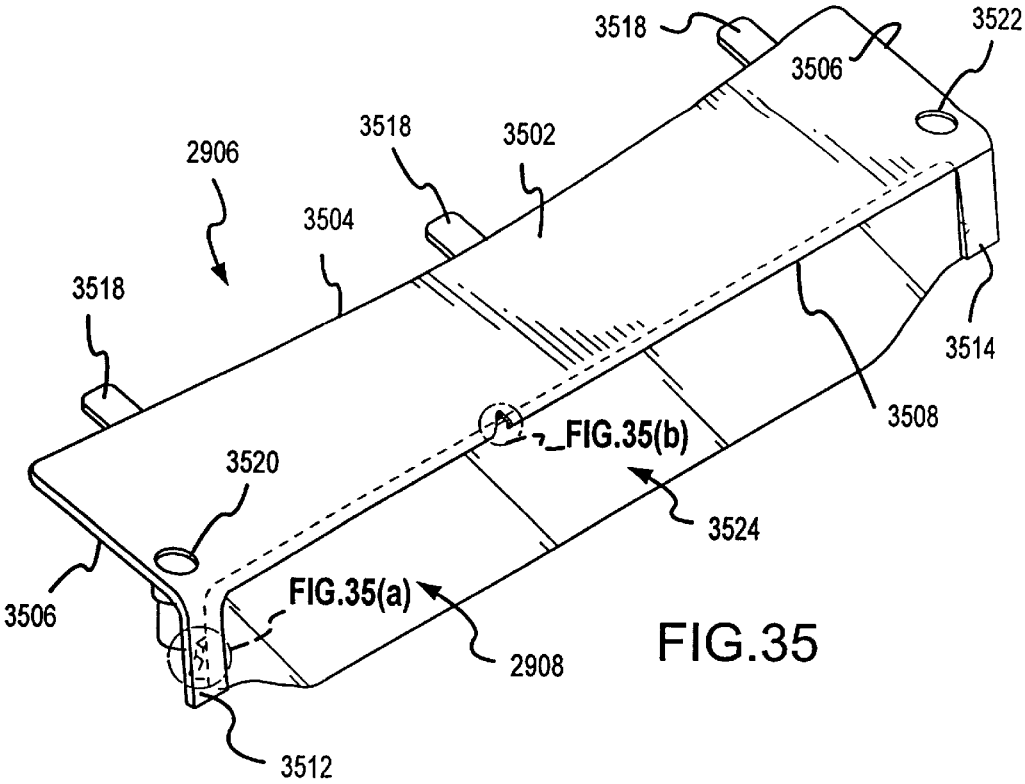
FIG. 35 is an isometric view of the top and front of a headlight lens housing comprising part of the light assembly depicted in FIG. 29.
Figure 35A:
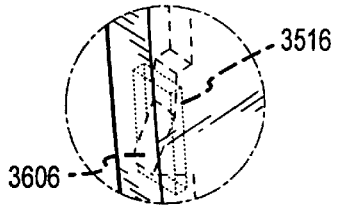
FIG. 35*a* is an enlarged isometric view of a headlight lens snap in engagement with a recess in a channel of the headlight lens housing.
Figure 35B:
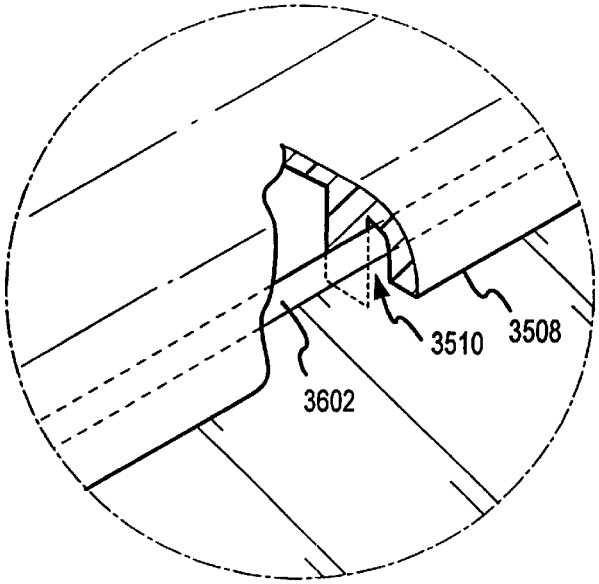
FIG. 35*b* is an enlarged, partially cut-away, isometric view of the a top edge of the headlight lens in engagement with a channel in a downwardly extending flange in a front portion of a cover of the headlight lens housing.

The headlight 102, as mentioned above, also includes a headlight lens housing 2906, which is illustrated to best advantage in FIG. 35. The headlight lens housing 2906 secures the headlight lens 2908 within the headlight cavity 2902 of the vacuum head housing 106. The headlight lens housing 2906 defines a cover 3502 having a rear edge 3504, and two side edges 3506. The front of the cover defines a short downwardly extending flange 3508, which defines the front wall of a channel 3510 (FIG. 35*b*) adapted to engage and retain a top edge 3602 of the headlight lens 2908. The downwardly extending flange 3508, along the leftmost and rightmost portion of the headlight lens housing 2906, extends downwardly defining a left front sidewall 3512 and a right front sidewall 3514. The left and right front sidewalls 3512, 3514 are adapted to rest on the front ledge 2932 (FIG. 29) of the headlight cavity 2902 when assembled with the vacuum head housing 106. The left and right front sidewalls 3512, 3514 each also define a channel (not shown) adapted to engage and retain the side edges 3604, 3605 (FIG. 36) of the headlight lens 2908. The channels in the sidewalls 3512, 3514 define a recess 3516 (shown in hidden line in FIG. 35*a*) adapted to engage a left headlight light lens snap 3606 and a right headlight lens snap 3608, discussed below with reference to FIG. 36, and thereby secure the headlight lens 2908 within the channel 3510 of the headlight housing 2906.

There are three guide tabs 3518 (FIG. 35) along the rear edge 3504 of the cover 3502. The guide tabs 3518 are adapted to engage the guide slots 2936 (FIG. 29) along the rear ledge 2934 of the headlight cavity 2902. In addition, there are two bolt housings 3520, 3522 in the front left and right portions of the headlight lens housing 2906. The bolt housings 3520, 3522 extend downwardly from the cover 3502 of the headlight lens housing 2906 and are adapted to rest on the front left locating wall 2916 and front right locating wall 2918, respectively, of the light assembly cavity 2902. The headlight lens housing 2906 is assembled with the vacuum head housing 106 by guiding the guide tabs 3518 into the corresponding guide slots 2936 until the rear edge 3504 of the headlight lens housing 2906 rests on the rear ledge 2934 of the headlight cavity 2902. In the assembled position, the bolt housings 3520, 3522 seat directly over the left and right bolt holes 2938. Accordingly, a bolt or screw (not shown) is inserted through the bolt housings 3520, 3522 and tightened into the corresponding bolt holes 2938, securing the headlight lens housing 2906 to the vacuum head housing 106. Before securing headlight lens housing 2906 to the vacuum head housing 106, the headlight lens 2908, as discussed below, should be assembled with the headlight lens housing 2906.

Figure 36:
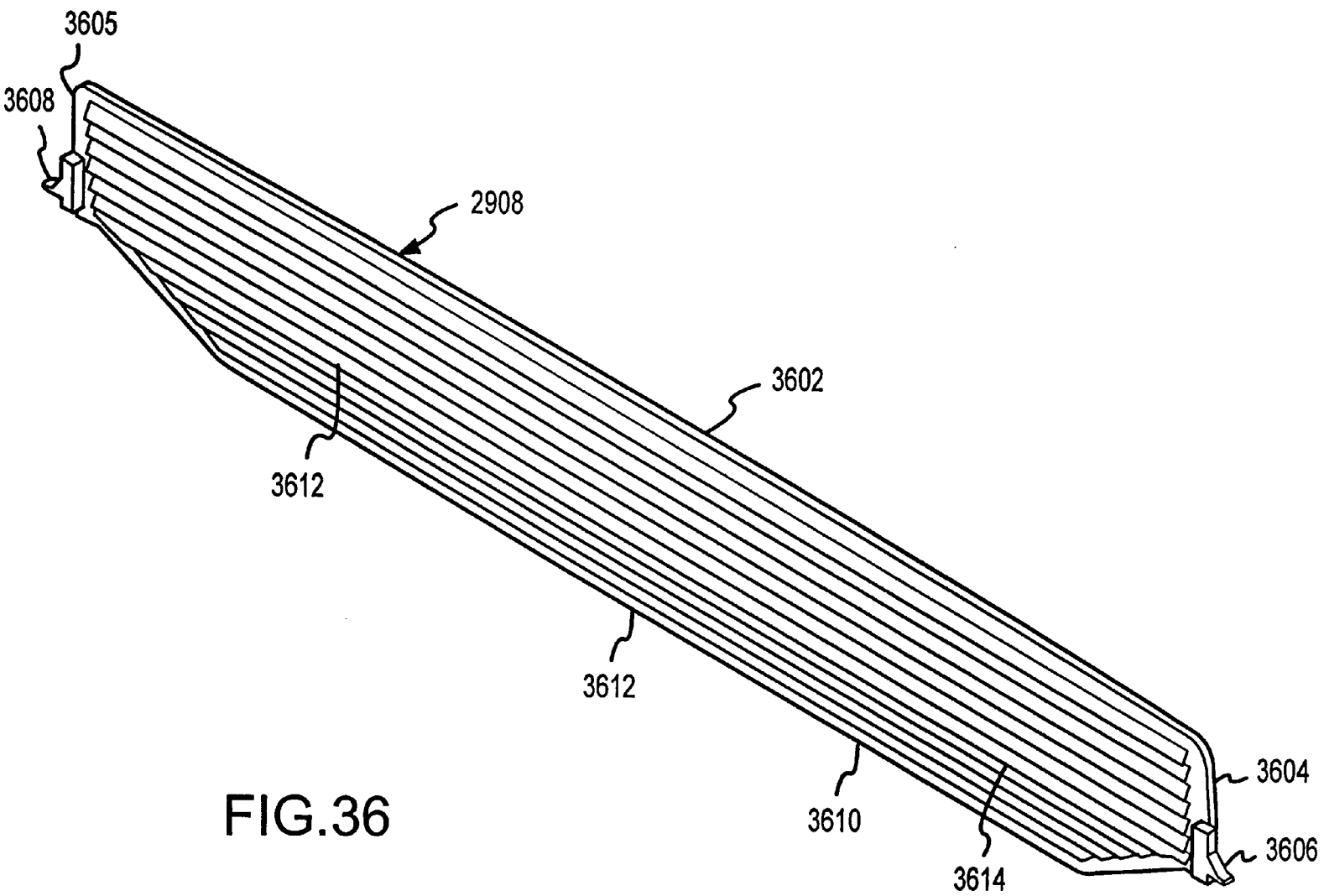
FIG. 36 is a rear isometric view of the headlight lens depicted in FIGS. 29, 35, and 35*b*.

The headlight lens 2908, illustrated in FIG. 36, is a generally rectangular lens defining a top edge 3602, a left side edge 3604, a right side edge 3605, and a bottom edge 3610. The headlight lens 2908 is made from Polycarbonate, preferably LEXAN™. The bottom edge 3610 of the headlight lens is contoured to fit along the lower front ledge 2932 of the headlight cavity 2902. Accordingly, the bottom edge 3610 has a downwardly sloping contour from the side edges 3604, 3605 toward a lower middle portion 3612 between the side edges 3604, 3605. The front view of the vacuum, illustrated in FIG. 4, most clearly illustrates the contour of the bottom edge 3610 of the headlight lens 2908.

Figure 37:
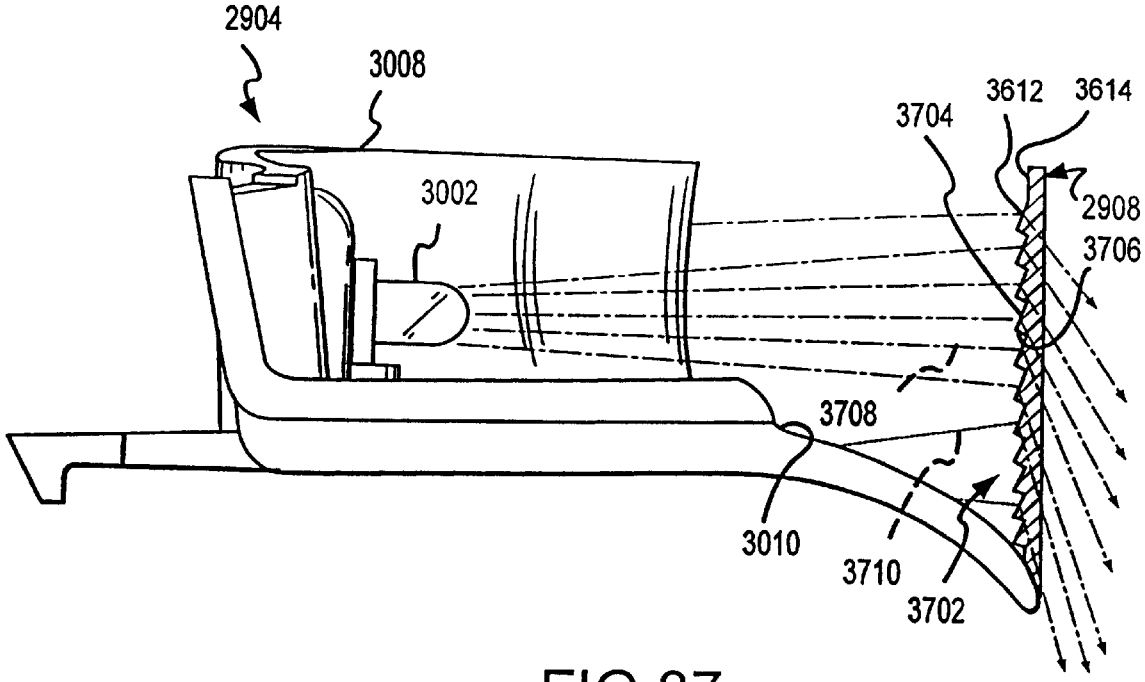
FIG. 37 is a side elevation of the reflector assembly with the light bulbs turned on, and the light from the light bulbs incident on the headlight lens.
Figure 38:
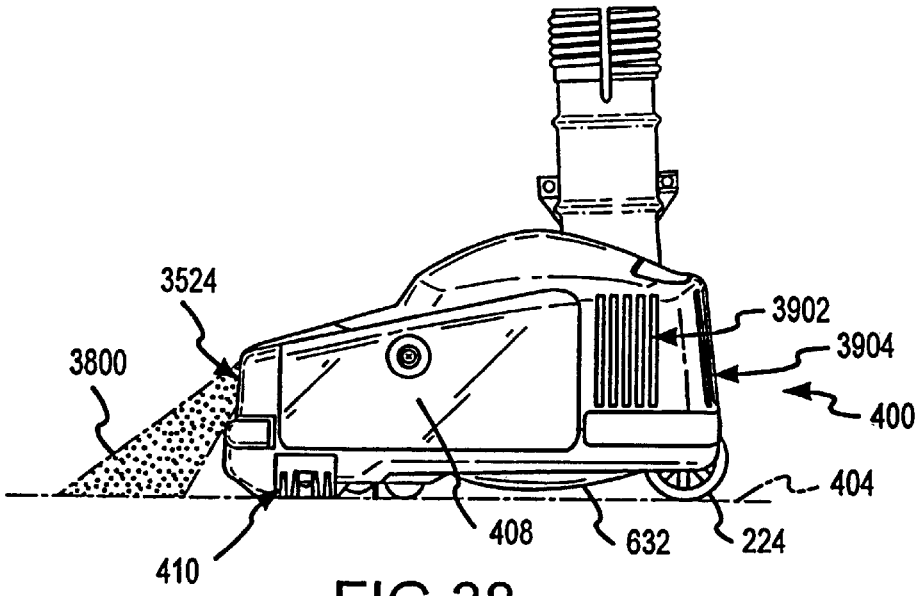
FIG. 38 is a side elevation of the vacuum with the headlights turned on, showing the light being refracted by the headlight lens and illuminating the area downwardly and forwardly of the vacuum.

The front side 3524 (FIG. 35) of the headlight lens 2908 is generally flat. The rear side 3614 (FIGS. 36 and 37) of the headlight lens 2908 defines a refraction contour 3612 that redirects a portion of the light 3800 from the bulbs 3002, 3004 and the reflector assembly 2904 outwardly and downwardly toward the area directly in front of the vacuum as shown in FIG. 38. In cross section, as illustrated in FIG. 37, the refraction contour 3612 defines a saw tooth pattern 3702. Each tooth in the saw tooth pattern 3702 has a long face 3704 and a short face 3706. The saw tooth pattern 3702 is configured so that when the headlight lens 2908 is assembled with the headlight 102, the long face 3704 of the saw tooth 3702 forms an angle of greater than 90 degrees as compared with light transmitted directly from the bulbs 3002, 3004, and the short face 3706 is about transverse the long face 3704. Therefore, a portion of the light 3708 striking the refraction contour 3612 directly from the bulbs 3002, 3004 or after reflecting off the vertical 3008 or horizontal reflective 3010 reflective surfaces is transmitted downwardly and forwardly directly in front of the vacuum.

Accordingly, the surface about to be vacuumed, directly in front of the vacuum, is illuminated. A portion of the diffuse light 3710 reflected from the downwardly sloping portion 3011 of the horizontal reflective surface 3010 is also refracted directly in front of the vacuum.

A left snap 3606 and a right snap 3608 along the left edge 3604 and the right edge 3605 of the headlight lens 2908 are adapted to snap into the corresponding left recess 3516 and right recess (not shown) in the channel 3510 of the headlight lens housing 2906. The top edge 3602 and side edges 3604, 3605 of the headlight lens 2908 fits within the channel 3510 defined by the downwardly extending flange 3508 of the headlight lens housing 2906 and the left and right sidewalls 3512, 3514 of the lens housing 2906. Accordingly, the headlight lens 2908 is assembled with the headlight lens housing 2906 by sliding the headlight lens upwardly into the channels 3510 of the left and right sidewalls 3512, 3514 of the until the snaps 3606, 3608 engage the corresponding recesses 3516 in the left and right channels. When the headlight lens 2908 is snapped into the headlight lens housing 2906, the top edge 3602 of the headlight lens is within the channel 3510 defined by the downwardly extending flange 3508. The headlight lens 2908 may be removed from the headlight lens housing 2906 by flexing the headlight lens housing 2906 until the snaps 3606, 3608 disengage and then sliding the headlight lens 2908 out of the channel 3510.

Figure 39:
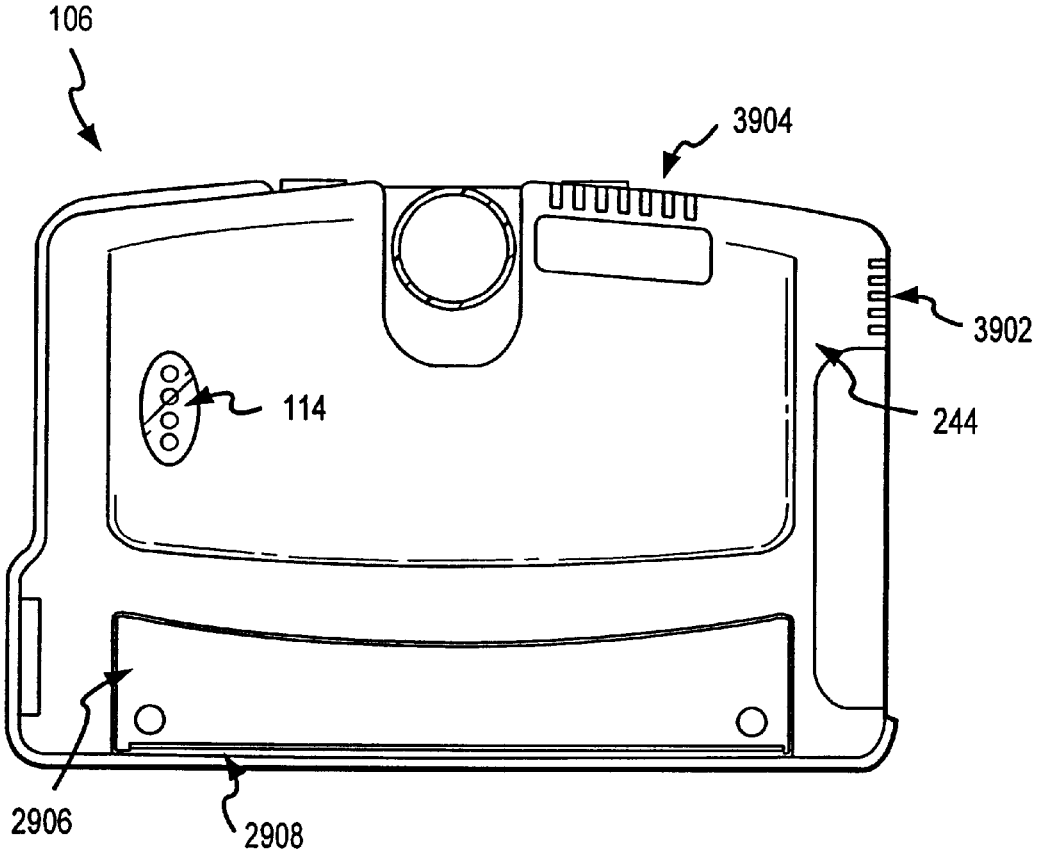
FIG. 39 is a top plan view of the vacuum head with the light assembly installed, showing the rearward offset of the headlight lens and of the headlight lens housing.
Figure 40:
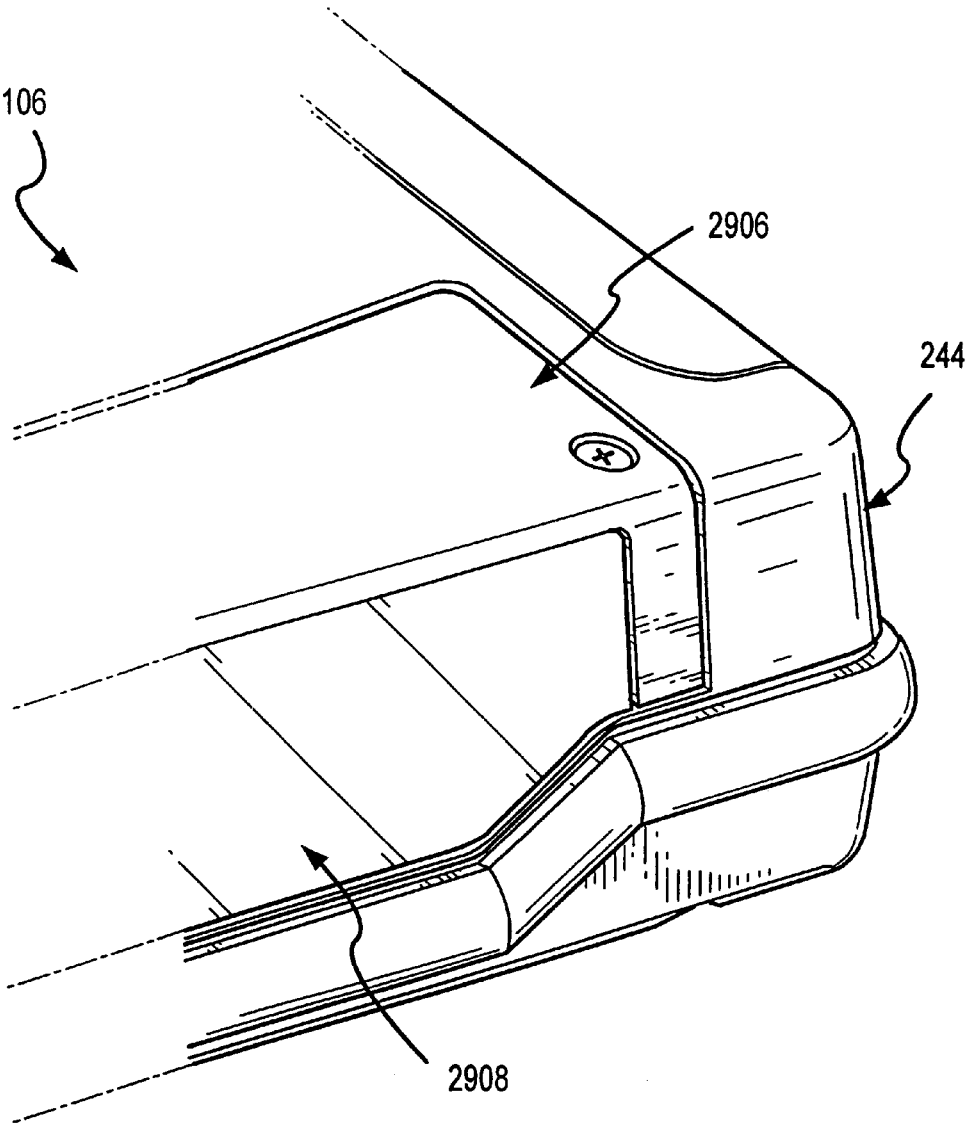
FIG. 40 is a fragmentary isometric view of the right front of the vacuum head with the light assembly installed.

As can be seen most clearly in FIG. 39 and FIG. 40, the headlight lens 2908 is offset rearwardly from the front of the vacuum head housing 106. This protects the headlight lens 2908 from collision with various objects during vacuuming. The rearward offset of the headlight lens is achieved by rearwardly offsetting the channel 3510 in the headlight lens housing 2906 in which the headlight lens 2908 is inserted, and rearwardly offsetting the headlight lens housing 2906 itself so that the headlight lens housing 2906 is recessed slightly within the top cover 244 of the vacuum head housing 106. In the most preferred embodiment, these offsets and recesses are a few thousandths of an inch.

Figure 41:
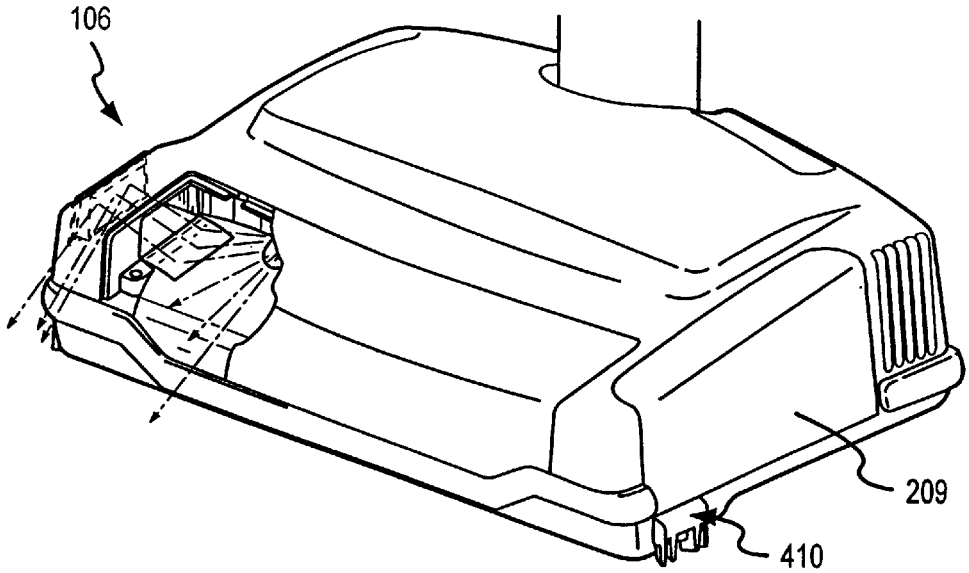
FIG. 41 is a partially cut-away, isometric view of the top and front of the vacuum head, showing the light assembly and the general pattern of light distribution from the light bulbs incident on both the sidelight lens and the headlight lens.

Referring again to FIG. 29, the light assembly 2900 of the present invention also includes the sidelight 104 (FIG. 1), which includes the reflector assembly 2904, and the sidelight lens 2912. Referring to FIG. 30, the reflector assembly 2904 includes the sidelight reflector 3009. Light transmitted directly from the left bulb 3002, and light reflected from the vertical reflective surface 3008 and horizontal reflective surface 3010 is transmitted directly and by way of the sidelight reflector 3009, to a sidelight lens 2912. The sidelight lens is affixed within a recess 2950 in the left sidewall of the vacuum head housing 106. The sidelight cavity 2910, mentioned above, extends between the recess 2950 and the headlight cavity 2902. The sidelight lens 2912 is fixed, preferably by ultrasonic welding, within the recess 2950. Accordingly, as shown to good advantage in FIG. 41, the sidelight 104 and the headlight 102 use a common light source, which, in the preferred embodiment, are the light bulbs 3002, 3004.

Figure 42:
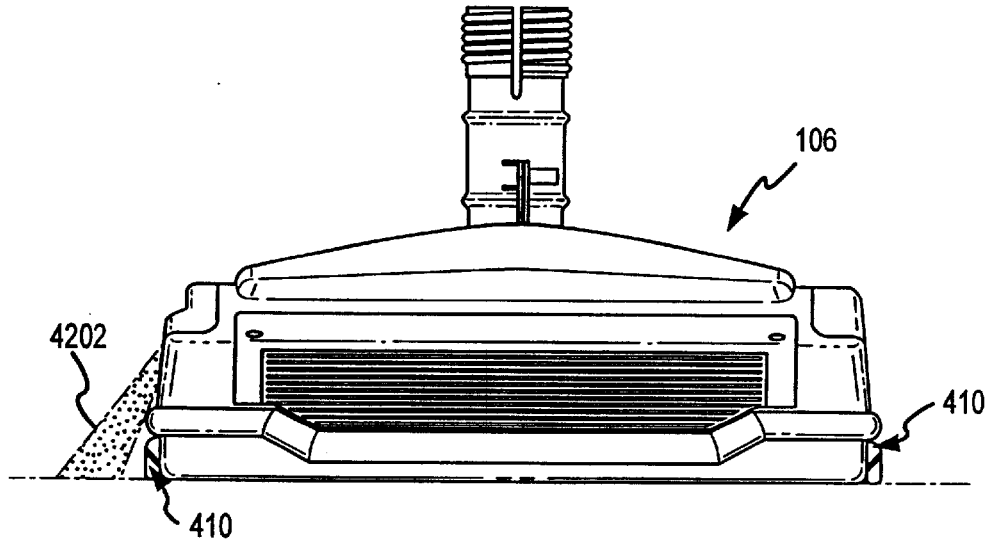
FIG. 42 is a front elevation of the vacuum head with the lights turned on, showing the light being refracted by the sidelight lens and illuminating the area downwardly and to the side of the vacuum.
Figure 43:
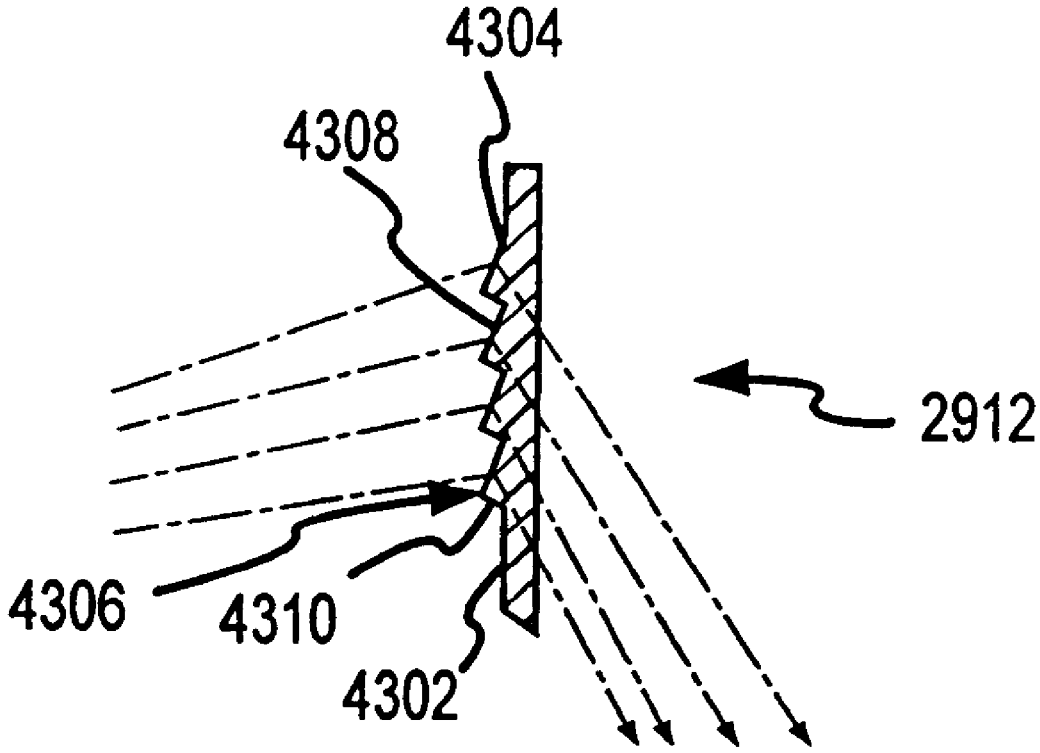
FIG. 43 is a side elevation of the sidelight lens, showing a possible light refraction pattern therefrom.
Figure 44:
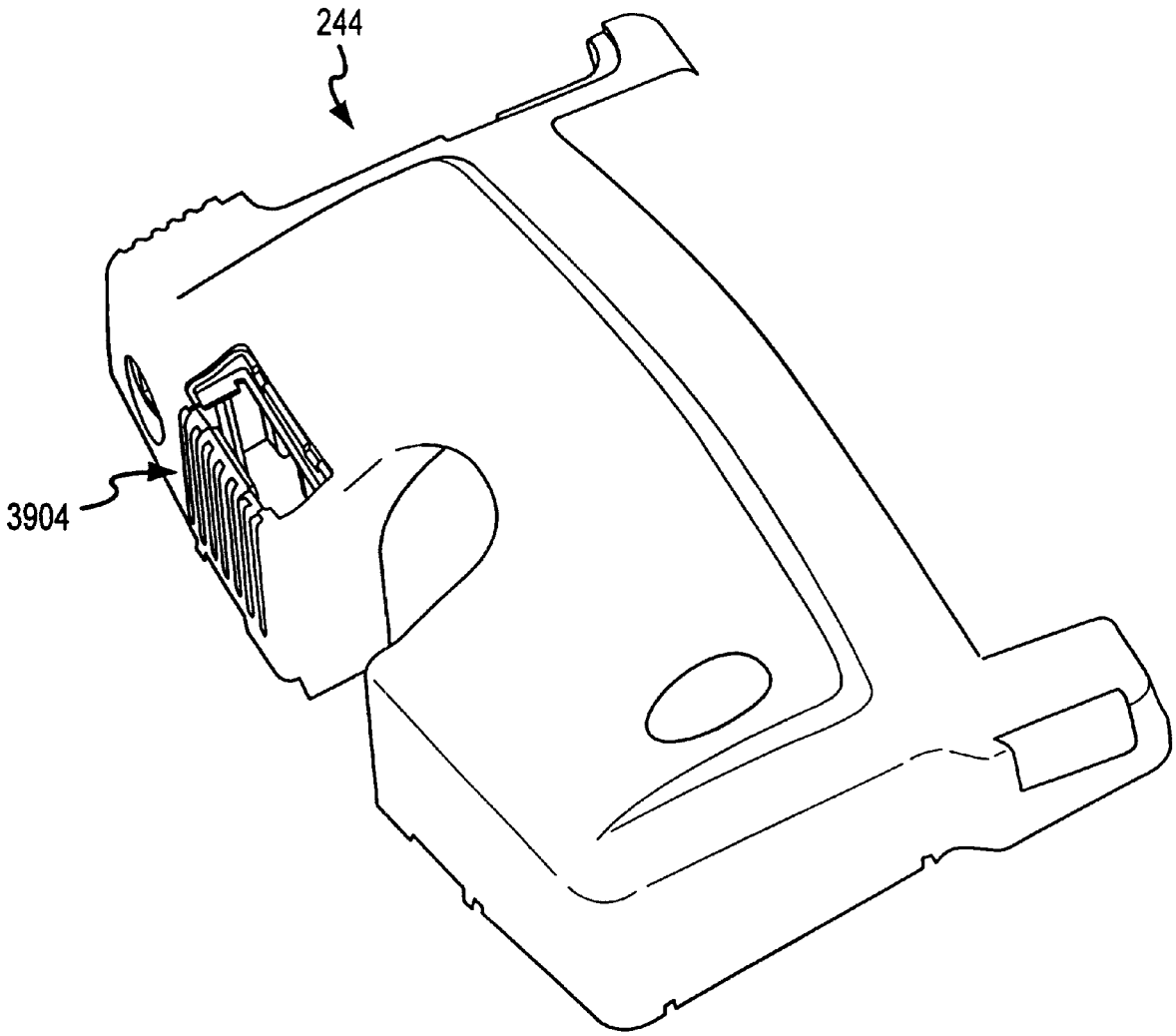
FIG. 44 is a fragmentary isometric view of the top side and rear side of the top cover of the head housing with the scent cartridge cover removed.
Figure 45:
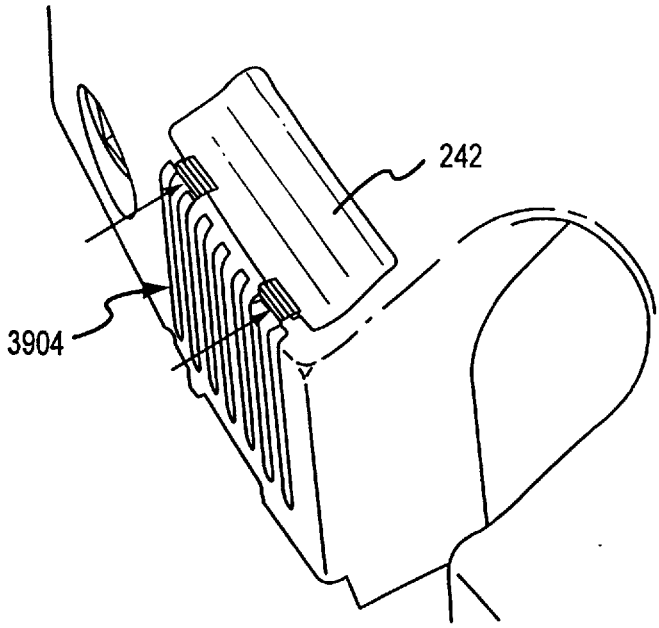
FIG. 45 is similar to FIG. 44, but is slightly enlarged and depicts the scent cartridge cover in position and closed.

A section view of the sidelight lens 2912, taken along line 43—43 of FIG. 29, is shown in FIG. 43. The rear 4302 of the sidelight lens 2912 defines a refraction contour 4304. The refraction contour 4304 defines a saw tooth pattern 4306, with each tooth having a long face 4308 and short face 4310. Light incident on the long faces 4308 is directed downwardly and outwardly from the sidelight lens 2912. FIG. 42 generally illustrates a preferred light distribution pattern 4202 from the sidelight 104. As can be seen, light is directed downwardly and outwardly from the left side of the vacuum head housing 106. Accordingly, the area that will be swept by the side brushes 410 is illuminated.

The sidelight reflector 3009 is a part of the reflector assembly 2904 and includes an upper sidelight reflector 3038 and a lower sidelight reflector 3040. The upper sidelight reflector 3038 is generally vertical and is adjacent the left most portion of the first hyperbolic reflective surface 3012. The lower sidelight reflector 3040 is generally transverse the upper sidelight reflector 3038 and canted upwardly from the horizontal reflective surface 3010 toward the sidelight lens 2912. When installing the reflector assembly 2904 within the headlight cavity 2902, the sidelight reflector portion 3009 is inserted into the sidelight cavity 2910. The sidelight reflector portion 3009 of the reflector assembly 2904 gathers light from the reflector assembly 2904 and transmits it toward the sidelight lens 2912.

The headlight 102 and the sidelight 104 of the present invention provide several advantages over the prior art headlight systems. For example, because the vertical reflective surface 3008 is contoured in two planes of curvature, the light from the light bulbs 3002, 3004 is generally more concentrated and may provide improved illumination of the floor surface in front of the vacuum head housing 106. This also allows the wattage of the light bulbs 3002, 3004 to be reduced to reduce the buildup of unwanted heat within the front headlight cavity 2902. Also, because the reflective assembly includes the horizontal reflective surface 3010 with the downwardly-sloped forward portion 3011, the headlight 102 provides improved illumination of the floor surface in front of the vacuum head housing 106. Because the headlight lens housing 2906, including the headlight lens 2908, is removable, the light assembly 2900 is easier to clean and maintain. The sidelight 104 advantageously lights the floor surface proximate the lateral side of the vacuum head housing 106, allowing the operator to better view this area of the floor surface 404 in dimly-lighted conditions.

Air Flow

FIG. 8 illustrates a schematic cross-sectional view of the vacuum head housing 106 with the head housing top cover 244 connected with the head housing bottom cover 222. The arrows shown in FIG. 8 generally illustrate a primary tortuous path 802 (shown as solid arrows) and a secondary tortuous path 804 (shown as dashed arrows) by which air flows through the vacuum head housing 106. Air flow through the vacuum head housing 106 advantageously provides cooling for the motor 204, provides cooling for the bulbs 3002, 3004, and provides cooling for the socket assemblies 3020, 3022.

The air flow is considered tortuous because the air is not allowed, by design, to flow in the most direct path from the air intake port 3902 (FIG. 39), which preferably comprises a plurality of slots, past the various components that need cooling, and out the air exhaust port 3904, which also preferably comprises a plurality of slots having the air intake port 3902 on a different side of the vacuum head housing 106 from the side having the air exhaust port 3904 helps to reduce the likelihood that hot air exiting the air exhaust port 3904 will be immediately drawn back into the air intake port 3902. Creating one or more tortuous air flow paths 802, 804 slows the air flow, which in turn allows the vacuum to run quieter than vacuums with a nontortuous air flow pattern. The tortuous air flow path, however, does not sacrifice cooling.

Referencing most specifically FIG. 8, air flow through the primary tortuous path 802 is driven primarily by the rotation of the exposed cooling vanes 801 attached with the drive shaft 206 of the motor 204. Air enters through the air intake port 3902 on the side of the head housing top cover 244. After entering the vacuum head housing 106, the air strikes a baffle plate 806. The baffle plate 806 diverts the air flow around the baffle plate, slowing the air flow down, and generally quieting the cooling operation. The baffle plate 806 also helps ensure that exhaust air, discussed below, will not be inadvertently exhausted through the air intake port 3902.

After passing the baffle plate 806, the air flows into and through the motor 204 generally along the drive shaft. Air flow through the motor 204 provides cooling for the motor and related electronic components. The air is pulled through the motor 204 along the drive shaft 210 by operation of the cooling vanes 801, which rotate along with the drive shaft 210. The air then flows transversely away from the drive shaft 210. For the primary tortuous path 802, the air flows rearwardly in the vacuum head housing 106 toward the air exhaust port 3904. Before exhausting, however, the air encounters at least one exhaust baffle 810. As with the baffle 806, the exhaust baffle 810 slows and diverts the air flow and hence quiets the air flow. Finally, after passing the exhaust baffle 810, the air flows past the scent cartridge assembly 234 and out through the air exhaust port 3904. The scent cartridge is discussed further below.

Air flow along the primary tortuous path 802 is generally restricted to a motor chamber area 808. The motor chamber 808 generally includes the space bounded by the rear wall of the headlight cavity 2902, the back end of the vacuum head housing 106, the side surface of the vacuum head housing, and the abutting cooperation between an upper motor retaining wall 712 projecting downwardly from the head housing top cover 244 and a lower motor retaining wall 714 projecting upwardly from the head housing bottom cover 222. The retaining walls 712, 714 define an aperture that helps secure the motor 204 in place.

Air flow through the secondary tortuous path 804 is also driven primarily by the cooling vanes. The air flow path through the air intake port 3902, past the baffle 806, and through the motor 204 is generally the same as the primary tortuous path 802. The air flow of the secondary tortuous path 804, unlike the primary tortuous path 802, is forced forwardly toward the right wiring harness aperture 3102*a*. The air flow then passes through the cut-out 3406 (see also FIG. 34) in the rear wall 2922 of the headlight cavity 2902, and then through the right ventilation recesses 3034. The air must flow non-linearly, upward and somewhat laterally, from the cut-out 3406 to the ventilation recesses 3034. Accordingly, as with the baffles 806, 810 the nonlinear air flow path causes the air to slow down somewhat and hence provides a quieting effect. The air flow then moves past the right socket assembly 3022 and past the right bulb 3004 removing heat therefrom. Air then moves from the right to the left in FIG. 8, through the inner area defined by the reflector assembly 2904, the headlight lens housing 2906, and the headlight lens 2908. Air then exits the reflector assembly 2904 through the ventilation recesses 3032, and passes through the cut-out 3406 behind the bulb 3002. The warm air finally flows into the generally chamber like area 812 of the vacuum head housing 106, behind the rear wall 2922 of the headlight cavity 2902. The warm air then generally seeps outwardly from the vacuum head housing 106. The generally chamber like area 812 includes the space bounded by the rear wall of the headlight cavity 2902, the back end of the vacuum head housing 106, a side surface of the vacuum head housing, and the abutting cooperation between an upper impeller fan housing retaining wall 716 and a lower impeller fan housing retaining wall 718.

Scent Cartridge

As previously discussed and as best shown in FIGS. 5, 8, and 40, the air intake port 3902 is disposed through the left side of the top cover 244. As best shown in FIGS. 8, 34, 39, and 44–47, an air exhaust port 3904 is disposed through the rear side of the top cover 244. In operation, a flow of cooling air (represented by the series of arrows in FIG. 8) is generated by the motor 204 as previously discussed. This cooling air flows through the intake port 3902, along one or more tortuous paths 802, 804 through the vacuum head housing 106, through the scent cartridge assembly 234, and out of the air exhaust port 3904. The scent cartridge assembly 234 may advantageously impart a fragrance to the cooling air, which then passes through the air exhaust port 3904 into the surrounding environment. In an alternate embodiment, the scent cartridge assembly 234 may include a filter member 238 (FIGS. 2 and 8). Preferably, the filter member 238 is capable of filtering carbon from the cooling air flow that may be emitted from the motor 204. Thus, the scent cartridge assembly 234 may advantageously improve the fragrance of the cooling air, while reducing particulates borne in the cooling air, thereby improving the operator's satisfaction with the vacuum cleaner 100.

Indicator Lights

As shown to best advantage in FIGS. 1, 29, 48, and 49, the vacuum head housing 106 includes a light pipe indicator unit 114 that engages into an elliptical recess 2952 (FIGS. 29 and 48) in the curved upper surface 116 of the top cover 244. FIG. 48 shows an enlarged, fragmentary top isometric view of the light pipe indicator unit 114 exploded above the elliptical recess 2952. As shown, the light indicator unit 114 has four light pipes 4800, which ride above and slightly displaced from LEDs 4900 on a circuit board 4802. The LEDs 4900 could selectively illuminate upon the occurrence of a predetermined condition (e.g., belt broken, vacuum clogged, bag full). Upon illumination of a particular LED, light from the LED would be transmitted or "piped" to the upper surface 116 of the top cover 244, where it would be observed by the user. When the light pipe indicator unit 114 is installed in the elliptical recess 2952 and retained in position by the retention clips 4901, the light pipes 4800 extend below the inside of the curved upper surface 116. The circuit board 4802, which is mounted to stalactite bosses 4904 extending downwardly from the inside of the curved upper surface 116 by mounting screws 4906, is positioned adjacent to, but displaced slightly from, the free distal ends of the light pipes 4800. Thus, if the upper surface of the top cover 244 flexed downwardly during operation or abuse of the vacuum 100, the possibility of that causing damage to the circuit board 4802 is reduced.

Although various embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative only and not limiting. Changes in detail or structure may be made without departing from the spirit of the invention as defined in the appended claims.

We claim:

1. An anti-ingestion bar for a vacuum cleaner having a head housing comprising holding tabs, said bar comprising:

at least two side arms, said at least two side arms including anti-ingestion portions;

a front bar portion extending between said at least two side arms, said front bar portion including at least one lateral support portion, and wherein said at least one lateral support portion is adapted to be woven around and releasably held by the holding tabs.

2. The anti-ingestion bar of claim 1, wherein said front bar portion is adapted to be joined to the head housing.

3. The anti-ingestion bar of claim 2, wherein said front bar portion is adapted to engage a bottom cover of the head housing.

4. The anti-ingestion bar of claim 1, wherein the front bar portion includes a joined series of co-planar, lateral support portions.

5. The anti-ingestion bar of claim 4, wherein said series of support portions of said front bar portion are adapted to weave between alternating holding tabs of the head housing to releasably secure the front bar portion to the head housing.

6. The anti-ingestion of claim 5, wherein the holding tabs are forwardly and rearwardly offset.

7. The anti-ingestion bar of claim 1, wherein said side arms are adapted to be releasably secured to the head housing.

8. The anti-ingestion bar of claim 7, wherein said side arms are adapted to be releasably secured to a lower surface of the head housing.

9. The anti-ingestion bar of claim 1, wherein said side arms are identical.

10. The anti-ingestion bar of claim 1, wherein said anti-ingestion portions are substantially horizontal.

11. The anti-ingestion bar of claim 1, wherein said anti-ingestion portions reside beneath a power roller brush located in the head housing.

12. The anti-ingestion bar of claim 1, wherein said side arms further comprise an upper connecting portion, a ramp portion, and a corner portion.

13. The anti-ingestion bar of claim 12, wherein said anti-ingestion portions are in a plane different from planes of said upper connecting portion, said ramp portion, and said corner portion.

14. The anti-ingestion bar of claim 1, further comprising rear anchor portions connected to said side arms.

15. The anti-ingestion bar of claim 14, wherein said side arms terminate at said rear anchor portions.

16. The anti-ingestion bar of claim 14, wherein said rear anchor portions are joined perpendicularly to said side arms.

17. The anti-ingestion bar of claim 14, wherein said rear anchor portions face in the same direction.

18. The anti-ingestion bar of claim 14, wherein said rear anchor portions face in opposite directions.

19. The anti-ingestion bar of claim 14, wherein said rear anchor portions define loops.

20. The anti-ingestion bar of claim 14, wherein said rear anchor portions are adapted to be releasably secured to the head housing.

21. The anti-ingestion bar of claim 20, wherein said rear anchor portions are adapted to be releasably secured to a lower surface of the head housing.

22. The anti-ingestion bar of claim 20, wherein the head housing comprises anchor slots, and wherein said rear anchor portions are adapted to be releasably secured to the head housing via the anchor slots.

23. The anti-ingestion bar of claim 20, wherein said rear anchor portions are adapted to be releasably secured to the head housing via at least one of the group selected from: a screw, a heat stake, and a stub.

24. The anti-ingestion bar of claim 14, wherein said rear anchor portions are covered by a squeegee.

25. The anti-ingestion bar of claim 1, further comprising a corner portion joined between said anti-ingestion portion and said front bar portion.

26. The anti-ingestion bar of claim 25, wherein said corner portion is upwardly-curved.

27. The anti-ingestion bar of claim 25, wherein said corner portion terminates at a forward end of a corresponding side arm.

28. The anti-ingestion bar of claim 25, wherein said corner portion is joined to said front bar portion.

29. The anti-ingestion bar of claim 28, wherein said corner portion is joined to at least one of said lateral support portions of said front bar portion.

30. The anti-ingestion bar of claim 29, wherein said at least one of said lateral support portions is directed inwardly from said side arm.

31. The anti-ingestion bar of claim 29, wherein said at least one of said lateral support portions is generally perpendicular to said side arm.

32. The anti-ingestion bar of claim 1, wherein said side arms further comprise a ramp portion that extends rearwardly and upwardly from said anti-ingestion portions.

33. The anti-ingestion bar of claim 32, wherein said ramp portion is joined to an upper connecting portion opposite said anti-ingestion portion.

34. The anti-ingestion bar of claim 33, wherein said upper connecting portions of said side arms are horizontally directed.

35. The anti-ingestion bar of claim 33, wherein said upper connecting portion is connected to a rear anchor portion.

36. The anti-ingestion bar of claim 35, wherein said upper connecting portion resides in the same plane as said rear anchor portions and extends forwardly towards said front bar portion.

37. The anti-ingestion bar of claim 33, wherein said anti-ingestion portions reside in a plane lower than and parallel to a plane containing a corresponding upper connecting portion.

38. The anti-ingestion bar of claim 37, wherein said plane containing a corresponding upper connecting portion further includes a corresponding rear anchor portion.

* * * * *